US007691228B2

(12) United States Patent
Edwards et al.

(10) Patent No.: US 7,691,228 B2
(45) **Date of Patent: *Apr. 6, 2010**

(54) WET CREPE THROUGHDRY PROCESS FOR MAKING ABSORBENT SHEET AND NOVEL FIBROUS PRODUCTS

(75) Inventors: Steven L. Edwards, Fremont, WI (US); Greg A. Wendt, Neenah, WI (US); Robert J. Marinack, Oshkosh, WI (US); Michael J. Vander Wielen, Neenah, WI (US); Stephen J. McCullough, Mount Calvary, WI (US); Jeffrey C. McDowell, Appleton, WI (US); Guy H. Super, Mensaha, WI (US); Gary L. Worry, Appleton, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 569 days.

This patent is subject to a terminal disclaimer.

(21) Appl. No.: 11/548,014

(22) Filed: Oct. 10, 2006

(65) Prior Publication Data

US 2007/0107863 A1 May 17, 2007

Related U.S. Application Data

(62) Division of application No. 10/806,792, filed on Mar. 23, 2004, now Pat. No. 7,160,418, which is a division of application No. 10/042,513, filed on Jan. 9, 2002, now Pat. No. 6,752,907.

(60) Provisional application No. 60/261,879, filed on Jan. 12, 2001.

(51) Int. Cl.
*B31F 1/16* (2006.01)
*D21H 27/40* (2006.01)

(52) U.S. Cl. ..... 162/111; 162/207; 428/153

(58) Field of Classification Search ..... 162/109–117, 162/204–207; 428/152–154
See application file for complete search history.

(56) References Cited

U.S. PATENT DOCUMENTS 3,301,746 A 1/1967 Sanford et al.

(Continued)

FOREIGN PATENT DOCUMENTS

CA 2053505 4/1992

(Continued)

OTHER PUBLICATIONS

B.K.G. Glifberg et al, Total Machine Concept and Considerations for Thru-Air-Dried Tissue Paper, EUCEPA 24th Conf. Proc. (Stockholm), Pap. Technol., May 8-11, 1990, 310-320.

(Continued)

*Primary Examiner*—Eric Hug
(74) *Attorney, Agent, or Firm*—Michael W. Ferrell

(57) ABSTRACT

An improved process for making sheet from a fibrous furnish includes: depositing the furnish on a foraminous support; compactively dewatering the furnish to form a nascent web; drying the web on a heated cylinder; creping the web therefrom and throughdrying the web to a finished product. The microstructure of the web is controlled so as to facilitate throughdrying. The product exhibits a characteristic throughdrying coefficient of from 4 to 10 when the airflow through the sheet is characterized by a Reynolds Number of less than about 1. The novel products of the invention are characterized by wet springback ratio, hydraulic diameter and an internal bond strength parameter.

49 Claims, 29 Drawing Sheets

U.S. PATENT DOCUMENTS

| | | | | |
|---|---|---|---|---|
| 3,432,936 | A | | 3/1969 | Cole et al. |
| 3,507,745 | A | | 4/1970 | Fuerst |
| RE28,459 | E | | 7/1975 | Cole et al. |
| 3,994,771 | A | | 11/1976 | Morgan, Jr. et al. |
| 4,016,030 | A | | 4/1977 | Sobota |
| 4,102,737 | A | | 7/1978 | Morton |
| 4,225,382 | A | | 9/1980 | Kearney et al. |
| 4,356,059 | A | | 10/1982 | Hostetler |
| 4,440,597 | A | | 4/1984 | Wells et al. |
| 4,443,299 | A | | 4/1984 | Cheshire et al. |
| 4,448,638 | A | | 5/1984 | Klowak |
| 4,462,868 | A | | 7/1984 | Oubridge et al. |
| 4,529,480 | A | | 7/1985 | Trokhan |
| 4,543,156 | A | | 9/1985 | Cheshire et al. |
| 4,689,119 | A | | 8/1987 | Weldon |
| 4,764,253 | A | | 8/1988 | Cheshire et al. |
| 5,164,045 | A | | 11/1992 | Awofeso et al. |
| 5,200,035 | A | | 4/1993 | Bhat et al. |
| 5,232,555 | A | | 8/1993 | Daunais et al. |
| 5,336,373 | A | | 8/1994 | Scattolino et al. |
| 5,411,636 | A | | 5/1995 | Hermans et al. |
| 5,494,554 | A | | 2/1996 | Edwards et al. |
| 5,495,678 | A | | 3/1996 | Ilmarinen et al. |
| 5,505,818 | A | | 4/1996 | Hermans et al. |
| 5,510,002 | A | | 4/1996 | Hermans et al. |
| 5,512,139 | A | | 4/1996 | Worcester |
| 5,607,551 | A | | 3/1997 | Farrington, Jr. et al. |
| 5,672,248 | A | * | 9/1997 | Wendt et al. ..... 162/109 |
| 5,738,760 | A | | 4/1998 | Svanqvist et al. |
| 5,851,353 | A | | 12/1998 | Fiscus et al. |
| 5,865,955 | A | | 2/1999 | Ilvespaa et al. |
| 5,891,309 | A | | 4/1999 | Page et al. |
| 5,968,590 | A | | 10/1999 | Ahonen et al. |
| 6,001,421 | A | | 12/1999 | Ahonen et al. |
| 6,036,820 | A | | 3/2000 | Schiel et al. |
| 6,119,362 | A | | 9/2000 | Sundqvist |
| 6,187,137 | B1 | * | 2/2001 | Druecke et al. ..... 162/109 |
| 6,187,139 | B1 | * | 2/2001 | Edwards et al. ..... 162/111 |
| 6,210,528 | B1 | | 4/2001 | Wolkowicz |
| 6,432,267 | B1 | * | 8/2002 | Watson ..... 162/111 |
| 6,436,234 | B1 | * | 8/2002 | Chen et al. ..... 162/109 |

FOREIGN PATENT DOCUMENTS

| | | | |
|---|---|---|---|
| CA | 2197485 | | 9/1997 |
| CA | 2241820 | | 2/1999 |
| DE | 4216264 | A1 | 11/1993 |
| EP | 0484101 | A2 | 5/1992 |
| GB | 2303647 | A | 2/1997 |
| WO | 96/09435 | | 3/1996 |

OTHER PUBLICATIONS

R. A. Parker, Economic Considerations in Through-Air-Drying, Pap. News (Valmet) 6, No. 1, 1990, 15-16.

D. Das et al, Convective Heat Transfer Under Turbulent Impinging Slot Jet at Large Temperature Differences, Drying '85, (Toei & Mujumdar, eds), Proc. Int. Drying Symp. (Kyoto) 4th, Jul. 9-12, 1984, 354-359, c1985 Hemisphere Publ. Co.

W. Kawka et al, Intensification of Paper Web Dewatering and Drying, Przeglad Papier. 45, No. 11, Nov. 1979, 402-404.

W. Kawka et al, Some Problems of Blow-Through Drying of Porous Papers, Przeglad Papier. 33, No. 8, Aug. 1977, 299-305.

M. Browning, Through-Dryer Adds New Life to Old Yankee Machine at Cascade Paper, Pulp & Paper, Sep. 1978, 78-79.

M. J. Goglia et al, Air Permeability of Parachute Cloths, Textile Research Journal, Apr. 1955, 296-313.

L. Green et al, Fluid Flow Through Porous Metals, Journal of Applied Mechanics, Mar. 1951, 39-45.

Kirk-Othmer, Flavor Characterization to Fuel Cells, Encyclopedia of Chemical Technology, 4th ed, vol. 11, 190.

Fluid and Particle Dynamics, Perry's Chemical Engineers' Handbook, 7th ed, 6-38 through 6-39.

* cited by examiner

SHOE PRESS TAPERED ON THE EXIT SIDE SO THAT BLANKET/FELT CAN BE RAPIDLY REMOVED FROM SHEET

SHOE PRESS TAPERED ON THE EXIT SIDE SO THAT FELT CAN BE RAPIDLY REMOVED FROM THE SHEET WHILE THE BLANKET IS SIMULTANEOUSLY RAPIDLY REMOVED FROM THE FELT

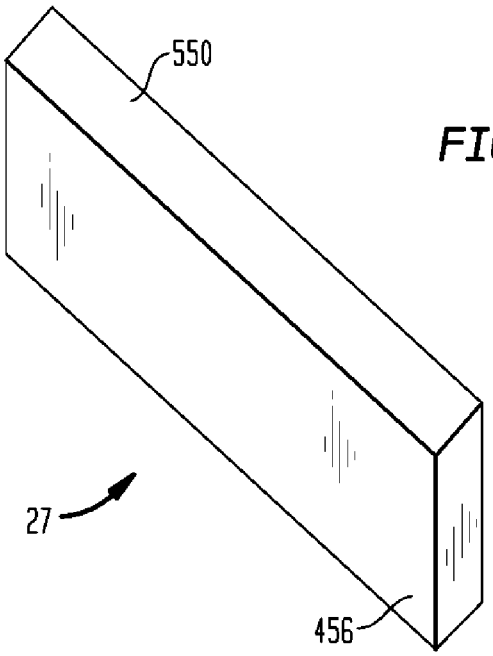
FIG. 35C
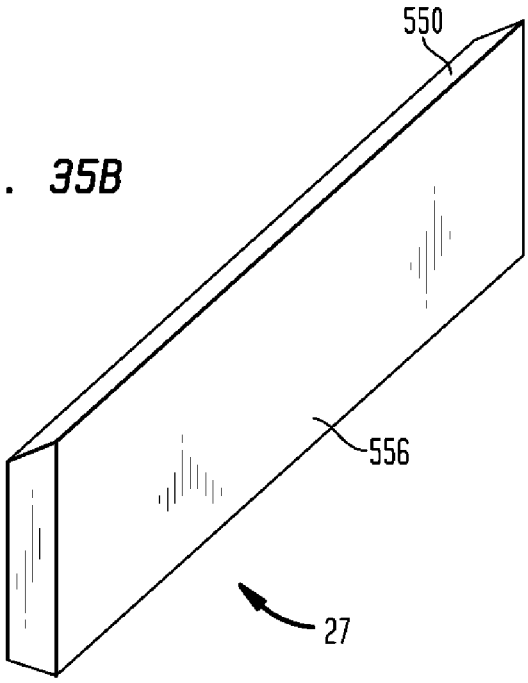
FIG. 35B
FIG. 35A
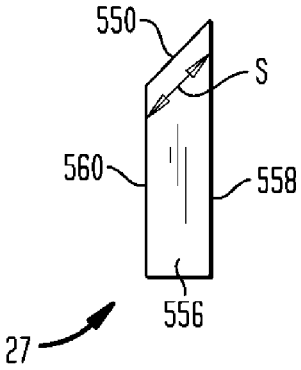

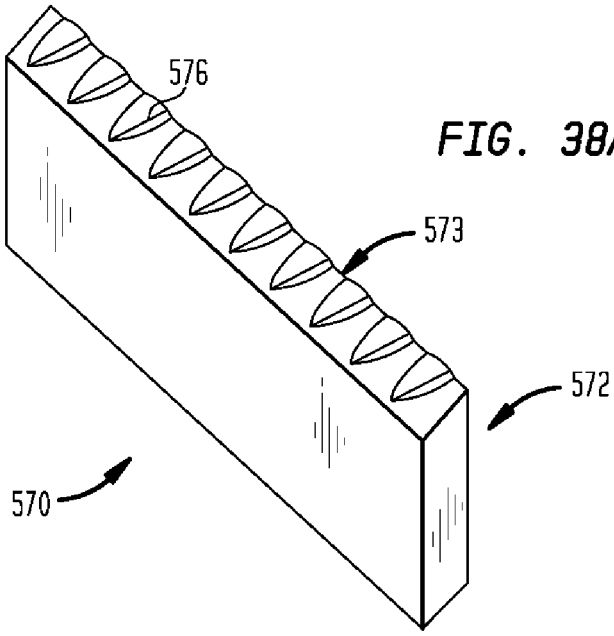
FIG. 38A
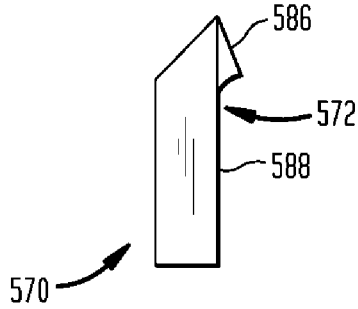
FIG. 38B
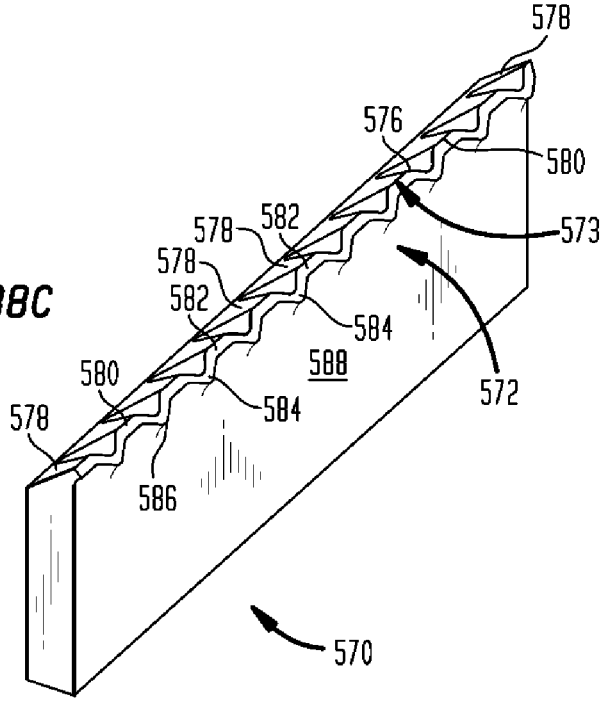
FIG. 38C
FIG. 38D
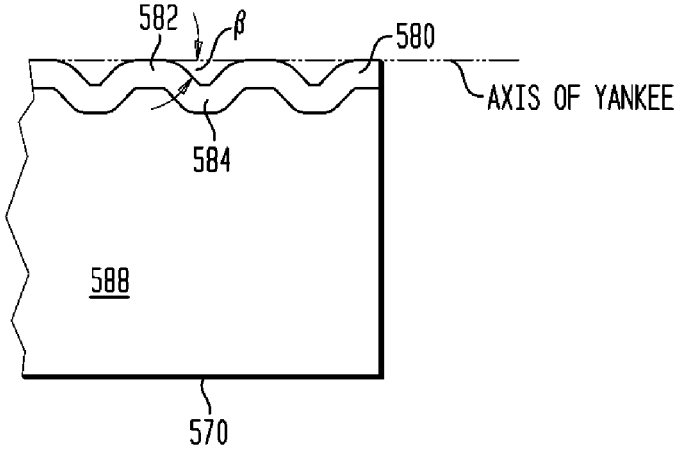

WET CREPE THROUGHDRY PROCESS FOR MAKING ABSORBENT SHEET AND NOVEL FIBROUS PRODUCTS

CLAIM FOR PRIORITY

This application is a division of U.S. patent application Ser. No. 10/806,792, filed Mar. 23, 2004, now U.S. Pat. No. 7,160,418, which is a divisional patent application of U.S. patent application Ser. No. 10/042,513, filed Jan. 9, 2002, now U.S. Pat. No. 6,752,907, which application claims the benefit of the filing date of U.S. Provisional Patent Application Ser. No. 60/261,879, filed Jan. 12, 2001. The priorities of the foregoing applications (all of the same title) are hereby claimed and their disclosures incorporated herein by reference.

TECHNICAL FIELD

The present invention relates to methods of making fibrous sheets in general, and more specifically to a wet-creped process wherein a web is compactively dewatered and thereafter creped, while controlling the permeability of the sheet to facilitate aftercrepe throughdrying and produce products of high bulk.

BACKGROUND

Methods of making paper tissue, towel, and the like are well known, including various features such as Yankee drying, throughdrying, dry creping, wet creping and so forth. Conventional wet pressing processes have certain advantages over conventional through-air drying processes including: (1) lower energy costs associated with the mechanical removal of water rather than transpiration drying with hot air; and (2) higher production speeds which are more readily achieved with processes which utilize wet pressing to form a web. On the other hand, through-air drying processes have become the method of choice for new capital investment, particularly for the production of soft, bulky, premium quality tissue and towel products.

One method of making throughdried products is disclosed in U.S. Pat. No. 5,607,551 to Farrington, Jr. et al. wherein uncreped, throughdried products are described. According to the '551 patent, a stream of an aqueous suspension of papermaking fibers is deposited onto a forming fabric and partially dewatered to a consistency of about 10 percent. The wet web is then transferred to a transfer fabric travelling at a slower speed than the forming fabric in order to impart increased stretch into the web. The web is then transferred to a throughdrying fabric where it is dried to a final consistency of about 95 percent or greater.

There is disclosed in U.S. Pat. No. 5,510,002 to Hermans et al. various throughdried, creped products. There is taught in connection with FIG. 2, for example, a throughdried/wet-pressed method of making creped tissue wherein an aqueous suspension of papermaking fibers is deposited onto a forming fabric, dewatered in a press nip between a pair of felts, then wet-strained onto a through-air drying fabric for subsequent through-air drying. The throughdried web is adhered to a Yankee dryer, further dried, and creped to yield the final product.

Throughdried, creped products are also disclosed in the following patents: U.S. Pat. No. 3,994,771 to Morgan, Jr. et al.; U.S. Pat. No. 4,102,737 to Morton; and U.S. Pat. No. 4,529,480 to Trokhan. The processes described in these patents comprise, very generally, forming a web on a foraminous support, thermally pre-drying the web, applying the web to a Yankee dryer with a nip defined, in part, by an impression fabric, and creping the product from the Yankee dryer.

As noted in the above, throughdried products tend to exhibit enhanced bulk and softness; however, thermal dewatering with hot air tends to be energy intensive and requires a relatively permeable substrate. Thus, wet-press operations are preferable from an energy perspective and are more readily applied to furnishes containing recycle fiber which tends to form webs with less permeability than virgin fiber.

The state of the art is further illustrated in the following patents. It will be appreciated that high production rates (sheet speeds) are exceedingly important to the viability of many production processes. In connection with paper manufacture, it has been suggested, for example, to employ an air foil to stabilize web transfer off of a Yankee dryer in order to maintain suitable production rates. There is disclosed, for example, in U.S. Pat. No. 5,891,309 to Page et al. a foil positioned adjacent a Yankee dryer above a creping doctor. The foil is designed to stabilize the web as it leaves the dryer and includes an air deflector positioned tangent to the Yankee dryer. The web is held against the bottom side of the foil by one or more Coanda air jets which are directed over the bottom surface of the foil. The jets are intended to prevent the web from sticking to the bottom surface of the foil while creating a Bernoulli effect which holds the web against the foil. See also, U.S. Pat. No. 5,512,139, to Worcester et al. which discloses a static foil (46, FIG. 1) intended to stabilize a sheet. Another method of facilitating transfer off a can dryer is disclosed in U.S. Pat. No. 5,232,555 to Daunais et al.

U.S. Pat. No. 5,851,353 to Fiscus et al. teaches a method for can drying wet webs for tissue products wherein a partially dewatered wet web is restrained between a pair of molding fabrics. The restrained wet web is processed over a plurality of can dryers, for example, from a consistency of about 40 percent to a consistency of at least about 70 percent. The sheet molding fabrics protect the web from direct contact with the can dryers and impart an impression on the web.

U.S. Pat. No. 5,087,324 to Awofeso et al. discloses a delaminated stratified paper towel. The towel includes a dense first layer of chemical fiber blend and a second layer of a bulky anfractuous fiber blend unitary with the first layer. The first and second layers enhance the rate of absorption and water holding capacity of the paper towel. The method of forming a delaminated stratified web of paper towel material includes supplying a first furnish directly to a wire and supplying a second furnish of a bulky anfractuous fiber blend directly onto the first furnish disposed on the wire. Thereafter, a web of paper towel is creped and embossed.

U.S. Pat. No. 5,494,554 to Edwards et al. illustrates the formation of wet press tissue webs used for facial tissue, bath tissue, paper towels, or the like, produced by forming the wet tissue in layers in which the second formed layer has a consistency which is significantly less than the consistency of the first formed layer. The resulting improvement in web formation enables uniform debonding during dry creping which, in turn, provides a significant improvement in softness and a reduction in linting. Wet pressed tissues made with the process according to the '554 patent are internally debonded as measured by a high void volume index.

Other processes such as wet crepe, throughdry processes have been suggested in the art and practiced commercially. One such process is described in U.S. Pat. No. 3,432,936 to Cole et al. The process disclosed in the '936 patent includes: forming a nascent web on a forming fabric; wet pressing the web; drying the web on a Yankee dryer; creping the web off of the Yankee dryer; and through-air drying the product.

Another wet crepe, through-air dry process is suggested in U.S. Pat. No. 4,356,059 to Hostetler. In the '059 patent there is disclosed a process including: forming a nascent web on a forming fabric; drying the web on a can dryer; creping the web off of the can dryer; through-air drying the web; applying the dry web to a Yankee dryer; creping the web from the Yankee dryer and calendering the product.

Wet crepe, through-air dry processes have not met with substantial commercial success since the process rates, product quality and machine productivity simply could not meet the demanding criteria required in the industry.

It has been found in accordance with the present invention that a wet crepe process can run at high productivity and provide a range of quality products provided certain elements of the process are properly controlled. Salient features of the present invention include: (a) creping a partially dried web off a heated dryer and (b) controlling the microstructure of the wet web such that the web is suitable for transpiration or throughdrying at high rates. These features and numerous other aspects of the present invention are described in detail below.

SUMMARY OF INVENTION

It has been found in accordance with the present invention that fibrous sheets are advantageously produced from a furnish of fibers by preparing a nascent web, controlling its porosity and microstructure while compactively dewatering the web, and at least partially throughdrying the web wherein airflow through the sheet exhibits a dimensionless characteristic Reynolds Number of less than about 1 and a characteristic dimensionless throughdrying coefficient of from about 4 to about 10. In this airflow regime, viscous pressure drop through the sheet is significant. A particularly preferred process involves: (a) depositing an aqueous furnish onto a foraminous support; (b) compactively dewatering the furnish to form a web; (c) applying the dewatered web to a heated rotating cylinder and drying the web to a consistency of greater than about 30 percent and less than about 90 percent; (d) creping the web from the heated cylinder at the aforesaid consistency; and (e) throughdrying the web subsequent to creping it from the cylinder to form the absorbent sheet. The furnish composition and the processing of steps (a), (b) and (c) as well as the creping geometry, the moisture profile of the web upon creping, the web adherence to the heated cylinder and the throughdrying conditions are controlled such that airflow through the sheet exhibits a characteristic Reynolds Number of less than about 1 and a characteristic throughdrying coefficient of from about 4 to about 10. In a typical embodiment, a method of making absorbent sheet includes: (a) depositing an aqueous cellulosic furnish on a foraminous support to form a nascent web; (b) compactively dewatering the web in a transfer nip while transferring the web to a Yankee cylinder; (c) drying the web to a consistency of from about 30 to about 90 percent on the Yankee cylinder; (d) creping the web from the Yankee cylinder; (e) transferring the web over an open draw to a throughdrying fabric while aerodynamically supporting the web; (f) re-wetting the web with an aqueous composition; (g) wet molding the re-wet web on the throughdrying fabric; and (h) throughdrying the re-wet web to form an absorbent sheet wherein airflow through the sheet exhibits a characteristic Reynolds Number of less than about 1 and a characteristic dimensionless throughdrying coefficient of from about 4 to about 10.

The novel products of the invention include fibrous sheet such as absorbent cellulosic sheet having a void volume fraction of from about 0.55 to about 0.85, a wet springback ratio of at least about 0.6 and a hydraulic diameter of from about $3\times10^{-6}$ ft to about $8\times10^{-5}$ ft. The products are distinguished from conventional wet-pressed products by their wet resilience and are distinguished from conventional throughdried products by virtue of their hydraulic properties. Conventional throughdried products are generally characterized by void volume fractions of greater than about 0.72 and hydraulic diameters of greater than about $8\times10^{-6}$ ft. The products of the present invention typically have a hydraulic diameter of less than about $7\times10^{-6}$ ft when the void volume fraction exceeds about 0.8 or so. Novel products of the present invention in some embodiments exhibit relatively high wet springback ratios as well as high internal bond strength. In general, such products exhibit a wet springback ratio of from about 0.4 to about 0.8 as well as an internal bond strength parameter of greater than about 140 g/in/mil.

There is provided in yet another aspect of the present invention a process for making fibrous sheet wherein the process generally includes depositing an aqueous furnish onto a foraminous support, compactively dewatering the furnish to form a web, applying the web to a heated rotating cylinder where the web is dried to a consistency of greater than about 30 percent and less than about 90 percent, creping the web from the heated cylinder at the aforesaid consistency and throughdrying the creped web; the improvement being controlling the characteristic void volume of the as-creped creped web such that said web exhibits a characteristic void volume upon creping in grams/g of greater than about 9.2–0.048X wherein X is the GMT of the as-creped product (grams/3") divided by the basis weight of the as-creped product (lbs/3000 $ft^2$).

In a further aspect of the present invention, there is provided a wet-crepe, throughdry process for making fibrous sheet, including the steps of: (a) depositing an aqueous furnish onto a foraminous support; (b) compactively dewatering the furnish to form a cellulosic web; (c) applying the dewatered web to a heated rotating cylinder and drying the web to a consistency of greater than about 30 percent and less than about 90 percent; (d) creping the web from the heated rotating cylinder at the aforesaid consistency of greater than about 30 percent and less than about 90 percent, wherein the furnish composition and processing of steps (a), (b) and (c), as well as the creping geometry, the temperature profile of the web upon creping, the moisture profile of the web upon creping and the web adherence to the heated cylinder are controlled such that the characteristic void volume of the web in grams/g upon creping is greater than about 9.2–0.048X wherein X is the GMT of the as-creped product (grams/3") divided by the basis weight of the as-creped product (lbs/3000 $ft^2$); and (e) throughdrying the web subsequent to creping said web from said heated cylinder to form said sheet.

The void volume of the final products is also characteristic of various processes of the invention. Thus a wet crepe, throughdry process for making fibrous sheet may include the steps of: (a) depositing an aqueous furnish onto a foraminous support; (b) compactively dewatering the furnish to form a web; (c) applying the dewatered web to a heated rotating cylinder and drying the web to a consistency of greater than about 30 percent and less than about 90 percent; and (d) creping the web from the heated cylinder at the consistency of greater than about 30 percent and less than about 90 percent, wherein the furnish composition and processing of steps (a), (b) and(c), as well as the creping geometry, temperature profile of the web upon creping, moisture profile of the web upon creping and web adherence to the heated rotated cylinder are controlled; and (e) throughdrying the web subsequent to creping the web from the heated cylinder to form the sheet, wherein the void volume of the sheet in grams/g is greater than about 9.2−0.048X wherein X is the GMT of the product (grams/3") divided by the basis weight of the product (lbs/3000 $ft^2$).

In some embodiments of the present invention there is provided a method of making absorbent sheet including delamination creping including the steps of: (a) depositing an aqueous furnish onto a foraminous support; (b) compactively dewatering the furnish to form a web; (c) applying the web to a heated rotating cylinder; (d) maintaining the surface of the rotating cylinder at an elevated temperature relative to its surroundings so as to produce a temperature gradient between the air and cylinder side of the web; (e) drying the web on the cylinder to a consistency of between about 30 and about 90 percent; (f) creping said web from said cylinder, wherein said creping is operative to delaminate said web and said web exhibits a characteristic void volume upon creping in grams/g of greater than about 9.2−0.048X wherein X is the GMT of the as-creped product (grams/3") divided by the basis weight of the as-creped product (lbs/3000 $ft^2$); and (g) throughdrying the web to form the sheet. The delamination process noted above may also be defined in terms of the product produced thereby or in other words, an inventive method likewise includes: (a) depositing an aqueous furnish onto a foraminous support; (b) compactively dewatering the furnish to form a web; (c) applying the web to a heated rotating cylinder; (d) maintaining the surface of the rotating cylinder at an elevated temperature relative to its surroundings so as to produce a temperature gradient between the air and cylinder sides of the web; (e) drying the web on the cylinder to a consistency of between about 30 to about 90 percent; (f) creping the web from the cylinder, wherein the creping is operative to delaminate the web; and (g) drying the web to form the absorbent sheet, wherein the void volume in grams/g of the sheet is greater than about 9.2−0.048X wherein X is the GMT of the sheet (grams/3") divided by the basis weight of the sheet (lbs/3000 $ft^2$). Delamination of a sheet refers to the fact that a creped sheet has a reduced density about its center, that is, a reduced fiber density in the interior of the sheet. In the extreme, the product is separated into separate plies and the fiber density approaches 0 at a plane in the interior of the product. Further aspects and advantages of the present invention are described in detail hereinafter.

As used herein, terminology is given its ordinary meaning unless otherwise defined or the definition of the term is clear from the context. For example, the term percent or % refers to weight percent and the term consistency refers to weight percent of fiber based on dry product unless the context indicates otherwise. Likewise, "ppm" refers to parts by million by weight, and the term "absorbent sheet" refers to tissue or towel made from cellulosic fiber.

The terms "fibrous", "aqueous furnish" and the like include all sheet-forming furnishes and fibers. The term "cellulosic" is meant to include any material having cellulose as a major constituent, and, specifically, comprising at least 50 percent by weight cellulose or a cellulose derivative. Thus, the term includes cotton, typical wood pulps, cellulose acetate, cellulose triacetate, rayon, thermomechanical wood pulp, chemical wood pulp, debonded chemical wood pulp, milkweed, and the like. "Papermaking fibers" include all known virgin or recycle cellulosic fibers or fiber mixes comprising cellulosic fibers. Fibers suitable for making the webs of this invention comprise any natural or synthetic cellulosic fibers including, but not limited to: nonwood fibers, such as cotton fibers or cotton derivatives, abaca, kenaf, sabai grass, flax, esparto grass, straw, jute hemp, bagasse, milkweed floss fibers, and pineapple leaf fibers; and wood fibers such as those obtained from deciduous and coniferous trees, including softwood fibers, such as northern and southern softwood kraft fibers; hardwood fibers, such as eucalyptus, maple, birch, aspen, or the like. Woody fibers may be prepared in high-yield or low-yield forms and may be pulped in any known method, including kraft, sulfite, groundwood, thermomechanical pulp (TMP), chemithermomechanical pulp (CTMP) and bleached chemithermomechanical pulp (BCTMP). High brightness pulps, including chemically bleached pulps, are especially preferred for tissue making, but unbleached or semi-bleached pulps may also be used. Recycled fibers are included within the scope of the present invention. Any known pulping and bleaching methods may be used. Synthetic cellulose fiber types include rayon in all its varieties and other fibers derived from viscose or chemically modified cellulose. Chemically treated natural cellulosic fibers may be used such as mercerized pulps, chemically stiffened or crosslinked fibers, sulfonated fibers, and the like. Suitable papermaking fibers may also include recycled fibers, virgin fibers, or mixtures thereof.

Unless otherwise indicated, "geometric mean tensile strength" (GMT) is the square root of the product of the machine direction tensile strength and the cross-machine direction tensile strength of the web. Tensile strengths are measured with standard Instron test devices which may be configured in various ways, one of which may be described as having a 5-inch jaw span or more using 3-inch wide strips of tissue or towel, conditioned at 50% relative humidity and 72° F. for at least 24 hours, with the tensile test run at a crosshead speed of 1 in/min. As discussed below in connection with the internal bond strength parameter, the 3" GMT is divided by 3 for convenience in expressing the parameter in g/in/mil.

The "void volume", as referred to hereafter, is determined by saturating a sheet with a nonpolar liquid and measuring the amount of liquid absorbed. The volume of liquid absorbed is equivalent to the void volume within the sheet structure. The void volume is expressed as grams of liquid absorbed per gram of fiber in the sheet structure. More specifically, for each single-ply sheet sample to be tested, select 8 sheets and cut out a 1 inch by 1 inch square (1 inch in the machine direction and 1 inch in the cross-machine direction). For multi-ply product samples, each ply is measured as a separate entity. Multiple samples should be separated into individual single plies and 8 sheets from each ply position used for testing. Weigh and record the dry weight of each test specimen to the nearest 0.0001 gram. Place the specimen in a dish containing POROFIL™ liquid, having a specific gravity of 1.875 grams per cubic centimeter, available from Coulter Electronics Ltd., Northwell Drive, Luton, Beds, England; Part No. 9902458.) After 10 seconds, grasp the specimen at the very edge (1-2 millimeters in) of one corner with tweezers and remove from the liquid. Hold the specimen with that corner uppermost and allow excess liquid to drip for 30 seconds. Lightly dab (less than ½ second contact) the lower corner of the specimen on #4 filter paper (Whatman Ltd., Maidstone, England) in order to remove any excess of the last partial drop. Immediately weigh the specimen, within 10 seconds, recording the weight to the nearest 0.0001 gram. The void volume for each specimen, expressed as grams of POROFIL per gram of fiber, is calculated as follows:

$$\text{void volume}=[W_2-W_1)/W_1],$$

wherein

"W1" is the dry weight of the specimen, in grams; and

"W2" is the wet weight of the specimen, in grams.

The void volume for all eight individual specimens is determined as described above and the average of the eight specimens is the void volume for the sample.

The dimensionless void volume fraction and/or void volume percent is readily calculated from the void volume in grams/gm by calculating the relative volumes of fluid and fiber determined by the foregoing procedure, i.e., the void volume fraction is the volume of Porofil® liquid absorbed by the sheet divided by the volume of fibrous material plus the volume of Porofil liquid absorbed (total volume) or in equation form $$\begin{aligned}\text{void volume fraction} &= (\text{void volume} \times \text{specific volume of fluid})/\\ &\quad (\text{void volume} \times \text{specific volume of fluid} + \\ &\quad \text{specific volume of fiber})\\ &= \text{void volume} \times 0.533/(\text{void volume} \times 0.533 + \\ &\quad \text{specific volume of fiber})\end{aligned}$$

Unless otherwise indicated, the specific volume of fiber is taken as unity. Thus a product having a void volume of 6 grams/gm has a void volume fraction of 3.2/4.2 or 0.76 and a void volume in percent of 76% as that terminology is used herein.

The products and processes of the present invention are advantageously practiced with cellulosic fiber as the predominant constituent fiber in the furnishes and products, generally greater than 75% by weight and typically greater than 90% by weight of the product. Nevertheless, as one of skill in the art will appreciate, the invention may be practiced with other suitable furnishes.

BRIEF DESCRIPTION OF THE DRAWINGS

The invention is described in detail below in connection with numerous embodiments and drawings wherein like numerals refer to similar parts. In the drawings:

FIGS. 35A-C are diagrams of a narrow creping ledge beveled creping blade useful in connection with the present invention;

FIGS. 38A-38D are diagrams of an undulatory creping blade useful in connection with the process of the present invention.

DETAILED DESCRIPTION

Figure 1:
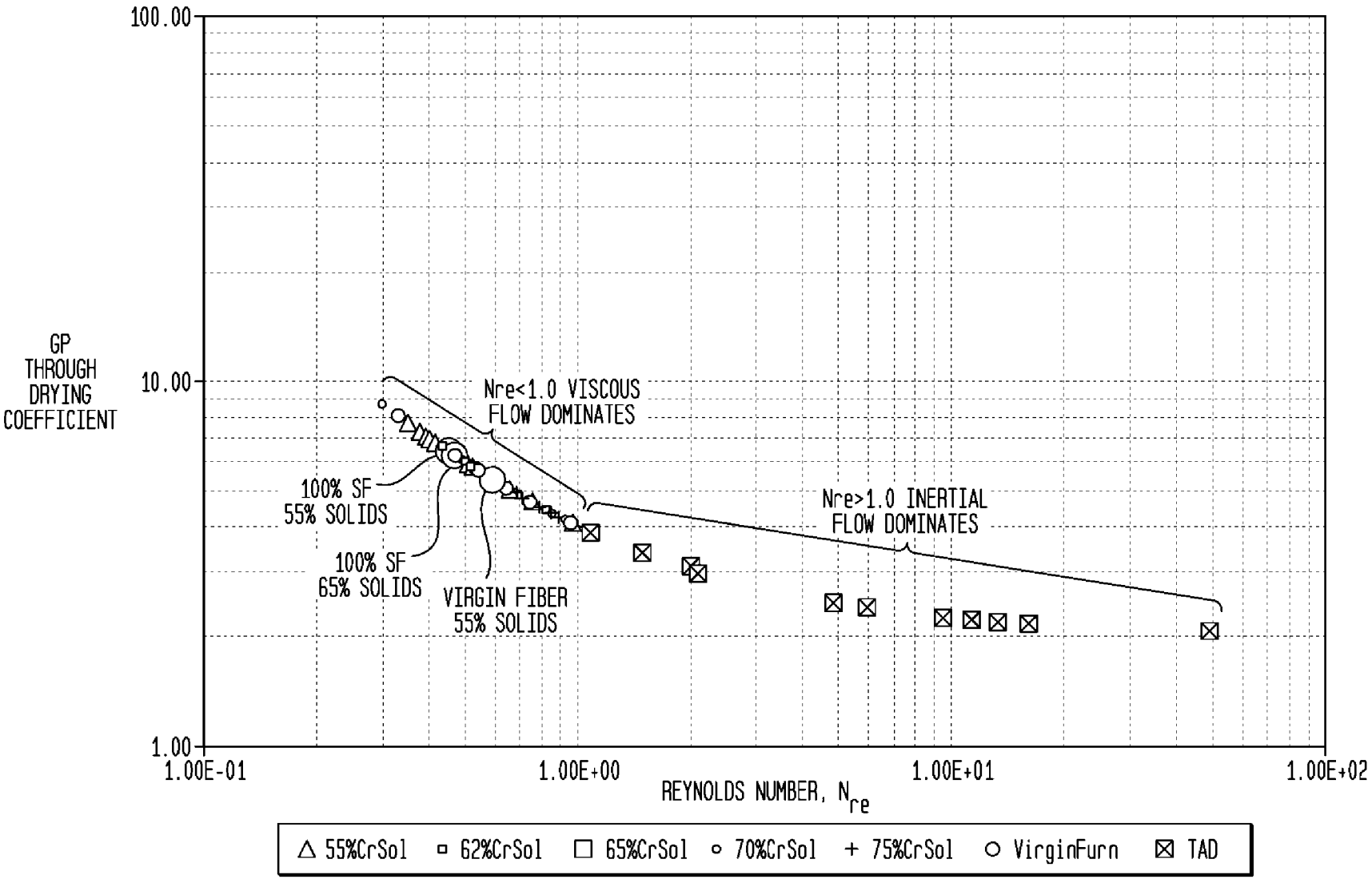
FIG. 1 is a plot of the characteristic Georgia-Pacific Throughdrying Coefficient versus characteristic Reynolds Number.

The present invention is directed, in part, to methods of making fibrous, typically paper products having improved processability, bulk, absorbency and softness. The processes according to the present invention can be practiced on any papermaking machines of conventional forming configuration if so desired, or on a machine particularly adapted for high speed manufacture of wet-creped products as described herein. While the invention is described hereinafter with respect to particular embodiments, modifications or variations to such embodiments within the spirit and scope of the invention will be readily apparent to those of skill in the art. The present invention is defined in the claims appended hereto.

Improved processes of making absorbent sheet in accordance with the invention include preparing a nascent web from a cellulosic furnish while controlling its microstructure and at least partially throughdrying the web wherein the airflow through the sheet exhibits a characteristic Reynolds Number (dimensionless, as hereinafter described) of less than about 1 and a characteristic dimensionless throughdrying coefficient of from about 4 to about 10. Throughdrying coefficients of from about 5 to about 7 are typical in some embodiments as is a Reynolds Number of less than about 0.75. The parameters may be determined while making the sheet, or measured on a finished (dry) product by measuring pressure drop therethrough as a function of airflow as described herein. Characteristic values of throughdrying coefficients and Reynolds numbers are obtained at substantially ambient conditions on dry sheet at a pressure drop across the sheet of 20 inches of water or so. A characteristic Reynolds Number of less than about 0.75 or even 0.5 is somewhat typical, particularly with respect to products made from recycle furnish. The flow characteristics of the sheet are relatively insensitive to moisture content, particularly when the consistency of the sheet is above about 50 percent.

Some products of the invention generally have a void volume fraction of from 0.55 to about 0.85 and are characterized by wet resilience which is manifested by a wet springback ratio of at least about 0.6 as well as hydraulic diameters of from about $3\times10^{-6}$ ft to about $8\times10^{-5}$ ft with the provisos that when the void volume fraction of the sheet exceeds about 0.72, the hydraulic radius is less than about $8\times10^{-6}$ ft and when the void volume fraction of the sheet exceeds about 0.8, the hydraulic diameter of the sheet is less than about $7\times10^{-6}$. Typically, the hydraulic diameter of the inventive products is between about $3\times10^{-6}$ and $6\times10^{-5}$ ft. The wet springback ratio is preferably at least about 0.65 and typically between about 0.65 and 0.75. Products including recycle fiber particularly usually exhibit a void volume fraction of less than 0.72 and a hydraulic diameter of from about $3\times10^{-6}$ to $6\times10^{-5}$ ft. Wet springback ratios of at least about 0.65 are generally preferred and a value between about 0.65 and 0.75 are typical. Hydraulic diameters between about $4\times10^{-6}$ ft and $8\times10^{-6}$ ft are somewhat typical as are hydraulic diameters between about 4-$7\times10^{-6}$ ft or 4-$6\times10^{-6}$ ft. The web may be prepared from a fibrous furnish including fiber other than virgin cellulosic or virgin wood fiber such as straw fibers, sugarcane fibers, bagasse fibers and synthetic fibers. Likewise, a variety of additives may be included in the furnish to adjust the softness, strength or other properties of the product. Such additives may include surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof, such chemicals optionally comprising polyols, starches, PPG esters, PEG esters, phospholipids, surfactants, polyamines or the like.

A particularly preferred process of the invention includes compactively dewatering a nascent web, followed by drying the web on a heated rotating cylinder, followed by wet creping the web from the cylinder, followed by throughdrying the creped web, sometimes referred to as the YTAD process herein. As part of this process, the web may be wet-molded on an impression fabric after creping from the drying cylinder. In some embodiments of the process it is desirable to re-wet the creped web with an aqueous composition prior to wet-molding the web. The aqueous composition can include any process or functional additive. Such additives include softeners, debonders, starches, strength aids, retention aids, barrier chemicals, wax emulsions, surface modifiers, antimicrobials, botanicals, latexes, binders, absorbency aids or combinations thereof, said additives optionally including phospholipids, polyamines, PPG esters, PEG esters and polyols, or the like. A preferred group of additives may be wet strength resins, dry strength resins and softeners. The web may be dried to a consistency of greater than 60 percent prior to creping and then re-wet to a consistency (weight percent solids) of less than about 60 percent prior to molding.

The products and processes of the present invention are better understood by considering their hydraulic properties as well as wet resilience.

Throughdrying Coefficient and Hydraulic Diameter

Background material with respect to fluids, in general, appears in various texts, see, e.g., Liepmann, H. W. and A. Roshko, *Elements of Gas Dynamics, Wiley*, N.Y. (1957); Streeter, V. L. and E. B. Wylie, *Fluid Mechanics*, McGraw-Hill, N.Y., 1975, as well as the following articles specifically relating to flow through porous media: Green et al., *Fluid Flow Through Porous Metals, Journal of Applied Mechanics*, pp. 39-45 (March, 1951); and Goglia et al., *Air Permeability of Parachute Cloths, Textile Research Journal*, pp. 296-313 (April, 1955). Throughdry processes for absorbent sheet are generally carried out with pressure drops across the sheet of 20' of water or so. It has been found that processes and products of the present invention can be differentiated from known products and processes on the basis of wet resiliency, hydraulic diameter and a dimensionless throughdrying parameter or drag coefficient, $\omega_{GP}$, termed herein the Georgia-Pacific Throughdrying Coefficient. As will be appreciated from the discussion which follows, throughdrying fibrous sheet is advantageously carried out in the flow regime where viscous pressure drop predominates.

The complexity of flow through porous structures such as absorbent sheet requires the use of dimensional analysis in order to approach the fluid-flow problem. In the case of a viscous liquid flowing thorough a porous medium, dimensional considerations show that when changes in elevation are neglected, the pressure gradient in the system may be expressed as $$-\frac{dP}{dx} = const \times \frac{\mu^2}{\rho\delta^3} \times F\left(\frac{\delta\rho V}{\mu}\right)$$

where

P=fluid pressure x=length variable

μ=viscosity of fluid

ρ=density of fluid

δ=a length characterizing pore openings

F=an unknown function

V=superficial bulk velocity of fluid

For low values of velocity, $$-\frac{dP}{dx} = const \times \frac{\mu V}{\delta^2} \quad [2]$$

which is the result experimentally verified by Darcy. Flows at sufficiently high values of Reynolds number, however, are characterized by the fact that the function F is proportional to the square of its argument. Thus Equation [1] takes the form $$-\frac{dP}{dx} = const \times \frac{\rho V^2}{\delta} \quad [3]$$

In the case of a porous medium, the losses due to the inertia of the fluid become progressively more important with increasing velocity. The gradual transition from the Darcy regime is marked by losses due to both viscous shear in creeping flow and to inertial effects; hence terms proportional to both the first and second power of the velocity must be included in the pressure-gradient equation as suggested by Forchheimer. By including the length parameter δ in the unknown constants, Equations [2] and [3] may be combined into the form $$-\frac{dP}{dx} = \alpha\mu V / g_c + \beta\rho V^2 / g_c \quad [4]$$

The two coefficients α and β defined by Equation [4] are independent of the mechanical properties of the fluid which were considered in the derivation. Having only the dimensions of length, they characterize the structure of the porous material itself, and hereafter will be referred to as viscous and inertial resistance coefficients of the material. It may be noted that the viscous coefficient α, of dimension $[L^{-2}]$, is the inverse of a permeability coefficient defined by Darcy's law. The inertial coefficient β with dimensions $[L^{-1}]$ may be interpreted as a measure of the tortuosity of the flow channels, perhaps as an average curvature of the streamlines determining the accelerations experienced by the fluid. In terms of the conventional concept of kinetic-energy losses, β might represent a resistance equivalent to a certain number of contractions and expansions per unit length of path.

The momentum equation may thus be written:

$$g_c dP + \alpha\mu V \cdot dx + \beta\rho V^2 \cdot dx + \rho V \cdot dV = 0 \quad [5]$$

Now, multiplying through by ρ, and by defining the mass velocity, G, as equal to the product ρV, i.e., having units $Mt^{-1}L^{-2}$, equation [5] becomes $$g_c \rho dP + \alpha\mu G \cdot dx + \beta G^2 \cdot dx + G\rho \cdot d(G/\rho) = 0 \quad [6]$$

In the case of an adiabatic, isentropic process, and a gas having the equation of state η=P/RT, where η is the molar density, the following definitions arise from thermodynamics:

$$C_V = \left(\frac{\partial U}{\partial T}\right)_V \quad [7]$$

Defining relationship for heat capacity at constant volume. $U$ is internal energy $$C_P = \left(\frac{\partial H}{\partial T}\right)_P \quad [8]$$

Defining relationship for heat capacity at constant pressure. $H$ is enthalpy.

$$H = U + P/\eta \quad [9]$$

Defining relationship for enthalpy.

From thermodynamics, we know that H, U, $C_v$ and $C_p$ are functions of temperature alone, independent of P and V, for a gas with the equation of state η=P/RT. Thus, we can separate equations [7] and [8], and integrate to obtain:

$$dU = C_V \cdot dT \quad [10]$$

$$dH = C_P \cdot dT \quad [11]$$

from which:

$$U_2 - U_1 = C_V(T_2 T_1) \quad [12]$$

and $$H_2 - H_1 = C_P(T_2 - T_1) \quad [13]$$

which describe the internal energy changes for an ideal gas.

The definition of enthalpy, in differential form, $$dH = dU + R \cdot dT \quad [14]$$

can be rewritten using equations [10] and [11] to form, $$C_P \cdot dT = C_V dT + R \cdot dT \quad [15]$$

and, $$C_P = C_V + R \quad [16]$$

If we define k to be the ratio of heat capacities, $$k = \frac{C_P}{C_V} \quad [17]$$

The following useful relations arise by substitution into [11]:

$$C_P = \frac{k}{k-1} R \quad [18]$$

$$C_V = \frac{1}{k-1} R \quad [19]$$

Turning to the 1st Law of Thermodynamics, the Principle of Conservation of Energy can be expressed as, $$T \cdot dS = dU + P \cdot d\left(\frac{1}{\eta}\right) \quad [20]$$

which also serves as the defining relationship for S, the Entropy. Note that unlike H, U, $C_P$ and $C_V$, S is a function of both T and P (or, equivalently, T and V).

Rewriting [20] with appropriate substitutions provides, $$dS = \frac{1}{T} \cdot dU + \frac{P}{T} \cdot d\left(\frac{1}{\eta}\right) \quad [21]$$

$$= \frac{C_V}{T} \cdot dT + R\eta \cdot d\left(\frac{1}{\eta}\right) \quad [22]$$

which may be integrated to provide, $$S_2 - S_1 = C_V \ln\left(\frac{T_2}{T_1}\right) + R\ln\left(\frac{\eta_1}{\eta_2}\right) \quad [23]$$

Utilizing [19], we obtain, $$S_2 - S_1 = C_V \ln\left(\frac{T_2}{T_1}\right) + C_V(k-1)\ln\left(\frac{\eta_1}{\eta_2}\right) \quad [24]$$

$$= C_V \ln\left[\left(\frac{T_2}{T_1}\right)\left(\frac{\eta_1}{\eta_2}\right)^{k-1}\right] \quad [25]$$

$$= C_V \ln\left[\left(\frac{P_2}{P_1}\right)\left(\frac{\eta_1}{\eta_2}\right)^{k}\right] \quad [26]$$

$$= C_V \ln\left[\left(\frac{T_2}{T_1}\right)^{k}\left(\frac{P_2}{P_1}\right)^{1-k}\right]$$

Equations [25] to [27] provide equivalent forms of the 2nd Law of Thermodynamics.

Since we are dealing here with an isentropic process, dS=0, $$S_2 - S_1 = 0 = C_V \ln\left[\left(\frac{P_2}{P_1}\right)\left(\frac{\eta_1}{\eta_2}\right)^{k}\right] \quad [28]$$

and $$\left[\left(\frac{P_2}{P_1}\right)^{1/k} = \left(\frac{\eta_1}{\eta_2}\right)^{k}\right] \quad [29]$$

so that, for an adiabatic, isentropic process, $$\eta_2 = \left(\frac{P_2}{P_1}\right)^{1/k} \eta_1 \quad [30]$$

Thus, the system can be described at any future equilibrium state if the initial equilibrium state is described by equation [30]. Equation [30] may be written in Engineering Units by replacing $\eta_i$ with $\eta_i$ and the relationship:

$$\rho_2 = \left(\frac{P_2}{P_1}\right)^{1/k} \rho_1 \quad [30a]$$

We may now re-write equation [6] in light of the Thermodynamic relations developed above:

$$0 = g_c\rho_1\left(\frac{P}{P_1}\right)^{1/k} \cdot dP + \alpha\mu G \cdot dx + \beta G^2 \cdot dx + \rho G^2 \cdot d\left(\frac{1}{\rho}\right) \quad [31]$$

Simplifying, and integrating from x=O to L, and $P=P_1$ to $P_2$, provides, $$0 = \frac{g_c\rho_1}{P_1^{\gamma-1}} \cdot \frac{P_2^{\gamma} - P_1^{\gamma}}{\gamma} + [\alpha\mu + \beta G]GL + (\gamma-1)G^2\ln\left(\frac{P_1}{P_2}\right) \quad [32]$$

where $$\gamma = 1 + \frac{1}{k} = \frac{k+1}{k}$$

Collecting terms, $$\frac{g_c\rho_1}{GLP_1^{\gamma-1}} \cdot \frac{P_1^{\gamma} - P_2^{\gamma}}{\gamma} = \alpha\mu + \beta G + (\gamma-1)\frac{G}{L}\ln\left(\frac{P_1}{P_2}\right) \quad [33]$$

and rearranging, $$\frac{g_c\rho_1}{GLP_1^{\gamma-1}} \cdot \frac{P_1^{\gamma} - P_2^{\gamma}}{\gamma} + (\gamma-1)\frac{G}{L}\ln\left(\frac{P_2}{P_1}\right) = \alpha\mu + \beta G \quad [34]$$

This equation may be used with laboratory air-permeability data to obtain values for α and β through simple linear regression.

If one can accept the assumption of an isothermal process, equation [34] can be further simplified, as in the isothermal case, k=1, and [34] becomes:

$$\frac{g_c\rho_1}{GLP_1} \cdot \frac{P_1^2 - P_2^2}{2} + \frac{G}{L}\ln\left(\frac{P_2}{P_1}\right) = \alpha\mu + \beta G \quad [35]$$

And since we assume an Ideal Gas equation of state ρ=PM/RT, where M is the molecular weight, lbm/lb-mol and we have:

$$\frac{Mg_c}{GLRT_1} \cdot \frac{P_1^2 - P_2^2}{2} + \frac{G}{L}\ln\left(\frac{P_2}{P_1}\right) = \alpha\mu + \beta G \quad [36]$$

and $$\frac{Mg_c}{2GLRT_1} \cdot (P_1^2 - P_2^2) + \frac{G}{L}\ln\left(\frac{P_2}{P_1}\right) = \alpha\mu + \beta G \quad [37]$$

which lends itself to the linear regression process.

Under typical through-air drying conditions, the value of $P_2$ will differ very little from that of $P_1$ (on an absolute pressure scale), such that the ratio of $P_1$ to $P_2$ will be very nearly unity. In the limit, as $(P_1/P_2)$ approaches unity, the term, $$\frac{G}{L}\ln\left(\frac{P_2}{P_1}\right) \quad [38]$$

approaches zero. It has been found through laboratory experimentation that the elimination of the term [38] has little effect on the values of α and β predicted by the data. Hence, the further simplification:

$$\frac{Mg_c}{2GLRT_1}\cdot(P_1^2-P_2^2)=\alpha\mu+\beta G \quad [39]$$

which proves adequate under most conditions.

Now the Reynolds number for air flow through the fibrous cellulosic sheet can be inferred from its definition as the ratio of inertial to viscous forces at a point in the flow and from the significance of the terms in equation [4], $$N_{Re}=\frac{\text{Inertia_force}}{\text{Viscous_force}}=\frac{\beta\rho V}{\alpha\mu}=\frac{(\beta/\alpha)\rho V}{\mu}=\frac{(\beta/\alpha)G}{\mu} \quad [40]$$

where β/α the hydraulic diameter, whose measure is length, is now understood to characterize the geometry of the flow through the interstices of the sheet. Furthermore, from equations [4] and [39] one can infer the existence of a dimensionless coefficient of throughdrying air flow, termed herein the Georgia-Pacific (GP) Throughdrying Coefficient, as the ratio of the total "dissipative" forces to the inertial forces.

$$\omega_{GP}=-\frac{dP/dx}{\beta G^2/2\rho g_c}=\frac{\Delta P^2/L}{\beta RTG^2/Mg_c} \quad [41]$$

or $$\omega_{GP}=\frac{Mg_c}{\beta RTG^2}\cdot\frac{P_1^2-P_2^2}{L}$$

Should the flow be confined to the viscous regime entirely, then equation [41] reduces to $$\omega_{GP}=\frac{2}{N_{Re}} \quad [42]$$

Similarly, if inertia effects predominate, then equation [41] becomes $$\omega_{GP}=2 \quad [43]$$

Accordingly, for the range of flows considered, equation [41 ] may now be written as $$\omega_{GP}=2+\frac{2}{N_{Re}} \quad [44]$$

This equation, then, describes completely the hydrodynamic behavior for the throughdrying air flow through the absorbent sheet hypothesized to have negligible deformation over the range of flows considered.

The parameters α and β can best be determined from the experimental data if a new variable φ is defined as:

$$\varphi=\frac{Mg_c}{2RTG}\cdot\frac{\Delta P^2}{L}=\alpha\mu+\beta G \quad [45]$$

as will be appreciated from equation [39] above.

Clearly 100 is observed to be linearly dependent upon G, the mass velocity; further, α and β are related to the intercept and slope of the (φ, G) plot. Moreover, only two sets of values of φ and G are necessary to establish the linear relation.

The above equations are derived for a fixed geometry, and it is assumed that α and β are related to the geometry of the sheet and independent of flow velocity. The assumptions of isentropic and adiabatic processes may be less than rigorous for real-world systems. Indeed, one may arrive at equation 39 above or 46 below through development other than the foregoing; nevertheless, the semi-empirical relationships developed herein apply with a surprising degree of precision. Unexpectedly, the equations are applicable over virtually the entire range of values considered of interest for characterizing absorbent sheet produced on a commercial scale, even where the sheet is lightweight tissue stock, for example. This aspect of the invention is appreciated from the following Examples where α and β are determined for an approximately 0.0007 ft. thick absorbent sheet for throughdrying purposes by measuring the approach air velocity and the pressure drop across the absorbent sheet made in accordance with the invention. The sheet thickness, L, used for the determination of α and β may be from standard 8-sheet caliper values corrected to single sheet thicknesses or may be calculated from the basis weight and porofil measurements using the apparent density of the sheet calculated generally as discussed below in connection with the apparent bond strength parameter. If it is desired to measure sheet thickness directly, as with a micrometer, the caliper of the sheet may be measured using the Model II Electronic Thickness Tester available from the Thwing-Albert Instrument Company of Philadelphia, Pa. The caliper is measured on a sample consisting of a stack of eight sheets using a two-inch diameter anvil at a 539.+−0.10 gram dead weight load. The mass flow and pressure drop data of Table 1 is taken on a Frazier Air Permeability Apparatus as is known for purposes of determining the hydraulic diameter of the sheet in accordance with Equation 46.

EXAMPLES 1 THROUGH 8

In engineering units, φ may be calculated as:

$$\varphi=\frac{Mg_c}{2GRT_1}\cdot\frac{P_1^2-P_2^2}{L}=\alpha\mu+\beta G \quad [46]$$

where: M = 28.964 lbm/lbmole*
$g_c$= 32.174 ft-lbm/lbf.sec2
upstream pressure, $P_1$= 2116.2 lbf/ft$^2$*
sheet thickness, L = $7.29\times10^{-4}$ ft
R = 1545 ft-lbf/lbmol-DegR
$T_1$= 518.67 DegR*
ρ= 0.07647 lbm/ft3@patm & $T_1$*
μ= $1.203\times10^{-5}$ lbm/ft. sec*

*International Standard Atmosphere

TABLE 1

Determination of Hydraulic Properties

| dP lb/ft$^2$ | V fps | Downstream pressure, $P_2$ lbf/ft$^2$ | G lbm/sqft-sec | ϕ Value Lbm/ft$^3$-sec |
|---|---|---|---|---|
| 31.1818 | 5.93 | 2085.0 | 0.4505 | 231889 |
| 41.5757 | 7.45 | 2074.6 | 0.5642 | 246242 |
| 51.9696 | 8.80 | 2064.3 | 0.6648 | 260582 |
| 62.3635 | 10.10 | 2053.9 | 0.7612 | 272450 |
| 72.7574 | 11.42 | 2043.5 | 0.8582 | 281201 |
| 83.1514 | 12.77 | 2033.1 | 0.9573 | 287389 |
| 93.5453 | 13.95 | 2022.7 | 1.0434 | 295887 |
| 103.939 | 15.14 | 2012.3 | 1.1297 | 302889 |

Slope: 103079.8

Intercept: 189472.6

$\alpha$= Intercept/$\mu$ $\alpha$(ft$^{-2}$): $1.575\times10^{10}$ $\beta$= slope $\beta$(ft$^{-1}$): $1.031\times10^{5}$ Hydraulic diameter (HD) $\beta/\alpha$(ft): 6.544×10−6

So also, a GP dimensionless throughdrying coefficient may be calculated from the above data and constants for the velocity of 15.14 fps from equation [41] (engineering units) as:

$$\omega_{GP} = \frac{Mg_c}{\beta G^2 RT} \cdot \frac{P_1^2 - P_2^2}{L} \quad [47]$$

or about 5.2; or for the velocity of 8.8 fps where $\omega_{GP}$ has a value of about 7.6. At these velocities, it will be appreciated that the pressure drop has a very significant viscous component. Likewise, the Reynolds Number at 8.8 fps may be calculated as:

$$\frac{\beta G/\alpha}{\mu}$$

or slightly less than about 0.4.

FIG. 1 is a plot of a characteristic GP Throughdrying Coefficient vs. a characteristic Reynolds Number for various products. In general, products of the invention exhibit characteristic GP throughdrying coefficients of from about 4 to about 10 at characteristic Reynolds Numbers of less than about 1. The characteristic Reynolds numbers and throughdrying coefficients referred to herein are calculated or determined using the hydraulic diameters of the sheet as determined above, for example, calculated as in Table 1 for Examples 1-8 and a pressure drop of 20 inches of water across the sheet. The approach conditions and air properties (viscosity, density) are taken at International Standard Atmosphere (substantially ambient) conditions as in Table 1. It is typically most convenient to determine the hydraulic diameter of the sheet and characteristic properties, that is, characteristic throughdrying coefficient and characteristic Reynolds number in connection with a substantially dry sheet. At characteristic Reynolds Numbers of less than about 1, the various points shown indicate operation of the YTAD process described herein wherein the web was creped from the Yankee drying cylinder at various consistencies. Virgin and secondary (recycle) furnishes were used to make the products. In general, the YTAD process involves compactively dewatering a wet web by pressing the web onto a Yankee dryer, for example, wet-creping the web from the Yankee dryer followed by throughdrying the wet-creped web. There is also shown in FIG. 1 at higher characteristic Reynolds Numbers and lower characteristic throughdrying coefficients what are believed to be conventional process conditions for preparing throughdried products. The products illustrated on FIG. 1 are compared on FIG. 2 which is a plot of hydraulic diameter versus void volume fraction for the various products of the invention and what are believed typical properties for conventional throughdried or TAD products (described further below). It should be appreciated from FIG. 2 that the various products of the invention generally have a smaller hydraulic diameter than corresponding conventional throughdried products of similar porosity.

EXAMPLES 9 THROUGH 138 AND COMPARATIVE EXAMPLES A-L

Figure 2:
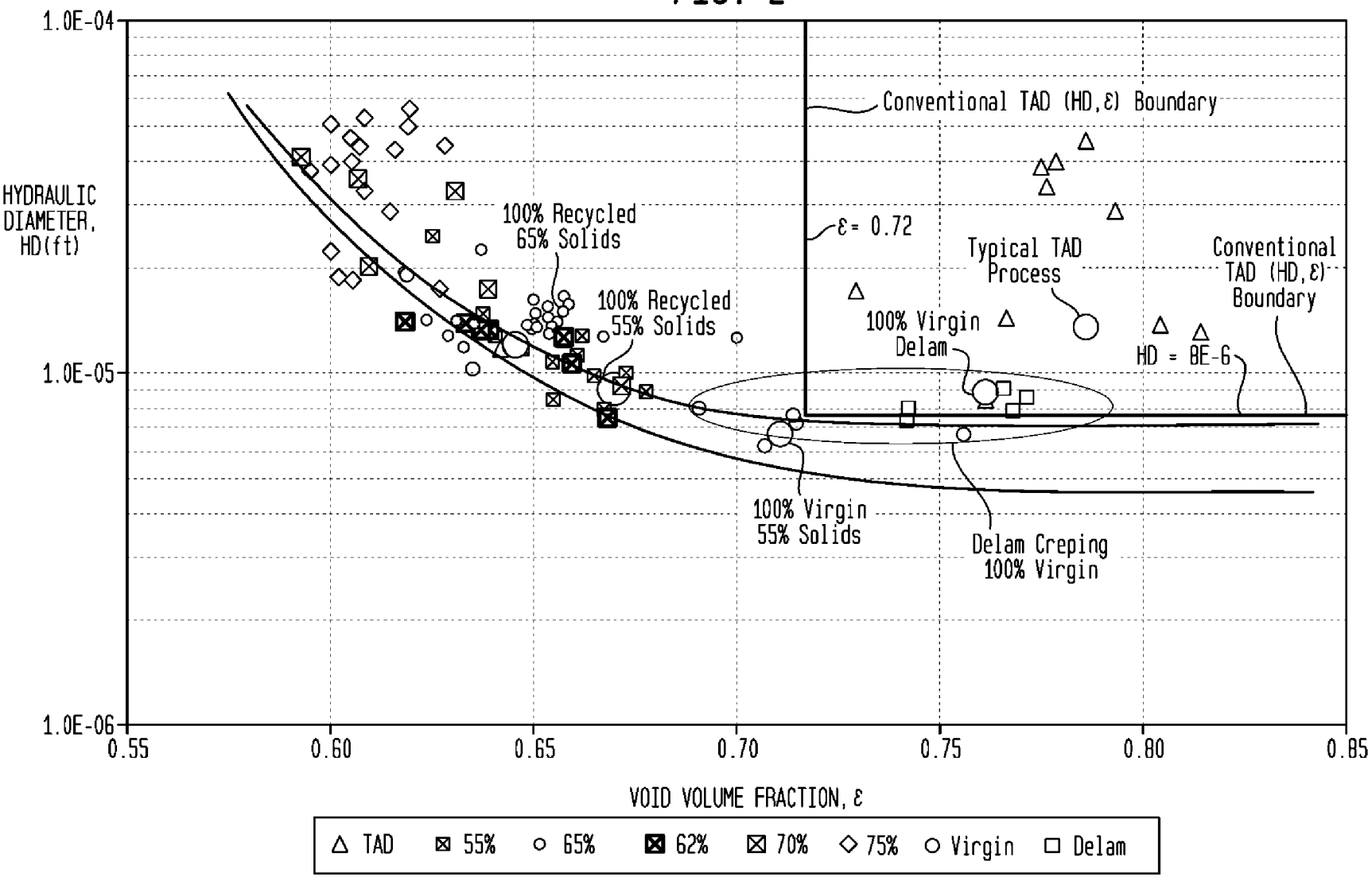
FIG. 2 is a plot of hydraulic diameter (ft) of various examples of absorbent sheet versus void volume fraction.

Representative characteristic values for the products and processes of FIGS. 1 and 2 appears below in Table 2. Data for determining the hydraulic properties were generated using a Frazier Air Permeability Apparatus as noted above. Examples 9 through 48 represent physical properties and characteristic drying conditions for absorbent sheet made from recycled furnish with the additives, adhesives and so forth described further herein made by way of the YTAD process described in more detail hereinafter. Examples 49 through 66 are physical properties and characteristic drying conditions for absorbent sheet made from recycle furnish as in Examples 9 through 48 wherein the sheet was creped from a Yankee dryer at a consistency of about 55%. Examples 67 to 122 are likewise physical properties and characteristic drying conditions for absorbent sheet made from recycled furnish utilizing the YTAD process, wherein the consistency upon creping was 62%, 65%, 70% and 75% as indicated in Table 2. Examples 123-131 were generated using virgin fiber and the YTAD process, whereas the sheet of Example 132 was prepared by delamination creping with a temperature differential between the drum and air side of the sheet. Examples 133-138 are further examples the of products and processes of the invention prepared as in Examples 9-48. In order to simulate drying conditions, the values of Reynolds Number and drying coefficient shown in Table 2 are calculated at a pressure drop of 20 inches of water across the web.

Comparative Examples A-L are believed to approximate conventional, throughdried products and processes. Such products and processes may include uncreped, throughdried products and processes as described by Farrington et al. in U.S. Pat. No. 5,607,551, as well as throughdried, creped products and processes as described in U.S. Pat. No. 4,529,480 to Trokhan et al. Herein, such products and processes are referred to simply as TAD products or processes.

TABLE 2

Hydraulic Diameter, Void Volume Fraction, and Throughdrying Coefficient

| Example | Category | Hydraulic Diameter | Reynolds Number | Void Volume Fraction | Through-Drying Coefficient |
|---|---|---|---|---|---|
| 9 | YTAD Genl | 4.592E−05 | 0.978 | 0.665 | 4.045 |
| 10 | YTAD Genl | 4.913E−05 | 1.036 | 0.647 | 3.930 |
| 11 | YTAD Genl | 5.127E−05 | 1.029 | 0.665 | 3.945 |
| 12 | YTAD Genl | 5.557E−05 | 1.534 | 0.674 | 3.304 |
| 13 | YTAD Genl | 1.717E−05 | 0.655 | 0.665 | 5.053 |
| 14 | YTAD Genl | 1.685E−05 | 0.626 | 0.689 | 5.197 |
| 15 | YTAD Genl | 1.278E−05 | 0.499 | 0.688 | 6.005 |
| 16 | YTAD Genl | 1.678E−05 | 0.515 | 0.678 | 5.880 |
| 17 | YTAD Genl | 1.425E−05 | 0.501 | 0.685 | 5.991 |
| 18 | YTAD Genl | 1.564E−05 | 0.527 | 0.682 | 5.793 |
| 19 | YTAD Genl | 1.202E−05 | 0.439 | 0.677 | 6.560 |

TABLE 2-continued

| Ex-ample | Category | Hydraulic Diameter | Reynolds Number | Void Volume Frac-tion | Through-Drying Coef-ficient |
|---|---|---|---|---|---|
| | | Hydraulic Diameter, Void Volume Fraction, and Throughdrying Coefficient | | | |
| 20 | YTAD Genl | 1.202E−05 | 0.491 | 0.703 | 6.074 |
| 21 | YTAD Genl | 1.141E−05 | 0.504 | 0.684 | 5.970 |
| 22 | YTAD Genl | 1.147E−05 | 0.539 | 0.700 | 5.707 |
| 23 | YTAD Genl | 1.151E−05 | 0.545 | 0.701 | 5.670 |
| 24 | YTAD Genl | 1.054E−05 | 0.489 | 0.709 | 6.087 |
| 25 | YTAD Genl | 1.156E−05 | 0.507 | 0.701 | 5.945 |
| 26 | YTAD Genl | 4.056E−05 | 0.931 | 0.660 | 4.148 |
| 27 | YTAD Genl | 3.630E−05 | 0.826 | 0.651 | 4.422 |
| 28 | YTAD Genl | 3.152E−05 | 0.704 | 0.645 | 4.841 |
| 29 | YTAD Genl | 3.974E−05 | 0.994 | 0.658 | 4.011 |
| 30 | YTAD Genl | 2.990E−05 | 0.736 | 0.661 | 4.718 |
| 31 | YTAD Genl | 3.782E−05 | 0.962 | 0.664 | 4.079 |
| 32 | YTAD Genl | 3.301E−05 | 0.874 | 0.668 | 4.289 |
| 33 | YTAD Genl | 3.318E−05 | 0.916 | 0.655 | 4.183 |
| 34 | YTAD Genl | 8.734E−06 | 0.562 | 0.713 | 5.561 |
| 35 | YTAD Genl | 1.245E−05 | 0.450 | 0.688 | 6.440 |
| 36 | YTAD Genl | 1.288E−05 | 0.491 | 0.689 | 6.071 |
| 37 | YTAD Genl | 1.307E−05 | 0.511 | 0.691 | 5.916 |
| 38 | YTAD Genl | 1.303E−05 | 0.509 | 0.755 | 5.927 |
| 39 | YTAD Genl | 1.406E−05 | 0.603 | 0.724 | 5.315 |
| 40 | YTAD Genl | 1.149E−05 | 0.556 | 0.708 | 5.597 |
| 41 | YTAD Genl | 1.236E−05 | 0.513 | 0.711 | 5.902 |
| 42 | YTAD Genl | 1.170E−05 | 0.465 | 0.702 | 6.305 |
| 43 | YTAD Genl | 1.301E−05 | 0.488 | 0.697 | 6.097 |
| 44 | YTAD Genl | 1.076E−05 | 0.568 | 0.732 | 5.523 |
| 45 | YTAD Genl | 1.070E−05 | 0.580 | 0.716 | 5.449 |
| 46 | YTAD Genl | 1.047E−05 | 0.591 | 0.728 | 5.384 |
| 47 | YTAD Genl | 1.047E−05 | 0.501 | 0.713 | 5.990 |
| 48 | YTAD Genl | 1.348E−05 | 0.714 | 0.712 | 4.802 |
| 49 | 55% CrSol | 7.024E−06 | 0.791 | 0.757 | 4.530 |
| 50 | 55% CrSol | 7.517E−06 | 1.023 | 0.757 | 3.955 |
| 51 | 55% CrSol | 6.543E−06 | 0.615 | 0.754 | 5.254 |
| 52 | 55% CrSol | 1.458E−05 | 0.451 | 0.686 | 6.438 |
| 53 | 55% CrSol | 1.056E−05 | 0.364 | 0.702 | 7.498 |
| 54 | 55% CrSol | 2.417E−05 | 0.645 | 0.675 | 5.102 |
| 55 | 55% CrSol | 1.158E−05 | 0.390 | 0.695 | 7.125 |
| 56 | 55% CrSol | 1.162E−05 | 0.417 | 0.694 | 6.798 |
| 57 | 55% CrSol | 1.234E−05 | 0.530 | 0.705 | 5.777 |
| 58 | 55% CrSol | 1.266E−05 | 0.503 | 0.689 | 5.979 |
| 59 | 55% CrSol | 1.113E−05 | 0.428 | 0.708 | 6.672 |
| 60 | 55% CrSol | 1.260E−05 | 0.511 | 0.709 | 5.915 |
| 61 | 55% CrSol | 8.918E−06 | 0.466 | 0.717 | 6.295 |
| 62 | 55% CrSol | 8.281E−06 | 0.413 | 0.702 | 6.846 |
| 63 | 55% CrSol | 9.700E−06 | 0.530 | 0.712 | 5.777 |
| 64 | 55% CrSol | 9.913E−06 | 0.528 | 0.719 | 5.789 |
| 65 | 55% CrSol | 8.690E−06 | 0.496 | 0.724 | 6.032 |
| 66 | 55% CrSol | 7.825E−06 | 0.405 | 0.714 | 6.934 |
| 67 | 62% CrSol | 1.427E−05 | 0.601 | 0.694 | 5.330 |
| 68 | 62% CrSol | 1.313E−05 | 0.524 | 0.688 | 5.817 |
| 69 | 62% CrSol | 1.381E−05 | 0.508 | 0.668 | 5.933 |
| 70 | 62% CrSol | 1.371E−05 | 0.545 | 0.682 | 5.673 |
| 71 | 62% CrSol | 1.315E−05 | 0.599 | 0.686 | 5.336 |
| 72 | 62% CrSol | 1.258E−05 | 0.627 | 0.705 | 5.190 |
| 73 | 62% CrSol | 1.058E−05 | 0.686 | 0.707 | 4.917 |
| 74 | 62% CrSol | 7.419E−06 | 0.624 | 0.714 | 5.205 |
| 75 | 65% CrSol | 6.585E−06 | 0.674 | 0.794 | 4.966 |
| 76 | 65% CrSol | 1.635E−05 | 0.722 | 0.705 | 4.771 |
| 77 | 65% CrSol | 1.388E−05 | 0.613 | 0.704 | 5.263 |
| 78 | 65% CrSol | 1.358E−05 | 0.608 | 0.698 | 5.290 |
| 79 | 65% CrSol | 1.467E−05 | 0.657 | 0.698 | 5.046 |
| 80 | 65% CrSol | 1.553E−05 | 0.639 | 0.706 | 5.129 |
| 81 | 65% CrSol | 1.182E−05 | 0.487 | 0.694 | 6.111 |
| 82 | 65% CrSol | 1.404E−05 | 0.560 | 0.674 | 5.570 |
| 83 | 65% CrSol | 1.158E−05 | 0.508 | 0.682 | 5.940 |
| 84 | 65% CrSol | 1.260E−05 | 0.511 | 0.679 | 5.915 |
| 85 | 65% CrSol | 1.333E−05 | 0.712 | 0.698 | 4.807 |
| 86 | 65% CrSol | 1.250E−05 | 0.820 | 0.714 | 4.440 |
| 87 | 65% CrSol | 1.607E−05 | 0.866 | 0.698 | 4.311 |
| 88 | 65% CrSol | 1.441E−05 | 0.794 | 0.701 | 4.518 |
| 89 | 65% CrSol | 1.527E−05 | 0.614 | 0.701 | 5.257 |
| 90 | 65% CrSol | 1.351E−05 | 0.524 | 0.697 | 5.818 |

TABLE 2-continued

| Ex-ample | Category | Hydraulic Diameter | Reynolds Number | Void Volume Frac-tion | Through-Drying Coef-ficient |
|---|---|---|---|---|---|
| | | Hydraulic Diameter, Void Volume Fraction, and Throughdrying Coefficient | | | |
| 91 | 65% CrSol | 1.476E−05 | 0.554 | 0.705 | 5.610 |
| 92 | 65% CrSol | 1.341E−05 | 0.631 | 0.702 | 5.169 |
| 93 | 65% CrSol | 1.286E−05 | 0.601 | 0.702 | 5.328 |
| 94 | 65% CrSol | 1.337E−05 | 0.647 | 0.699 | 5.092 |
| 95 | 65% CrSol | 1.921E−05 | 0.713 | 0.669 | 4.804 |
| 96 | 65% CrSol | 2.217E−05 | 0.795 | 0.686 | 4.515 |
| 97 | 65% CrSol | 1.244E−05 | 0.450 | 0.744 | 6.443 |
| 98 | 65% CrSol | 1.366E−05 | 0.494 | 0.684 | 6.047 |
| 99 | 65% CrSol | 1.392E−05 | 0.536 | 0.680 | 5.735 |
| 100 | 65% CrSol | 6.049E−06 | 0.665 | 0.751 | 5.005 |
| 101 | 70% CrSol | 4.128E−05 | 1.041 | 0.644 | 3.921 |
| 102 | 70% CrSol | 3.527E−05 | 0.886 | 0.658 | 4.257 |
| 103 | 70% CrSol | 3.321E−05 | 0.979 | 0.680 | 4.044 |
| 104 | 70% CrSol | 2.003E−05 | 0.630 | 0.660 | 5.176 |
| 105 | 70% CrSol | 9.065E−06 | 0.308 | 0.718 | 8.486 |
| 106 | 70% CrSol | 1.703E−05 | 0.504 | 0.688 | 5.971 |
| 107 | 75% CrSol | 4.237E−05 | 0.929 | 0.666 | 4.153 |
| 108 | 75% CrSol | 5.518E−05 | 1.164 | 0.669 | 3.718 |
| 109 | 75% CrSol | 4.895E−05 | 1.017 | 0.669 | 3.966 |
| 110 | 75% CrSol | 5.220E−05 | 1.187 | 0.659 | 3.684 |
| 111 | 75% CrSol | 4.286E−05 | 0.824 | 0.658 | 4.426 |
| 112 | 75% CrSol | 2.164E−05 | 0.662 | 0.651 | 5.019 |
| 113 | 75% CrSol | 1.807E−05 | 0.523 | 0.652 | 5.822 |
| 114 | 75% CrSol | 1.805E−05 | 0.622 | 0.656 | 5.217 |
| 115 | 75% CrSol | 1.694E−05 | 0.601 | 0.676 | 5.330 |
| 116 | 75% CrSol | 3.881E−05 | 0.738 | 0.656 | 4.709 |
| 117 | 75% CrSol | 2.797E−05 | 0.544 | 0.665 | 5.679 |
| 118 | 75% CrSol | 4.568E−05 | 0.883 | 0.655 | 4.264 |
| 119 | 75% CrSol | 3.216E−05 | 0.642 | 0.659 | 5.116 |
| 120 | 75% CrSol | 3.665E−05 | 0.712 | 0.646 | 4.807 |
| 121 | 75% CrSol | 4.991E−05 | 1.058 | 0.651 | 3.890 |
| 122 | 75% CrSol | 3.826E−05 | 0.744 | 0.651 | 4.689 |
| 123 | VirginFurn | 7.024E−06 | 0.791 | 0.757 | 4.530 |
| 124 | VirginFurn | 7.517E−06 | 1.023 | 0.757 | 3.955 |
| 125 | VirginFurn | 6.049E−06 | 0.665 | 0.751 | 5.005 |
| 126 | VirginFurn | 6.585E−06 | 0.674 | 0.794 | 4.966 |
| 127 | VirginFurn | 6.543E−06 | 0.615 | 0.754 | 5.254 |
| 128 | VirginFurn | 7.844E−06 | 0.556 | 0.736 | 5.600 |
| 129 | VirginFurn | 1.861E−05 | 0.564 | 0.669 | 5.548 |
| 130 | VirginFurn | 1.007E−05 | 0.342 | 0.684 | 7.841 |
| 131 | VirginFurn | 9.296E−06 | 0.490 | 0.000 | 6.080 |
| 132 | Delam Crepe | 7.689E−06 | 1.213 | 0.805 | 3.649 |
| 133 | YTAD Genl | 2.380E−05 | 0.517 | 0.644 | 5.870 |
| 134 | YTAD Genl | 1.807E−05 | 0.536 | 0.669 | 5.730 |
| 135 | YTAD Genl | 1.329E−05 | 0.458 | 0.682 | 6.371 |
| 136 | YTAD Genl | 1.169E−05 | 0.434 | 0.693 | 6.609 |
| 137 | YTAD Genl | 1.156E−05 | 0.351 | 0.690 | 7.691 |
| 138 | YTAD Genl | 4.716E−05 | 0.697 | 0.578 | 4.868 |
| A | Simulated TAD | 1.704E−05 | 1.500 | 0.771 | 3.333 |
| B | Simulated TAD | 1.382E−05 | 2.036 | 0.803 | 2.982 |
| C | Simulated TAD | 8.324E−06 | 1.144 | 0.799 | 3.749 |
| D | Simulated TAD | 1.330E−05 | 2.111 | 0.820 | 2.947 |
| E | Simulated TAD | 3.889E−05 | 11.952 | 0.814 | 2.167 |
| F | Simulated TAD | 3.871E−05 | 13.327 | 0.811 | 2.150 |
| G | Simulated TAD | 2.858E−05 | 9.549 | 0.826 | 2.209 |
| H | Simulated TAD | 1.267E−05 | 4.876 | 0.846 | 2.410 |
| I | Simulated TAD | 1.255E−04 | 48.211 | 0.835 | 2.041 |
| J | Simulated TAD | 4.534E−05 | 16.162 | 0.821 | 2.124 |
| K | Simulated TAD | 1.372E−05 | 5.888 | 0.836 | 2.340 |
| L | Simulated TAD | 3.320E−05 | 11.368 | 0.812 | 2.176 |

The advantages of the YTAD process are understood by reference to Table 3 which is a comparison of throughdrying costs from about the consistency indicated to near dryness. As can be seen, the YTAD process makes it possible to through-dry even those products made from secondary (recycle) furnishes at throughdrying costs comparable to conventional TAD processes. Likewise, non-wood fibers such as straw, synthetic fiber bagasse fiber or sugarcane fiber may be employed. Given the substantial upstream cost advantages of compactively dewatering the furnish, it will be appreciated that the YTAD offers significant drying cost advantages over conventional processes.

Processes in accordance with the invention may typically include sheet exhibiting a characteristic Reynolds Number of 0.75 or less, or even less than 0.5. A characteristic Reynolds Number of less than about 0.75 with a characteristic through-drying coefficient of from 5 to 7 is somewhat typical. When the void volume fraction of the products of the invention exceeds about 0.8, the hydraulic diameter of the inventive materials is less than about $7\times10^{-6}$ ft. Hydraulic Diameters between about $4\times10^{-6}$ to $8\times10^{-6}$ ft are typical at high void volumes, with hydraulic diameters of up to about 6 or $7\times10^{-6}$ ft being preferred. Wet springback ratios of between about 0.65 and 0.75 are likewise typical of the products. Products made with recycle furnish may typically have a void volume fraction of from about 0.55 to about 0.70 and a hydraulic diameter of from about $4\times10^{-6}$ ft to $5\times10^{-5}$ ft. While the YTAD process is one aspect of the invention, the novel products of the invention, whether defined in terms of hydraulic properties or internal bond strength parameter, may be made by any suitable means, including impingement air drying. One such process includes compactively dewatering the web, applying the web to a Yankee dryer and partially drying the web, followed by wet-creping the web and impingement air drying is described in U.S. Pat. No. 6,432,267, entitled "Wet Creping Impingement Air Dry Process for Making Absorbent Sheet", of Watson et al., the disclosure of which is incorporated herein by reference. An impingement air drying process need not involve creping, but may be an uncreped, impingement air dry process as described in U.S. Pat. No. 6,447,640, entitled "Impingement Air Dry Process for Making Absorbent Sheet", also of Watson et al., the disclosure of which is incorporated by reference together with the disclosures of the following United States Patents relating to impingement air drying:

U.S. Pat. No. 5,865,955 of Ilvespaaet et al.
U.S. Pat. No. 5,968,590 of Ahonen et al.
U.S. Pat. No. 6,001,421 of Ahonen et al.
U.S. Pat. No. 6,119,362 of Sundqvist et al.

Wet Resiliency

Unlike conventional wet-pressed products, the products of the present invention exhibit wet resiliency which is manifested in wet compressive recovery tests. A particularly convenient measure is wet springback ratio which measures the ability of the product to elastically recover from compression. For measuring this parameter, each test specimen is prepared to consist of a stack of two or more conditioned (24 hours @50% RH, 73° F. (23° C.)) dry sample sheets cut to 2.5" (6.4 cm) squares, providing a stack mass preferably between 0.2 and 0.6 g. The test sequence begins with the treatment of the dry sample. Moisture is applied uniformly to the sample using a fine mist of deionized water to bring the moisture ratio (g water/g dry fiber) to approximately 1.1. This is done by applying 95-110% added moisture, based on the conditioned sample mass. This puts typical cellulosic materials in a moisture range where physical properties are relatively insensitive to moisture content (e.g., the sensitivity is much less than it is for moisture ratios less than 70%). The moistened sample is then placed in the test device. A programmable strength measurement device is used in compression mode to impart a specified series of compression cycles to the sample. Initial compression of the sample to 0.025 psi (0.172 kPa) provides an initial thickness (cycle A), after which two repetitions of loading up to 2 psi (13.8 kPa) are followed by unloading (cycles B and C). Finally, the sample is again compressed to 0.025 psi (0.172 kPa) to obtain a final thickness (cycle D). (Details of this procedure, including compression speeds, are given below).

Three measures of wet resiliency may be considered which are relatively insensitive to the number of sample layers used in the stack. The first measure is the bulk of the wet sample at 2 psi (13.8 kPa). This is referred to as the "Compressed Bulk". The second measure (more pertinent to the following examples) is termed "Wet springback Ratio", which is the ratio of the moist sample thickness at 0.025 psi (0.172 kPa) at the end of the compression test (cycle D) to the thickness of the moist sample at 0.025 psi (0. 172 kPa) measured at the beginning of the test (cycle A). The third measure is the "Loading Energy Ratio", which is the ratio of loading energy

TABLE 3

Comparison of Throughdrying Costs

| Sample Description | Furnish | Void Vol gms/gm | Basis Wt lb/3000 ft$^2$ | Caliper mils/8 Sht | GM Tensile gms/3" | TAD Roll Vacuum "WC | TAD Drying Fuel KWH/Ton | TAD Drying Electrical KWH/Ton | TAD Drying Total Costs $/Ton |
|---|---|---|---|---|---|---|---|---|---|
| YTAD 55% Yankee Solids | 100% Recycled | 5.0 | 29 | 113 | 2902 | 27 | 1406 | 195 | $18.61 |
| YTAD 65% Yankee Solids | 100% Recycled | 4.3 | 26 | 71 | 5007 | 40 | 1354 | 283 | $20.52 |
| YTAD 55% Yankee Solids | 100% Virgin Blend | 5.8 | 32 | 117 | 2323 | 14 | 1442 | 125 | $17.02 |
| YTAD 55% Yankee Solids High Delam | 100% Virgin Blend | 7.5 | 36 | N/A | 1613 | 11 | 1529 | 169 | $19.06 |
| Typical TAD/UCTAD Conventional Sheet | 100% Virgin Blend | 8.7 | 30 | 160 | 3735 | 7 | 1547 | 156 | $18.86 |

in the second compression to 2 psi (13.8 kPa) (cycle C) to that of the first compression to 2 psi (13.8 kPa) (cycle B) during the sequence described above, for a wetted sample. When load is plotted as a function of thickness, Loading Energy is the area under the curve as the sample goes from an unloaded state to the peak load of that cycle. For a purely elastic material, the spingback and loading energy ratio would be unity. The three measures described are relatively independent of the number of layers in the stack and serve as useful measures of wet resiliency. One may also refer to the Compression Ratio, which is defined as the ratio of moistened sample thickness at peak load in the first compression cycle to 2 psi (13.8 kPa) to the initial moistened thickness at 0.025 psi (0.172 kPa).

In carrying out the measurements of the wet compression recovery, samples should be conditioned for at least 24 hours under TAPPI conditions (50% RH, 73° F. (23° C.)). Specimens are die cut to 2.5"2.5" (6.4×6.4 cm) squares. Conditioned sample weight should be near 0.4 g, if possible, and within the range of 0.25 to 0.6 g for meaningful comparisons. The target mass of 0.4 g is achieved by using a stack of 2 or more sheets if the sheet basis weight is less than 65 gsm. For example, for nominal 30 gsm sheets, a stack of 3 sheets will generally be near 0.4 g total mass.

Compression measurements are performed using an Instron (RTM) 4502 Universal Testing Machine interfaced with a 826 PC computer running Instron (RTM) Series XII software (1989 issue) and Version 2 firmware. A 100 kN load cell is used with 2.25" (5.72 cm) diameter circular platens for sample compression. The lower platen has a ball bearing assembly to allow exact alignment of the platens. The lower platen is locked in place while under load (30-100 lbf) (130-445 N) by the upper platen to ensure parallel surfaces. The upper platen must also be locked in place with the standard ring nut to eliminate play in the upper platen as load is applied.

Following at least one hour of warm-up after start-up, the instrument control panel is used to set the extensiometer to zero distance while the platens are in contact (at a load of 10-30 lb (4.5-13.6 kg)). With the upper platen freely suspended, the calibrated load cell is balanced to give a zero reading. The extensiometer and load cell; should be periodically checked to prevent baseline drift (shifting of the zero points). Measurements must be performed in a controlled humidity and temperature environment, according to TAPPI specifications (50%±2% RH and 73° F. (23° C.)). The upper platen is then raised to a height of 0.2 in. and control of the Instron is transferred to the computer.

Using the Instron Series XII Cyclic Test software, an instrument sequence is established with 7 markers (discrete events) composed of 3 cyclic blocks (instructions sets) in the following order:

Marker 1: Block 1
Marker 2: Block 2
Marker 3: Block 3
Marker 4: Block 2
Marker 5: Block 3
Marker 6: Block 1
Marker 7: Block 3.

Block 1 instructs the crosshead to descend at 1.5 in./min (3.8 cm/min) until a load of 0.1 lb (45 g) is applied (the Instron setting is −0.1 lb (−45g), since compression is defined as negative force). Control is by displacement. When the targeted load is reached, the applied load is reduced to zero.

Block 2 directs that the crosshead range from an applied load of 0.05 lb (23 g) to a peak of 8 lb (3.6 kg) then back to 0.05 lb (23 g) at a speed of 0.4 in./min. (1.02 cm/min). Using the Instron software, the control mode is displacement, the limit type is load, the first level is —0.05 lb (−23 g), the second level is −8 lb (−3.6 kg), the dwell time is 0 sec., and the number of transitions is 2 (compression, then relaxation); "no action" is specified for the end of the block.

Block 3 uses displacement control and limit type to simply raise the crosshead to 0.2 in (0.51 cm) at a speed of 4 in./min. (10.2 cm/min), with 0 dwell time. Other Instron software settings are 0 in first level, 0.2 in (0.51 cm) second level, 1 transition, and "no action" at the end of the block.

When executed in the order given above (Markers 1-7), the Instron sequence compresses the sample to 0.025 psi (0.1 lbf) [0.172 kPa (0.44 N)], relaxes, then compresses to 2 psi (8 lbs) [13.8 kPa (3.6 Kg)], followed by decompression and a crosshead rise to 0.2 in (0.51 cm), then compresses the sample again to 2 psi (13.8 kPa), relaxes, lifts the crosshead to 0.2 in. (0.51 cm), compresses again to 0.025 psi (0.1 lbf) [0.172 kPa (0.44 N)], and then raises the crosshead. Data logging should be performed at intervals no greater than every 0.02" (0.051 cm) or 0.4 lb (180 g), (whichever comes first) for Block 2 and for intervals no greater than 0.01 lb (4.5 g) for Block 1. Preferably, data logging is performed every 0.004 lb (1.8 g) in Block 1 and every 0.05 lb. (23 g) or 0.005 in. (0.13 mm) (whichever comes first) in Block 2.

The results output of the Series XII software is set to provide extension (thickness) at peak loads for Markers 1, 2, 4 and 6 (at each 0.025 (0.172 kPa) and 2.0 psi (13.8 kPa) peak load), the loading energy for Markers 2 and 4 (the two compressions to 2.0 psi (13.8 kPa) previously termed cycles B and C, respectively), and the ratio of final thickness to initial thickness (ratio of thickness at last to first 0.025 psi (0. 172 kPa) compression). Load versus thickness results are plotted on the screen during execution of Blocks 1 and 2.

In performing a measurement, the dry, conditioned sample moistened (deionized water at 72-73° F. (22.2-22.8° C.) is applied.). Moisture is applied uniformly with a fine mist to reach a moist sample mass of approximately 2.0 times the initial sample mass (95-110% added moisture is applied, preferably 100% added moisture, based on conditioned sample mass; this level of moisture should yield an absolute moisture ratio between 1.1 and 1.3 g. water/g. oven dry fiber—with oven dry referring to drying for at least 30 minutes in an oven at 105° C.). The mist should be applied uniformly to separated sheets (for stacks of more than 1 sheet), with spray applied to both front and back of each sheet to ensure uniform moisture application. This can be achieved using a conventional plastic spray bottle, with a container or other barrier blocking most of the spray, allowing only about the upper 10-20% of the spray envelope—a fine mist—to approach the sample. The spray source should be at least 10" away from the sample during spray application. In general, care must be applied to ensure that the sample is uniformly moistened by a fine spray. The sample must be weighed several times during the process of applying moisture to reach the targeted moisture content. No more than three minutes should elapse between the completion of the compression tests on the dry sample and the completion of moisture application. Allow 45-60 seconds from the final application of spray to the beginning of the subsequent compression test to provide time for internal wicking and absorption of the spray. Between three and four minutes will elapse between the completion of the dry compression sequence and initiation of the wet compression sequence.

Once the desired mass range has been reached, as indicated by a digital balance, the sample is centered on the lower Instron platen and the test sequence is initiated. Following the measurement, the sample is placed in a 105° C. oven for drying, and the oven dry weight will be recorded later (sample should be allowed to dry for 30-60 minutes, after which the dry weight is measured).

Note that creep recovery can occur between the two compression cycles to 2 psi (13.8 kPa), so the time between the cycles may be important. For the instrument settings used in these Instron tests, there is a 30 second period (±4 sec.) between the beginning of compression during the two cycles to 2 psi (13.8 kPa). The beginning of compression is defined as the point at which the load cell reading exceeds 0.03 lb. (13.6 g). Likewise, there is a 5-8 second interval between the beginning of compression in the first thickness measurement (ramp to 0.025 psi (0.172 kPa)) and the beginning of the subsequent compression cycle to 2 psi (13.8 kPa)). The interval between the beginning of the second compression cycle to 2 psi (13.8 kPa) and the beginning of compression for the final thickness measurement is approximately 20 seconds.

EXAMPLES M THROUGH O AND 139, 140

Using the procedures described above, two commercially available conventional wet pressed products (M+N) and one conventional uncreped, throughdried product (O) were compared with two products (Example 139 and 140) of the present invention prepared by way of the wet pressing/Yankee drying/throughdrying process of the invention (YTAD). The samples were all wetted to 100% as noted above. Data appears in Table 4 below.

TABLE 4

| | | Wet Resiliency | | | | |
|---|---|---|---|---|---|---|
| | | Example | | | | |
| | Units | M | N | O | 139 | 140 |
| Wet Caliper @ .025 psi (1) | mils | 52.9 | 81.1 | 94.9 | 37.7 | 75.8 |
| Wet Caliper @ 0.025 psi (2) | mils | 28.7 | 41.9 | 64.1 | 27.8 | 52 |
| Wet SpringBack Ratio | | 0.5425 | 0.5166 | 0.6754 | 0.7374 | 0.6860 |

As can be seen, the YTAD products exhibit wet resilience similar to, and even higher than, uncreped throughdried products and significantly higher than conventional wet pressed products.

Internal Bond Strength

Figure 3:
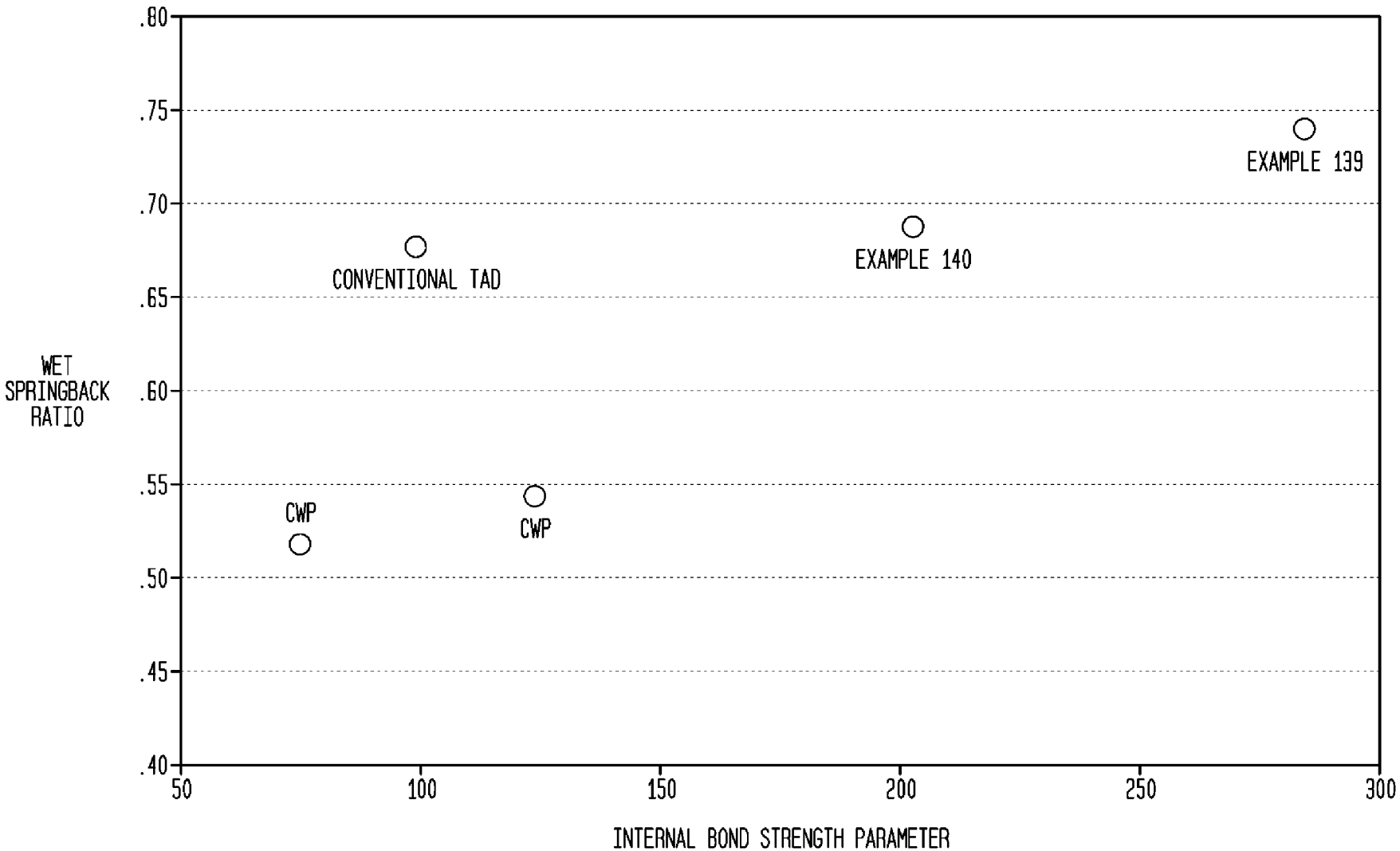
FIG. 3 is a plot of an internal bond strength parameter in gm/in/mil versus wet springback ratio.

Fibrous sheet in accordance with the invention also exhibits a relatively high strength as can be seen from FIG. 3, which is a plot of wet springback ratio versus an internal bond strength parameter ("IBSP") in g/in/mil. The products of the invention exhibit IBSP values of about 140 or greater, typically, to about 500, and more typically, between about 175 and 300 as shown in FIG. 3 which values might be achieved along with wet springback ratios of anywhere from 0.4 to about 0.8. Preferred are products with a wet springback ratio of at least about 0.6 and in some embodiments at least about 0.65. One of skill in the art will appreciate that the products of the invention exhibit relatively high GMT as compared, for example, with a conventional TAD product. The IBSP is calculated as follows: (a) the GMT, g/3" is divided by 3 to get a per inch value; (b) the basis weight is expressed in grams per square meter; (c) the apparent density based on the porofil test described above is determined by dividing the dry weight of the porofil sample by the sum of the dry sample weight divided by 0.8 (fiber density) and the wet sample weight less dry weight divided by the 1.9 (density of the fluid) or:

$$\text{Apparent density} = \frac{\text{Dry sample weight}}{\frac{\text{dry weight}}{0.8} + \frac{\text{wet wt.} - \text{dry wt.}}{1.9}};$$

(d) the thickness of the sheet is expressed in thousandths of an inch (mils) by dividing the square meter basis weight in step (b) by the apparent density and dividing by 25.4 to convert units; and finally (e) the value calculated in step (a) is divided by the thickness in mils as calculated in step (d) to arrive at an IBSP in g/in/mil Thus, for the sheet of Example 139 above having the following characteristics:

TABLE 4a

| Example 139 Product Characteristics Example 139 | | |
|---|---|---|
| Raw Measure | Value | Units |
| GMT | 4983.61 | gm/3-in |
| BasWt | 25.55 | Lb/3000 sqft |
| Porofil Dry | 0.028 | gm |
| Porofil Wet | 0.151 | gm |
| Porofil Delta | 0.123 | gm |
| Cellulose Density | 0.8 | gm/cc |
| Porofil Liquid Density | 1.9 | gm/cc |

An IBSP of 284.65 g/in/mil is calculated.

Microstructure Control

The improved processes according to the present invention also include controlling the characteristic void volume upon creping in grams/g of greater than about 9.2−0.048X wherein X is the GMT of the as-creped product (grams/3") divided by the basis weight of the as-creped product (lbs/3000 $ft^2$). More typically, the web exhibits a characteristic void volume upon creping in grams/g of greater than about 9.5−0.048X wherein X is the GMT of the as-creped product (grams/3") divided by the basis weight of the as-creped product (lbs/3000 $ft^2$). In a preferred embodiment the web exhibits a characteristic void volume of at least about 6.5 gms/gm upon creping whereas at least about 7 gms/gm upon creping is even more preferred. In some embodiments the characteristic void volume of the web may be at least about 7.5 gms/gm upon creping with at least about 8 gms/gm upon creping being preferred in some cases.

Absorbent sheet of any suitable basis weight may be manufactured by way of the process of the present invention. In some preferred embodiments the product will have a basis weight of at least about 12 lbs per 3000 $ft^2$ ream and in still others basis weights of at least 20 lbs per 3000 $ft^2$ ream or at least 25 lbs or 30 lbs per 3000 $ft^2$ ream.

Generally speaking, in accordance with the improved wet-creped process of the present invention, the web is dewatered to a consistency of at least about 30 percent prior to, or contemporaneously with, being applied to the heated cylinder. Dewatering the web to a consistency of at least about 40 percent prior to drying the web to the heated cylinder is preferred in many embodiments. On the heated cylinder, the web is dried to a consistency of at least about 50 percent in many cases and may be dried to a consistency of 60 or 70 percent or higher if so desired.

The web may be creped from the heated cylinder by any known technique. Generally such techniques utilize a creping blade and a creping or pocket angle of from about 50 to about 125 degrees. In some embodiments a beveled creping blade is used wherein the pocket angle is from about 65 to about 90 degrees. The bevel on the blade may be of any suitable angle typically from about 0 to about 40 degrees or in some embodiments from about 0 to about 20 degrees. In some particularly preferred embodiments the web is creped from the heated cylinder with an undulatory creping blade so as to form a reticulated biaxially undulatory product with crepe bars extending in the cross direction and ridges extending in the machine direction. In such instances, the product may have from about 8 to about 150 crepe bars per inch in the cross direction and from about 4 to about 50 ridges per inch extending in the machine direction. A preferred method of utilizing an undulatory creping blade is where the blade is positioned configured and dimensioned so as to be in continuous undulatory engagement with a heated rotating cylinder over the width of the cylinder.

The wet web may be creped from the heated rotating cylinder while maintaining a narrow effective creping shelf having a width of less than about 3 times the thickness of the web. One way of maintaining a suitably narrow effective creping shelf is to use a creping blade having a creping ledge width of from about 0.005 to about 0.025 inches. The sheet may be prepared from virgin hardwood or softwood fiber or prepared from a fibrous furnish comprising fiber other than virgin wood fiber. The furnish optionally comprises a non-wood fiber selected from the group consisting of straw fibers, sugarcane fibers, bagasse fibers and synthetic fibers.

A particularly advantageous process is practiced using secondary or recycled cellulosic fiber. The recycled fiber in some instances may be at least about 50 percent by weight of the fiber present or more, such as cases where recycled fiber makes up at least about 75 percent by weight of the fiber present and sometimes nearly all of the cellulosic fiber (from more than 75 up to 100 percent) present in the web may be recycled fiber. A process of the present invention advantageously utilizes compactive dewatering. This is carried out by the application of mechanical pressure on the web that may include pressing the furnish between a forming wire and a papermaking felt or fabric or may be accomplished by pressing the web on a fabric in a transfer nip defined by a press roll and the aforesaid heated rotating cylinder as further described and illustrated hereafter. Likewise, the web may be compactively dewatered in controlled pressure shoe press on a papermaking felt if so desired. A particularly preferred type of controlled pressure shoe press is described in co-pending application Ser. No. 09/191,376, filed Nov. 13, 1998 entitled "Method for Maximizing Water Removal In A Press Nip" of Steven L. Edwards et al., now U.S. Pat. No. 6,248,210, the disclosure of which is incorporated herein by reference. Generally speaking, this apparatus compactively dewaters the furnish or web in a shoe/cylinder nip by providing a peak engagement pressure (maximum pressure) of from about 500-2,000 kN/m$^2$ in some embodiments or at least about 2,000 kN/m$^2$ in other embodiments. The line load may be less than about 90 kN/m or up to about 240 kN/m in some cases. "Line load" refers to total force applied to the nip divided by the width (which also may be referred to as length) of the press cylinder. The pressure profile applied to the furnish or web is asymmetric in that it declines from a peak pressure to a value of 20% of the peak value over a nip length which is no more than about half of the nip length over which it rose to the peak pressure from 20% of the peak pressure. The line load is typically less than about 175 kN/m, with less than about 100 kN/m being preferred in many embodiments. A peak engagement pressure in the press nip may be at least about 2,500 kN/m$^2$ or at least about 3,000 kN/m$^2$ in some applications.

Chemical additives may be included in the aqueous furnish in accordance with the present invention. The chemical additive may include surface modifiers, softeners, debonders, strength aids, latexes, opacifiers, optical brighteners, dyes, pigments, sizing agents, barrier chemicals, retention aids, insolubilizers, organic or inorganic crosslinkers, and combinations thereof, said chemicals optionally comprising polyols, starches, PPG esters, PEG esters, phospholipids, surfactants, polyamides and the like. Typically, such chemicals include a cationic debonding agent. A debonder advantageously includes a non-ionic surfactant in some embodiments.

The process of the present invention is advantageously practiced wherein the creped web is transferred over an open draw at a speed of at least about 1500 feet per minute ("fpm") while aerodynamically supporting the web to preserve its creped structure. Aerodynamic support may be accomplished using a passive air foil which may be contoured or uncontoured or aerodynamic support may be practiced utilizing a Coanda effect air foil. So also, the wet web may be supported by being vacuum drawn to a permeable sheet disposed over the open draw or supported by a foil including a plurality of overlapping plate portions as described hereinafter. The open draw is generally at least about two feet in length whereas an open draw of at least about three feet in length is more typical in many instances. The inventive process is advantageously practiced wherein the sheet is transferred over the open draw at a sheet speed of at least 2000 fpm (feet per minute), preferably at least 2500 or 3000 fpm. A speed of at least about 4000 fpm or even 5000 fpm is more preferred in some cases. Likewise, the creped web is advantageously throughdried at high drying rates. A rate of at least about 30 pounds of water removed per square foot of through-air drying surface per hour is desirable, whereas a throughdrying rate of at least about 40 pounds of water removed per square foot of through-air drying surface per hour is more preferred. A through-air drying rate of at least about 50 pounds of water removed per square foot of throughdrying surface per hour is even more preferred.

It will be appreciated by one who is skilled in the art that a variety of techniques may be utilized to achieve the desired voidage in the as-creped web. One method involves utilizing modified fiber. One may, for example, subject a portion of the fiber supplied to the aqueous furnish to a curling process. When utilizing this technique, typically at least about 5 percent, sometimes about 10 or about 25 percent of the fiber is subjected to a curling process prior to being supplied to the foraminous support. In other embodiments at least about 50 percent of the fiber in the aqueous furnish is subjected to a curling process prior to being supplied to the foraminous support, whereas one may choose to subject 75 percent of the fiber to a curling process or about 90 percent or more of the fiber to a curling process prior to forming the web. While any suitable method of curling the fiber may be used, a particularly advantageous method includes concurrently heat treating and convolving the fiber at an elevated temperature in a disk refiner with saturated steam at a pressure of from about 5 to about 150 psig. The fiber is optionally bleached. Preferred techniques involve carrying out this process in a disk refiner as described in more detail in U.S. Pat. Nos. 6,627,041 and 6,899,790, respectively entitled "Method of Bleaching and Providing Papermaking Fibers with Durable Curl and Absorbent Products Incorporating Same" and "Method of Providing Papermaking Fibers with Durable Curl and Absorbent Products Incorporating Same".

In some embodiments it may be desirable to utilize a controlled pressure shoe press as noted above and/or foam-form the furnish on the foraminous support as hereinafter discussed in more detail. Generally, foamed furnish will contain from about 150 to about 500 ppm by weight of a foam-forming surfactant and have a consistency of from about 0. 1 to about 3 percent.

Another method of achieving a relatively high voidage for the as creped web involves delamination creping over a temperature differential between the cylinder side and the air side of the web. Typically the temperature differential between the surfaces of the web is from about 5 degrees F. to about 80 degrees F. A temperature differential of from about 10 degrees F. to about 40 degrees F. is more typical whereas a temperature differential of between about 15 degrees F. and about 30 degrees F. is preferred in many cases. In a particularly preferred embodiment the temperature differential between the cylinder side and the air side of the web is about 20 degrees F.

In order to provide enhanced bulk to the final product, it is desirable in some cases to pressure mold the web into an impression fabric subsequent to the creping of the web but prior to the throughdrying thereof. In some embodiments the air side of the web is relatively moist with respect to the cylinder side of the as creped web and this side is molded into the impression fabric. In these embodiments the air side is more amenable to wet shaping than the cylinder side which is relatively dry. The inventive processing be characterized in terms of the final products which will in many cases exhibit similar values in terms of tensile strength, void volume and so forth as the as-creped web. There is thus within the present invention, a wet crepe, throughdry process for making fibrous sheet comprising the steps of: (a) depositing an aqueous furnish onto a foraminous support; (b) compactively dewatering said furnish to form a web; (c) applying said dewatered web to a heated rotating cylinder and drying said web to a consistency of greater than about 30 percent and less than about 90 percent; and (d) creping said web from said heated cylinder at said consistency of greater than about 30 percent and less than about 90 percent; wherein the furnish composition and processing of steps (a), (b) and (c), as well as the creping geometry, temperature profile of the web upon creping, moisture profile of the web upon creping and web adherence to the heated rotated cylinder are controlled; and (e) throughdrying said web subsequent to creping said web from said heated cylinder to form said fibrous sheet, wherein the void volume of the sheet in grams/g is greater than about 9.2–0.048X wherein X is the GMT of the product (grams/3") divided by the basis weight of the product (lbs/3000 $ft^2$). Typically, the sheet exhibits a characteristic void volume in grams/g of greater than about 9.5–0.048X wherein X is the GMT of the as-creped product (grams/3") divided by the basis weight of the as-creped product (lbs/3000 ft2) and usually the sheet exhibits a characteristic void volume in grams/g of greater than about 9.75–0.048X wherein X is the GMT of the as-creped product (grams/3") divided by the basis weight of the as-creped product (lbs/3000 $ft^2$). The product sheet preferably includes also the specific attributes recited above in connection with the as-creped web.

When practicing delamination creping it is most advantageous to crepe the web wherein the air side of the web is at a temperature of from about 160 degrees F. to about 210 degrees F. upon creping. Creping the web where the air side of the web is at a temperature of from about 180 degrees F. to about 200 degrees F. is more preferred while in a particularly preferred embodiment the web is creped when the air side is at a temperature of about 190 degrees F. The underside of the sheet upon creping is generally at a temperature of from about 210 degrees F. to about 240 degrees F. Typically, the temperature of the cylinder side of the sheet is from about 220 degrees F. to about 230 degrees F. Steam is generally applied to the rotating cylinder at pressure of from about 30 to about 150 psig while a pressure of steam supplied to the cylinder is more typically at least about 100 psig.

Figure 4:
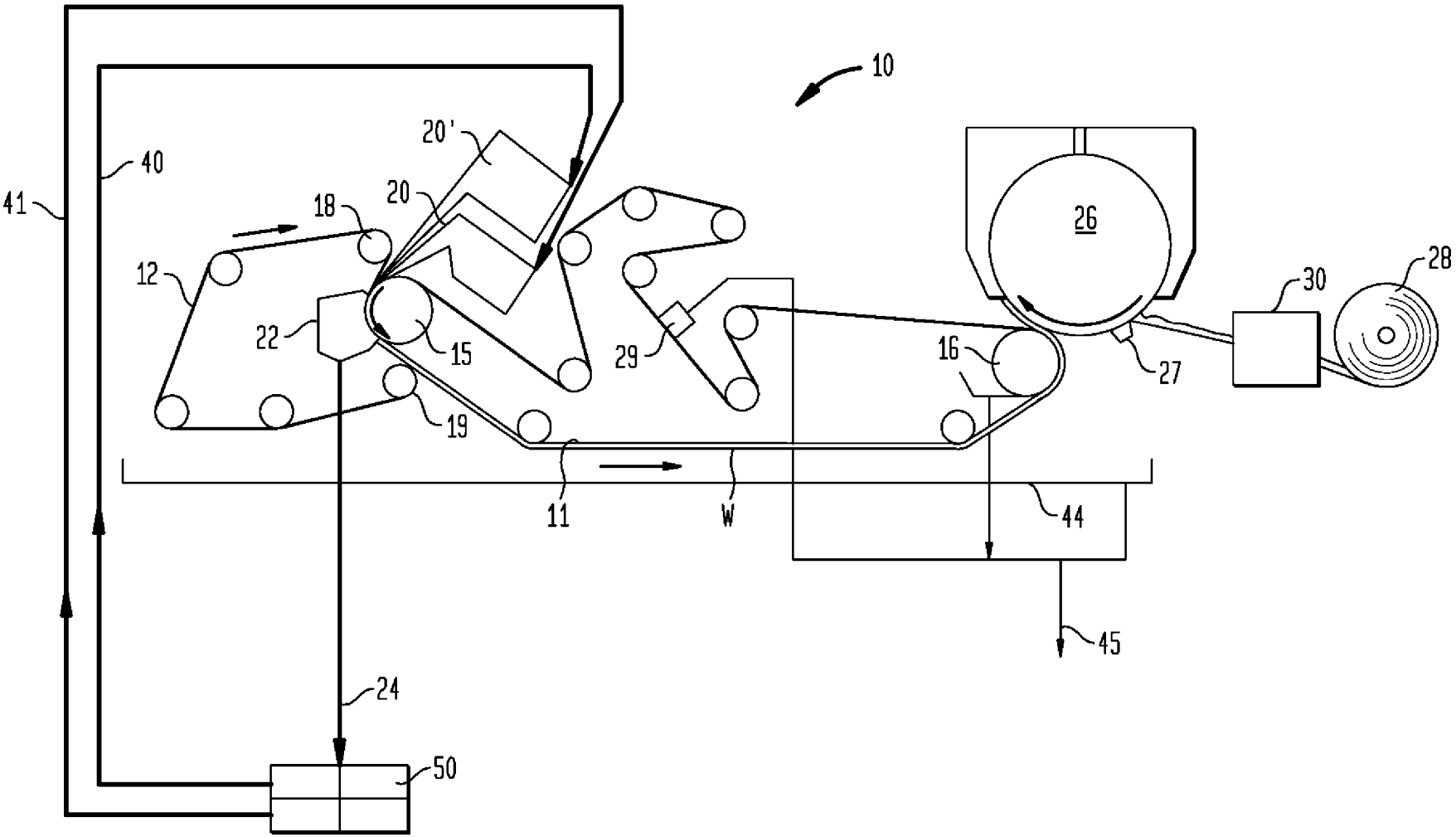
FIG. 4 illustrates one papermachine layout which may be used in accordance with the present invention.

FIG. 4 illustrates an embodiment of the present invention where a machine chest 50, which may be compartmentalized, is used for preparing furnishes that are treated with chemicals having different functionality depending on the character of the various fibers used. This embodiment shows two head boxes thereby making it possible to produce a stratified product. The product according to the present invention can be made with single or multiple head boxes and regardless of the number of head boxes may be stratified or unstratified. The treated furnish is transported through different conduits 40 and 41, where they are delivered to the head box 20, 20' (indicating an optionally compartmented headbox) of a crescent forming machine 10.

FIG. 4 shows a web-forming end or wet end with a liquid permeable foraminous support member 11 which may be of any conventional configuration. Foraminous support member 11 may be constructed of any of several known materials including photopolymer fabric, felt, fabric, or a synthetic filament woven mesh base with a very fine synthetic fiber batt attached to the mesh base. The foraminous support member 11 is supported in a conventional manner on rolls, including breast roll 15 and couch or pressing roll, 16.

Forming fabric 12 is supported on rolls 18 and 19 which are positioned relative to the breast roll 15 for pressing the press wire 12 to converge on the foraminous support member 11. The foraminous support member 11 and the wire 12 move in the same direction and at the same speed which is in the direction of rotation of the breast roll 15. The pressing wire 12 and the foraminous support member 11 converge at an upper surface of the forming roll 15 to form a wedge-shaped space or nip into which one or more jets of water or foamed liquid fiber dispersion (furnish) provided by single or multiple headboxes 20, 20' is pressed between the pressing wire 12 and the foraminous support member 11 to force fluid through the wire 12 into a saveall 22 where it is collected to reuse in the process.

The nascent web W formed in the process is carried by the foraminous support member 11 to the pressing roll 16 where the nascent web W is transferred to the drum 26 of a Yankee dryer. Fluid is pressed from the web W by pressing roll 16 as the web is transferred to the drum 26 of a dryer where it is partially dried and creped by means of a creping blade 27. The creped web is then transferred to an additional drying section 30 as shown in FIG. 12 to complete the drying of the web, prior to being collected on a take-up roll 28. The drying section 30 includes a throughdryer as is well known in the art.

A pit 44 is provided for collecting water squeezed from the furnish by the press roll 16 and a Uhle box 29. The water collected in pit 44 may be collected into a flow line 45 for separate processing to remove surfactant and fibers from the water and to permit recycling of the water back to the papermaking machine 10.

According to the present invention, an absorbent paper web can be made by dispersing fibers into aqueous slurry and depositing the aqueous slurry onto the forming wire of a papermaking machine. Any art-recognized forming scheme might be used. For example, an extensive but non-exhaustive list includes a crescent former, a C-wrap twin wire former, an S-wrap twin wire former, a suction breast roll former, a Fourdrinier former, or any art-recognized forming configuration. The forming fabric can be any suitable foraminous member including single layer fabrics, double layer fabrics, triple layer fabrics, photopolymer fabrics, and the like. Non-exhaustive background art in the forming fabric area includes U.S. Pat. Nos. 4,157,276; 4,605,585; 4,161,195; 3,545,705; 3,549,742; 3,858,623; 4,041,989; 4,071,050; 4,112,982; 4,149,571; 4,182,381; 4,184,519; 4,314,589; 4,359,069; 4,376,455; 4,379,735; 4,453,573; 4,564,052; 4,592,395; 4,611,639; 4,640,741; 4,709,732; 4,759,391; 4,759,976; 4,942,077; 4,967,085; 4,998,568; 5,016,678; 5,054,525; 5,066,532; 5,098,519; 5,103,874; 5,114,777; 5,167,261; 5,199,261; 5,199,467; 5,211,815; 5,219,004; 5,245,025; 5,277,761; 5,328,565; and 5,379,808 all of which are incorporated herein by reference in their entirety. One forming fabric particularly useful with the present invention is Voith Fabrics Forming Fabric 2164 made by Voith Fabrics Corporation, Shreveport, La.

Foam-forming of the aqueous furnish on a forming wire or fabric may be employed as a means for controlling the permeability or void volume of the sheet upon wet-creping. Suitable foam-forming techniques are disclosed in U.S. Pat. No. 4,543,156 and Canadian Patent No. 2,053,505, the disclosures of which are incorporated herein by reference. The foamed fiber furnish is made up from an aqueous slurry of fibers mixed with a foamed liquid carrier just prior to its introduction to the headbox. The pulp slurry supplied to the system has a consistency in the range of from about 0.5 to about 7 weight percent fibers, preferably in the range of from about 2.5 to about 4.5 weight percent. The pulp slurry is added to a foamed liquid comprising water, air and surfactant containing 50 to 80 percent air by volume forming a foamed fiber furnish having a consistency in the range of from about 0. 1 to about 3 weight percent fiber by simple mixing from natural turbulence and mixing inherent in the process elements. The addition of the pulp as a low consistency slurry results in excess foamed liquid recovered from the forming wires. The excess foamed liquid is discharged from the system and may be used elsewhere or treated for recovery of surfactant therefrom. Thus, a method of making a fibrous web or tissue from a foamed fiber furnish includes depositing an aqueous dispersion of fibers onto a moving foraminous support characterized in that a foamed aqueous dispersion is obtained by combining an unfoamed aqueous slurry of fibers containing 0.5 to 7 percent fiber with a foamed liquid comprising water, air and a surface active agent to form a foamed fiber furnish containing from 50 to 80 percent air by volume and from 0.5 to 3 weight percent fiber, based on the dry weight of the fibers.

The foamed liquid or aqueous dispersion is produced by mixing water with sufficient surfactant in a suitable vessel or cavity to produce the foamed liquid. A suitable anionic surfactant such as alpha olefin sulfonate, available from Goldschmidt A. G. (Germany), may be used to produce a satisfactory aqueous foam. The surfactant is generally present in the range of from about 100 ppm to about 350 ppm by weight in some embodiments. A number of surfactants suitable as a water additive for purposes of the present invention are available on the market, being generally classified as nonionic, anionic, cationic or amphoteric. The surfactant concentration required usually will be in the range of 150 to about 1000 ppm by weight and typically in the range of from about 150 to about 500 ppm by weight. Generally, the bubble size of the foam is in the range of from about 20 to about 200 microns as will be appreciated by one of skill in the art.

Selection of a class of surfactant is dependent upon chemical characteristics of such other additives as may be commonly used in the manufacture of fibrous webs. These other additives may include, singly or in homogeneous mixtures thereof, latexes, binders, debonding agents, dyes, corrosion inhibiting agents, pH controls, retention aids, creping aids, additives for increasing wet strength or dry strength as well as other substances commonly used in papermaking processes.

U.S. Pat. Nos. 3,716,449 and 3,871,952 disclose specific nonionic, anionic, and cationic surfactants, including some classified as amphoteric surfactants, which are suitable for practice of foam-forming in connection with the present invention. It is to be understood that there are a number of other surfactant materials available which are capable of modifying the interfacial tension between water and gas or air to form a semi-stable foam. Further details on foam-forming may be found in U.S. Pat. Nos. 5,200,035; 5,164,045; 4,764,253, the disclosures of which are incorporated herein by reference.

Papermaking fibers used to form the absorbent products of the present invention include cellulosic fibers and especially wood pulp fibers, liberated in the pulping process from softwood (gymnosperms or coniferous trees) and hardwoods (angiosperms or deciduous trees). Cellulosic fibers from diverse material origins may be used to form the web of he present invention. These fibers include non-woody fibers liberated from sugar cane, bagasse, sabai grass, rice straw, banana leaves, paper mulberry (i.e., bast fiber), abaca leaves, pineapple leaves, esparto grass leaves, and fibers from the genus hesperaloe in the family Agavaceae. Also recycled fibers which may contain of the above fiber sources in different percentages, can be used in the present invention. Suitable fibers are disclosed in U.S. Pat. Nos. 5,320,710 and 3,620,911, both of which are incorporated herein by reference.

Papermaking fibers can be liberated from their source material by any one of the number of chemical pulping processes familiar to one experienced in the art including sulfate, sulfite, polysulfide, soda pulping, etc. The pulp can be bleached if desired by chemical means including the use of chlorine, chlorine dioxide, oxygen, etc. Furthermore, papermaking fibers can be liberated from source material by any one of a number of mechanical/chemical pulping processes familiar to anyone experienced in the art including mechanical pulping, thermomechanical pulping, and chemithermomechanical pulping. These mechanical pulps can be bleached, if necessary, by a number of familiar bleaching schemes including alkaline peroxide and ozone bleaching.

Fibers for use according to the present invention are also procured by recycling of pre-and post-consumer paper products. Fiber may be obtained, for example, from the recycling of printers' trims and cuttings, including book and clay coated paper, post consumer paper including office and curbside paper recycling including old newspaper. The various collected paper can be recycled using means common to the recycled paper industry. The papers may be sorted and graded prior to pulping in conventional low, mid, and high-consistency pulpers. In the pulpers the papers are mixed with water and agitated to break the fibers free from the sheet. Chemicals may be added in this process to improve the dispersion of the fibers in the slurry and to improve the reduction of contaminants that may be present. Following pulping, the slurry is usually passed through various sizes and types of screens and cleaners to remove the larger solid contaminants while retaining the fibers. It is during this process that such waste contaminants as paper clips and plastic residuals are removed. The pulp is then generally washed to remove smaller sized contaminants consisting primarily of inks, dyes, fines and ash. This process is generally referred to as deinking. Deinking can be accomplished by several different processes including wash deinking, floatation deinking, enzymatic deinking and so forth. One example of a sometimes preferred deinking process by which recycled fiber for use in the present invention can be obtained is called floatation. In this process small air bubbles are introduced into a column of the furnish. As the bubbles rise they tend to attract small particles of dye and ash. Once upon the surface of the column of stock they are skimmed off. At this point the pulp may be relatively clean but is often low in brightness. Paper made from this stock can have a dingy, gray appearance, not suitable for near-premium product forms.

Since the cost of waste paper delivered to the pulp processing plant is related to the cleanliness and quality of the fibers in the paper, it is advantageous to be able to upgrade relatively low cost waste papers into relatively high value pulp. However, the process to do this can be expensive not only in terms of machinery and chemical costs but also in lost yield. Yield is defined as the percentage by weight of the waste paper purchased that finally ends up as pulp produced. Since the lower cost waste papers generally contain more contaminants, especially relatively heavy clays and fillers generally associated with coated and writing papers, removal of these contaminants can have a dramatic effect on the overall yield of pulp obtainable. Low yields also translate into increased amounts of material that must be disposed of in landfills or by other means.

In addition, as the ash levels are reduced, fines, and small fibers are lost since there is currently no ash-specific removal process in use which removes only ash without taking small fibers and fines. For example, if a pulp of 70 percent yield can be used rather than a "cleaner" 50 percent yield the savings in pulp cost due to more fiber and less waste removal is significant.

Generally, premium grade products are not made using a major amount of secondary recycle fibers, let alone being made predominately or entirely from secondary recycle fibers. Recycled fibers suffer from problems with low brightness requiring the addition of virgin fibers; and slow furnish de-watering resulting in poor drainage on the forming wire and necessitating slower machine speeds. Base sheets made by conventional means with a high percentage or 100 percent recycled fibers are very dense and not amenable to through-drying in many cases. Moreover, their strength does not break down as much during creping in a conventional process due to their high density on contact with the creping blade. This results in harsh, high strength, creped paper. In conventional processes it has been understood that to include recycle fibers, it is necessary to preprocess the fibers to render them substantially free from ash. This inevitably increases cost. Failing to remove the ash is believed to create often insurmountable problems with drainage or formation. If sufficient water is added to the stock to achieve good formation, the forming wires often flood. If the water is reduced to prevent this flooding problem, there are often severe problems in forming a substantially homogeneous web.

The preferred furnishes according to the present invention may contain significant amounts of secondary fibers that possess significant amounts of ash and fines. It is common in the industry to hear the term ash associated with virgin fibers. This is defined as the amount of ash that would be created if the fibers were burned. Typically no more than about 0.1% to about 0.2% ash is found in virgin fibers. Ash as used in the present invention includes this "ash" associated with virgin fibers as well as contaminants resulting from prior use of the fiber. Furnishes utilized in connection with the present invention may include excess of amounts of ash greater than about 1% or more. Ash originates when fillers or coatings are needed to paper during formation of a filled or coated paper product. Ash will typically be a mixture containing titanium dioxide, kaolin clay, calcium carbonate and/or silica. This excess ash or particulate matter is what has traditionally interfered with processes using recycle fibers, thus making the use of recycled fibers unattractive. In general recycled paper containing high amounts of ash is priced substantially lower than recycled papers with low or insignificant ash contents. Thus, there will be a significant advantage to a process for making a premium or near-premium product from recycled paper containing excessive amounts of ash.

Furnishes containing excessive ash also typically contain significant amounts of fines. Ash and fines are most often associated with secondary, recycled fibers, post-consumer paper and converting broke from printing plants and the like. Secondary, recycled fibers with excessive amounts of ash and significant fines are available on the market and are quite cheap because it is generally accepted that only very thin, rough, economy towel and tissue products can be made unless the furnish is processed to remove the ash. The present invention makes it possible to achieve a paper product with high void volume and premium or near-premium qualities from secondary fibers having significant amounts of ash and fines without any need to preprocess the fiber to remove fines and ash. While the present invention contemplates the use of fiber mixtures, including the use of virgin fibers, fiber in the products according to the present invention may have greater than 0.75% ash, and sometimes more than 1% ash. The fiber may have greater than 2% ash and may even have as high as 30% ash or more.

As used herein, fines constitute material within the furnish that will pass through a 100 mesh screen. Ash and ash content is defined as above and can be determined using TAPPI Standard Method T211 OM93.

The suspension of fibers or furnish may contain chemical additives to alter the physical properties of the paper produced. These chemistries are well understood by the skilled artisan and may be used in any known combination. Such additives may be surface modifiers, softeners, debonders, strength aids, latexes, opacifiers, optical brighteners, dyes, pigments, sizing agents, barrier chemicals, retention aids, insolubilizers, organic or inorganic crosslinkers, or combinations thereof, said chemicals optionally comprising polyols, starches, PPG esters, PEG esters, phospholipids, surfactants, polyamines, HMCP or the like.

The pulp can be mixed with strength adjusting agents such as wet strength agents, dry strength agents and debonders/softeners. Suitable wet strength agents are known to the skilled artisan. A comprehensive but non-exhaustive list of useful strength aids include urea-formaldehyde resins, melamine formaldehyde resins, glyoxylated polyacrylamide resins, polyamide-epichlorohydrin resins and the like. Thermosetting polyacrylamides are produced by reacting acrylamide with diallyl dimethyl ammonium chloride (DADMAC) to produce a cationic polyacrylamide copolymer which is ultimately reacted with glyoxal to produce a cationic cross-linking wet strength resin, glyoxylated polyacrylamide. These materials are generally described in U.S. Pat. No. 3,556,932 to Coscia et al. and U.S. Pat. No. 3,556,933 to Williams et al., both of which are incorporated herein by reference in their entirety. Resins of this type are commercially available under the trade name of PAREZ 631NC by Bayer Corporation. Different mole ratios of acrylamide/DADMAC/glyoxal can be used to produce cross-linking resins, which are useful as wet strength agents. Furthermore, other dialdehydes can be substituted for glyoxal to produce thermosetting wet strength characteristics. Of particular utility are the polyamide-epichlorohydrin resins, an example of which is sold under the trade names Kymene 557LX and Kymene 557H by Hercules Incorporated of Wilmington, Del. and Amres® from Georgia-Pacific Resins, Inc. These resins and the process for making the resins are described in U.S. Pat. Nos. 3,700,623 and 3,772,076 each of which is incorporated herein by reference in its entirety. An extensive description of polymeric-epihalohydrin resins is given in Chapter 2: *Alkaline-Curing Polymeric Amine-Epichlorohydrin* by Espy in *Wet Strength Resins and Their Application* (L. Chan, Editor, 1994), herein incorporated by reference in its entirety. A reasonably comprehensive list of wet strength resins is described by Westfelt in *Cellulose Chemistry and Technology* Volume 13, p. 813, 1979, which is incorporated herein by reference.

Suitable dry strength agents will be readily apparent to one skilled in the art. A comprehensive but non-exhaustive list of useful dry strength aids includes starch, guar gum, polyacrylamides, carboxymethyl cellulose and the like. Of particular utility is carboxymethyl cellulose, an example of which is sold under the trade name Hercules CMC by Hercules Incorporated of Wilmington, Del.

Suitable debonders are likewise known to the skilled artisan. Debonders or softeners may also be incorporated into the pulp or sprayed upon the web after its formation. The present invention may also be used with softener materials including but not limited to the class of amido amine salts derived from partially acid neutralized amines. Such materials are disclosed in U.S. Pat. No. 4,720,383. Evans, *Chemistry and Industry,* 5 Jul. 1969, pp. 893-903; Egan, *J. Am. Oil Chemist's Soc.*, Vol. 55 (1978), pp. 118-121; and Trivedi et al., *J. Am. Oil Chemist's Soc.*, June 1981, pp. 754-756, incorporated by reference in their entirety, indicate that softeners are often available commercially only as complex mixtures rather than as single compounds. While the following discussion will focus on the predominant species, it should be understood that commercially available mixtures would generally be used in practice.

Quasoft 202-JR is a suitable softener material, which may be derived by alkylating a condensation product of oleic acid and diethylenetriamine. Synthesis conditions using a deficiency of alkylation agent (e.g., diethyl sulfate) and only one alkylating step, followed by pH adjustment to protonate the non-ethylated species, result in a mixture consisting of cationic ethylated and cationic non-ethylated species. A minor proportion (e.g., about 10%) of the resulting amido amine cyclize to imidazoline compounds. Since only the imidazoline portions of these materials are quaternary ammonium compounds, the compositions as a whole are pH-sensitive. Therefore, in the practice of the present invention with this class of chemicals, the pH in the head box should be approximately 6 to 8, more preferably 6 to 7 and most preferably 6.5 to 7.

Quaternary ammonium compounds, such as dialkyl dimethyl quaternary ammonium salts are also suitable particularly when the alkyl groups contain from about 10 to 24 carbon atoms. These compounds have the advantage of being relatively insensitive to pH.

Biodegradable softeners can be utilized. Representative biodegradable cationic softeners/debonders are disclosed in U.S. Pat. Nos. 5,312,522; 5,415,737; 5,262,007; 5,264,082; and 5,223,096, all of which are incorporated herein by reference in their entirety. The compounds are biodegradable diesters of quaternary ammonia compounds, quaternized amine-esters, and biodegradable vegetable oil based esters functional with quaternary ammonium chloride and diester dierucyldimethyl ammonium chloride and are representative biodegradable softeners.

In some embodiments, a particularly preferred debonder composition includes a quaternary amine component as well as a nonionic surfactant.

The quaternary ammonium component may include a quaternary ammonium species selected from the group consisting of: an alkyl(enyl)amidoethyl-alkyl(enyl)-imidazolinium, dialkyldimethylammonium, or bis-alkylamidoethyl-methyl-hydroxy-ethyl-ammonium salt; wherein the alkyl groups are saturated, unsaturated, or mixtures thereof, and the hydrocarbon chains have lengths of from ten to twenty-two carbon atoms. The debonding composition may include a synergistic combination of: (a) a quaternary ammonium surfactant component comprising a surfactant compound selected from the group consisting of a dialkyldimethyl-ammonium salts of the formula:

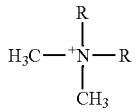

a bis-dialkylamidoammonium salt of the formula:

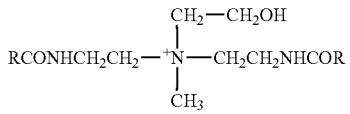

a dialkylmethylimidazolinium salt of the formula:

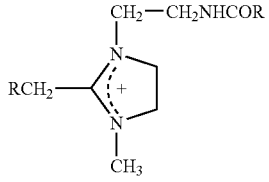

wherein each R may be the same or different and each R indicates a hydrocarbon chain having a chain length of from about ten to about twenty-four carbon atoms and may be saturated or unsaturated; and wherein said compounds are associated with a suitable anion; and (b) a nonionic surfactant component. Preferably, the ammonium salt is a dialkyl-imidazolinium compound and the suitable anion is methylsulfate. The nonionic surfactant component typically includes the reaction product of a fatty acid or fatty alcohol with ethylene oxide such as a polyethylene glycol diester of a fatty acid (PEG diols or PEG diesters); polypropylene glycol (PPG) esters, diols and other suitable compounds may be employed.

In accordance with the invention, the fibrous web is deposited on a de-watering felt and water is mechanically removed from the web. Any art suitable fabrics or felts could be used with the present invention. For example, an additional list of impression fabrics includes plain weave fabrics described in U.S. Pat. No. 3,301,746; semi-twill fabrics described in U.S. Pat. Nos. 3,974,025 and 3,905,863; bilaterally-staggered-wicker-basket cavity type fabrics described in U.S. Pat. Nos. 4,239,065 and 4,191,609; sculptured/load bearing layer type fabrics described in U.S. Pat. No. 5,429,686; photopolymer fabrics described in U.S. Pat. Nos. 4,529,480; 4,637,859; 4,514,345; 4,528,339; 5,364,504; 5,334,289; 5,275,799; and 5,260,171; and fabrics containing diagonal pockets described in U.S. Pat. No. 5,456,293. As will become apparent from the discussion which follows, a papermaking felt can be used with the present invention. For example, felts can have double-layer base weaves, triple-layer base weaves, or laminated base weaves. Preferred felts are those having the laminated base weave design. A wet-press-felt which may be particularly useful with the present invention is AMFlex 3 made by Voith Fabric. Background art in the press felt area includes U.S. Pat. Nos. 5,657,797; 5,368,696; 4,973,512; 5,023,132; 5,225,269; 5,182,164; 5,372,876; and 5,618,612. A differential pressing felt as is disclosed in U.S. Pat. No. 4,533,437 to Curran et al. may likewise be utilized.

As used herein, the term compactively dewatering the web or furnish refers to mechanical dewatering by wet pressing on a dewatering felt, for example, in some embodiments by use of mechanical pressure applied continuously over the web surface as in a nip between a press roll and a press shoe wherein the web is in contact with a papermaking felt. In other typical embodiments, compactively dewatering the web or furnish is carried out in a transfer nip on an impression or other fabric wherein the web is transferred to a Yankee dryer, for example, such that the furnish is concurrently compactively dewatered and applied to a heated rotating cylinder. Transfer pressure may be higher in selected areas of the web when an impression fabric is used. The terminology "compactively dewatering" is used to distinguish processes wherein the initial dewatering of the web is carried out by thermal means as is the case, for example, in U.S. Pat. No. 4,529,480 to Trokhan and U.S. Pat. No. 5,607,551 to Farrington et al. noted above. It is noted that webs which are initially compactively dewatered, that is, mechanically compressed in accordance with the present invention are initially typically more dense than webs which are initially dewatered by thermal means as in the '480 and '551 patents.

One method of providing that the web applied to and creped off of the Yankee dryer has sufficient permeability or porosity to be suitable for throughdrying is to provide in the furnish at the forming end of the process at least a modicum of curled fiber. This may be accomplished by adding commercially available high bulk additive ("HBA") available from Weyerhauser Corporation, or, suitable virgin or secondary fibers may be provided with additional curl as described in one or more of the following patents, the disclosure of which is hereby incorporated by reference into this patent as if set forth in their entirety: U.S. Pat. No. 2,516,384 to Hill et al.; U.S. Pat. No. 3,382,140 to Henderson et al.; U.S. Pat. No. 4,036,679 to Bach et al.; U.S. Pat. No. 4,431,479 to Barbe et al.; U.S. Pat. No. 5,384,012 to Hazard; U.S. Pat. No. 5,348,620 to Hermans et al.; U.S. Pat. No. 5,501,768 to Hermans et al.; or United U.S. Pat. No. 5,858,021 to Sun et al. The curled fiber is added in suitable amounts as noted herein, or, one may utilize 100% curled fiber if so desired provided the costs are not prohibitive.

In this respect, a particularly cost effective procedure is simply to concurrently heat treat and convolve the fiber in a pressurized disk refiner at relatively high consistency (20-60%) with saturated steam at a pressure of from about 5 to 150 psig. Preferably, the refiner is operated at low energy inputs, less than about 2 hp-day/ton and at short residence times of the fiber in the refiner. Suitable residence times may be less than about 20 seconds and typically less than about 10 seconds. This procedure produces fiber with remarkably durable curl as described in co-pending U.S. Pat. No. 6,899,790 (Attorney Docket No. 2247) entitled "Method of Providing Papermaking Fibers with Durable Curl and Absorbent Sheet Incorporating Same" (noted above).

The web is typically adhered to the Yankee dryer by nip transfer pressing. The transfer may be accomplished by any art-recognized method including, but not limited to, press rolls and belts. The machine configuration used to transfer the web to the Yankee can be any method that allows one to adhere the web to the dryer and create a profile that causes delamination upon creping. While the specification generally makes reference to the dryer from which the web is creped as a Yankee dryer, it should be understood that any dryer from which the web is creped can be used. One example of an alternative configuration would include the use of an impulse dryer including a wide-shoe press against a heated back roll.

Any suitable adhesive might be used on the Yankee dryer. Examples of conventional adhesives include polyvinyl alcohol with suitable plasticizers, glyoxylated polyacrylamide with or without polyvinyl alcohol, and polyamide epichlorohydrin resins such as Quacoat A-252 (QA252), Betz CrepePlus 97 (Betz+97) and Calgon 675 B. Suitable adhesives are widely described in the patent literature. A comprehensive but non-exhaustive list includes U.S. Pat. Nos. 5,246,544; 4,304,625; 4,064,213; 3,926,716; 4,501,640; 4,528,316; 4,788,243; 4,883,564; 4,684,439; 5,326,434; 4,886,579; 5,374,334; 4,440,898; 5,382,323; 4,094,718; 5,025,046; and 5,281,307, incorporated herein by reference. Other suitable adhesives may also be used. Typical release agents can be used in accordance with the present invention.

The adhesive is preferably added in an amount of greater than about 0.1 lbs/ton, more preferably greater than about 0.25 lbs/ton, and most preferably between about 0.5 and about 1.0 lb/ton. In some embodiments up to about 10 lbs/ton may be employed. The nascent web adhered to the dryer preferably has a solids content of from about 30 to about 90, more preferably from about 45 to about 75 and still more preferably from about 55 to about 65.

Delamination Creping

In one preferred embodiment, the temperature of the dryer from which the web is to be creped can be controlled to provide a moisture profile within the web that causes delamination of the web during creping. The Yankee dryer temperature and the Yankee hood temperature are controlled to provide a moisture profile in the web which causes delamination of the fibers during creping. This delamination is achieved through the use of increased heating to the Yankee dryer and decreased heating from the Yankee hood. Conventionally, more heat is applied from the Yankee hood than from the Yankee dryer. Conventional operation causes drying of the web on both sides, resulting in acceptable dry creping. When the heating from the Yankee is increased and the heating from the hood is decreased, the primary heat source contacting the web is the Yankee dryer. This causes the Yankee side of the web to be at a higher temperature than the air side of the web. This also causes the Yankee side of the web to be dryer than the air side of the web. It is believed that through the control of this moisture profile that delamination of the web occurs.

The Yankee dryer is preferably at a pressure of from about 30 to about 150 psig steam pressure, more preferably at pressure of from about 90 psig to about 150 psig, and still more preferably at a pressure of from about 110 to about 150 psig. During wet creping the Yankee dryer side of the sheet immediately after creping is preferably at a temperature of from about 180 to about 230° F., more preferably at a temperature from about 195 to about 225° F. and most preferably at a temperature of from about 205 to about 220° F. (as measured by IR using an emissivity setting of about 0.9).

The side of the sheet away from the Yankee dryer (the airside), when measured under similar circumstance, exhibits a temperature of about 210° F. or less, more preferably about 200° F. or less, still more preferably less than about 190° F. Delamination is best affected when the temperature sidedness of the sheet measured just after creping is at least about 5° F., more preferably at least about 10° F., still more preferably at least about 20° F. This differential is best controlled by maintaining an outside side sheet temperature (while on the roll but before creping) of about 220 degrees or less. In maintaining the temperatures in this manner one can be assured that there is a moisture differential sufficient in the sheet to produce the delamination effect. This is believed to be based upon the roll side of the sheet being dry just prior to creping. The dryness of a single side can be determined by the temperature exhibited by the side of the web in contact with the Yankee dryer. Because of the very high heat flux possible using an impulse dryer, the extent to which the web needs to be wrapped around the heated roll can be minimized to better control this temperature differential. In order to use an impulse dryer in the process according to the present invention, it is preferable that a shoe press is used to create sufficient adhesion between the web and the dryer to resulting in delamination upon creping.

The variables that affect delamination include Yankee hood temperature, Yankee dryer temperature, creping adhesive composition, blade angle, moisture content of the web at the time of creping, chemistry, stratification, fiber composition, basis weight, rate of heat transfer and time of drying.

Not wishing to be bound by theory, it is believed that the Yankee side of the web is sufficiently dry so as to act in the same manner as a completely dry web would during the creping operation. Since the other side of the web is significantly wetter, as the web is creped, a shear plane exists within the web resulting in delamination of the wetter part of the web from the dryer part of the web. Best results may be obtained when the outer surface of the web is at a temperature minimum as the drying cylinder rotates. Measurements indicate that the temperature of the outer surface of the web initially rises upon contact with the drying cylinder, then falls through a minimum before rising again. This phenomenon may be due to vapor action within the wet web.

Creping, by breaking a significant number of inter-fiber bonds, adds to and increases the perceived softness of resulting tissue or towel product.

The creping (pocket) angle is preferably between about 60 and about 95 degrees, more preferably between about 65 and about 90 degrees, and most preferably between about 70 and about 85 degrees. Decreasing the blade bevel from about 15 degrees shows an increase in the breakup and delamination of the web which is reflected as an increase in void volume and clearer separation of the two delaminated layers. Unless handled correctly, the 0 degree bevel blade caused actual disruptions of the top side layer of the sheet. Care must be taken to adjust the sheet take away angle from the creping pocket to insure that the line of the sheet draw be at or above the line of the creping blade surface. In this manner the sheet can be pulled out of the creping pocket before the nearly (or completely) delaminated sheet is damaged to the extent that it cannot be used for tissue or towel products.

Not wishing to be bound by theory, it is believed the process according to the present invention behaves in most respects exactly as a dry creping process. Thus, it is believed that the process according to the present invention may only be modified to improve runnability in a manner consistent with standard dry crepe protocols.

These dry crepe protocols include but are not limited to: creping angles, adhesive add-on rates, release add-on rates, sheet temperature (of the Yankee dryer side), blade changes, sheet threading, and crepe ratio (speed of the take-away relative to the creping cylinder). In short, the creping process is believed to behave quite similarly to a dry crepe process so operators can use their existing understanding of these creping variables to adjust and control this process. The operator needs to carefully monitor and control the moisture content and temperature differential across the sheet at the creping blade. These temperature differentials are indicative of the moisture differential across the sheet and therefore the propensity of the sheet to delaminate at creping. It could be particularly desirable to be able to change the creping pocket angle on the fly so as to have a direct means of controlling the downstream permeability of the sheet. In this manner, the subsequent drying of the sheet could be optimized for maximum production rates. For example, reduced air permeability will reduce through-air drying "TAD" drying rates significantly. The operator could then close the creping pocket (reduce the creping angle) to regain this lost permeability. In this manner he would be able to maintain both productivity and sheet quality throughout the life of the creping blade. Or the operator could make grade changes without the need to break the sheet down at this critical creping step.

Figure 5:
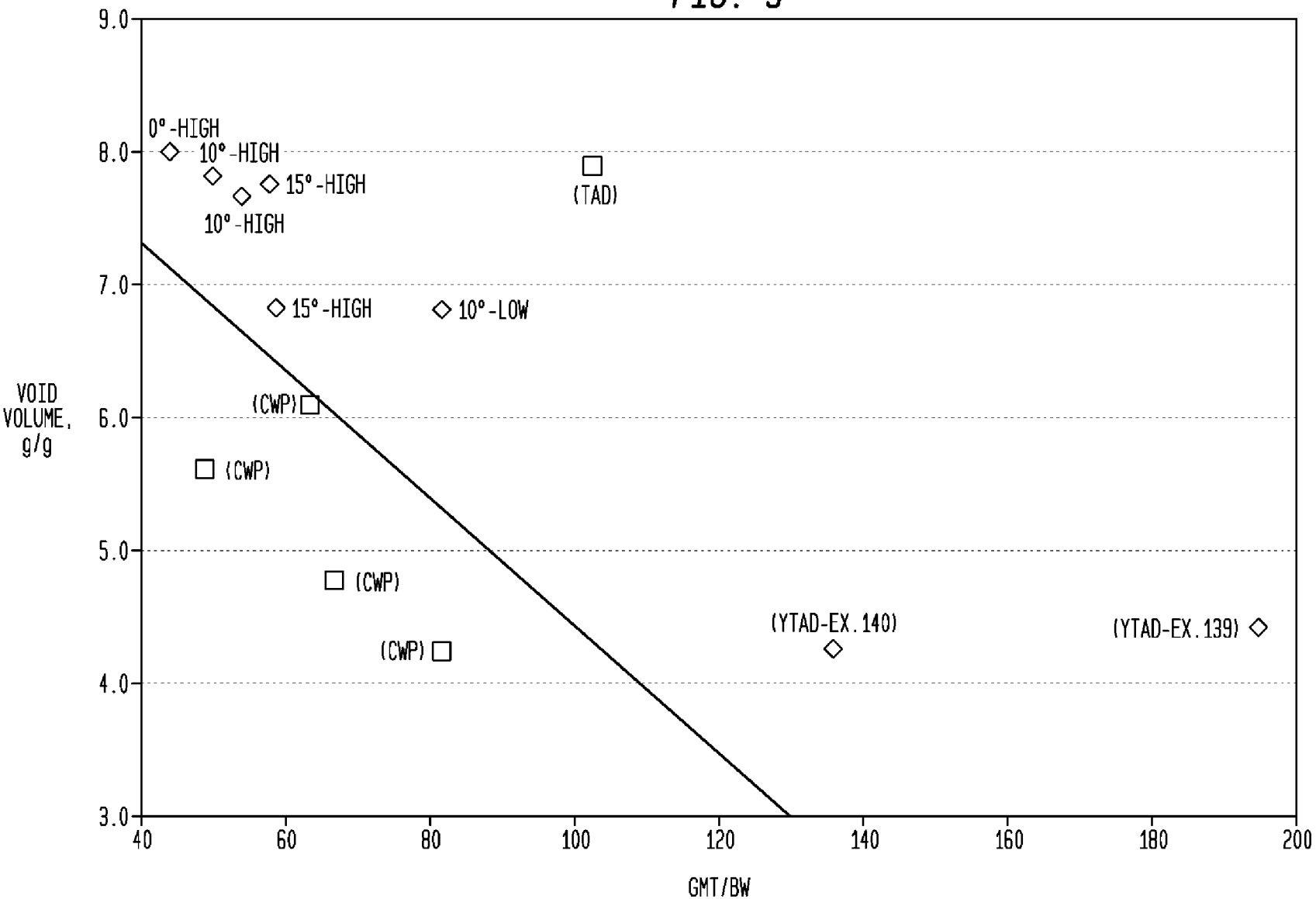
FIG. 5 is a graphical comparison of the products of the present invention and conventional products in terms of void volume and GMT/Basis Weight.
Figure 6:
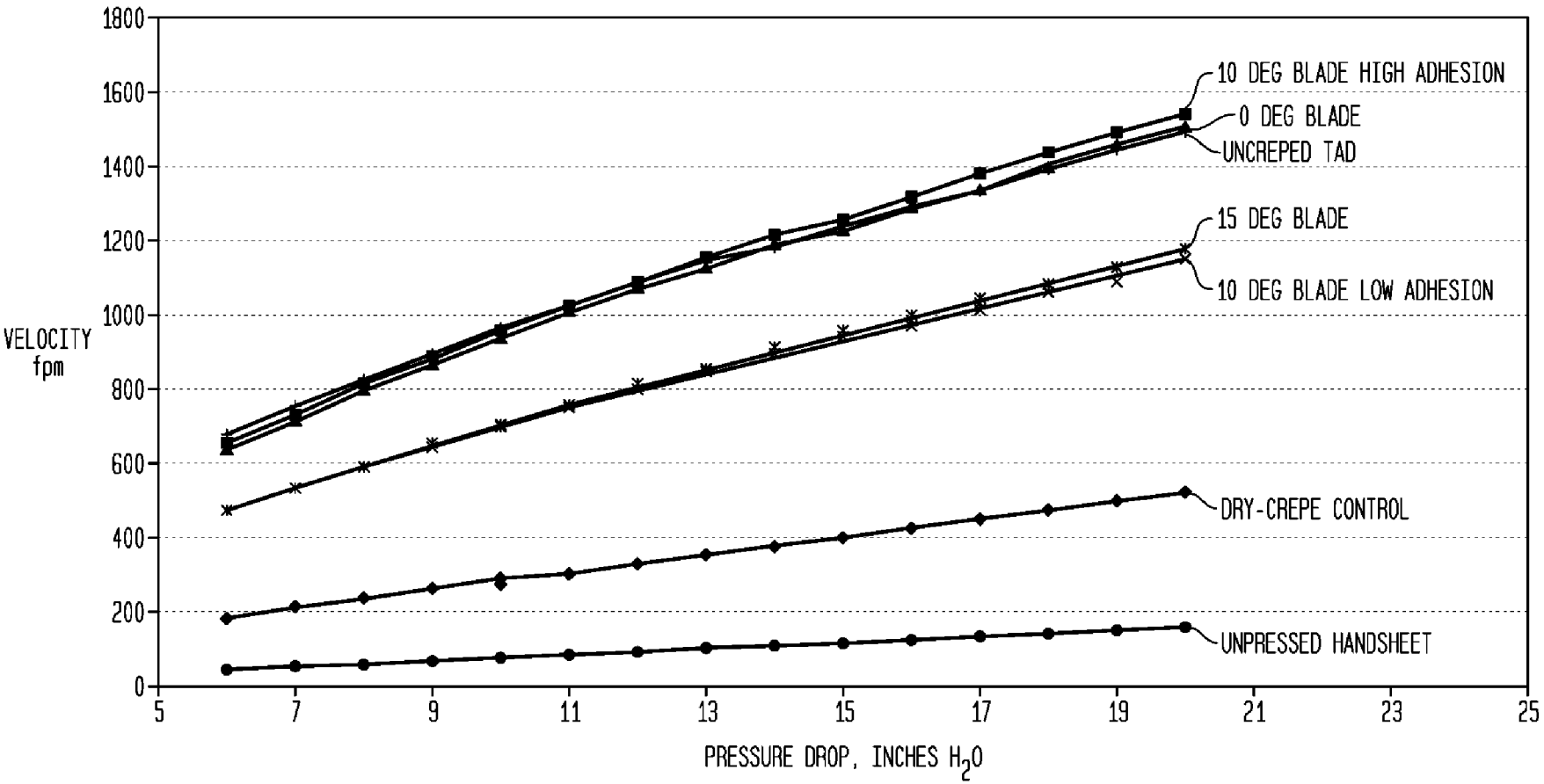
FIG. 6 is a graphical representation showing the impact of creping variables and the relative permeability of various fibrous sheets.

FIG. 5 shows the response of the internal void volume of the web, as measured by the Porofil® void volume test described above, to creping blade angle, or creping pocket as it is sometimes referred to. FIG. 5 is a plot of void volume (g/g) versus the GMT (g/3") divided by basis weight in lbs/3000 $ft^2$. In FIG. 5, the delamination process of the present invention is indicated by the diamonds at the upper left portion of the graph; whereas, other products of the invention are at the lower right. FIG. 6 shows a similar response in the air permeability of the web for 50/50 hardwood/softwood sheet. In FIG. 6, delamination creped products of the invention are compared with a dry-creped control, an unpressed handsheet, as well as uncreped TAD products. As can be seen from FIG. 6, the air permeability of the web according to the present invention is significantly above that which one of ordinary skill would expect for a similar dry-creped product, which today is commonly used to predict the through-air dryability of the web.

The final product may be calendered or uncalendered and is usually reeled to await further converting processes. The products according to the present invention may be subjected to any art-recognized converting operations, including embossing, printing, etc.

The web can be used to form single or multi-ply product benefiting from high internal volume or interruption of the pore structure in the interior of the sheet, including, for example, bathroom tissue, facial tissue, napkins, paper towels.

The following additional examples are illustrative of, but are not to be construed as limiting, the invention embodied herein.

EXAMPLES

COMPARATIVE EXAMPLE P

A web was produced from a slurry of furnish mixture of 50% bleached southern hardwood draft (BHWK) and 50% bleached southern softwood kraft (BSWK). The furnish contained chemicals to assist with creping and felt/wire cleaning. The furnish was not refined. A nascent web was deposited on a pressing felt and pressed to a solids content of 44%, simultaneously with being adhered to a Yankee dryer. The web was creped from the Yankee dryer at a water content of less than 2% (that is, 98% consistency as the term is used herein)

moisture using an 82° pocket angle (i.e., creping angle) and about 0.5 lbs/ton of creping adhesive and about 0.5 lbs/ton of release agent.

Figure 7:
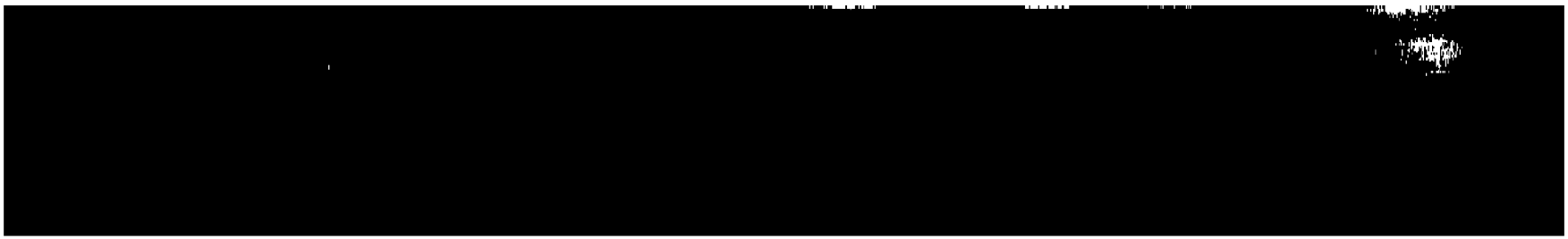
FIG. 7 is a 50× photographic representation of the cross machine direction of a 29 lb web that has been creped from a Yankee dryer.

FIG. 7 is a photographic representation of the cross machine direction of a 29 lb web than has been dry creped from a Yankee dryer. The representation is at a magnification of 50×. The photograph shows the degree to which the web was debonded by the severe creping action obtained by the low moisture creping.

EXAMPLE 141

A web was produced as described in comparative Example P with the same fibers and furnish, except that the hoods were cooled down to reduce the dryness of the sheet at the creping blade. A nascent web was deposited on a pressing felt and pressed to a solids content of 44%, simultaneously with being adhered to a Yankee dryer. The web was creped from the Yankee dryer at a solids content of 55% and a blade bevel of 10°. The web was subsequently pulled out using a pair of calender with rolls very lightly nipped with a resulting crepe of 15% left in the sheet. Percent crepe was calculated as:

(Yankee speed−Calender speed)÷Yankee speed×100%

The sheet was then collected and dried to a solids content of about 95% while held in restraint by sheet restraining/drying racks at room temperature. This restrained drying is used to the approximate as-creped properties of the sheet. Multiple fabric can drying could also be used but might not exhibit such a dramatic effect in void volume, permeability, etc., due to the sheet compression during drying that is commonly encountered with this method.

Figure 8:
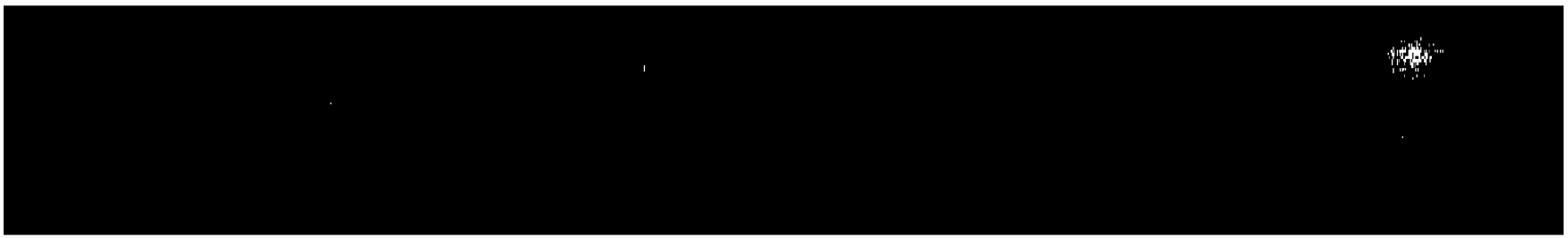
FIG. 8 is a 50× photographic representation of the cross machine direction of a 35 lb web produced according to the present invention and creped with a blade having a 10° bevel angle, illustrating the delamination that occurs within the web.

FIG. 8 is a photographic representation of the cross machine direction of a 35 lb web produced according to the present invention. The web was creped from the Yankee dryer with a 10° beveled blade. As can be seen from the 50× photograph, delamination of the fibers occurs within the web, thereby increasing bulk and absorbency of the web.

EXAMPLE 142

A web was produced as in Example 141, except that the creping was carried out using a 15° bevel blade.

Figure 9:
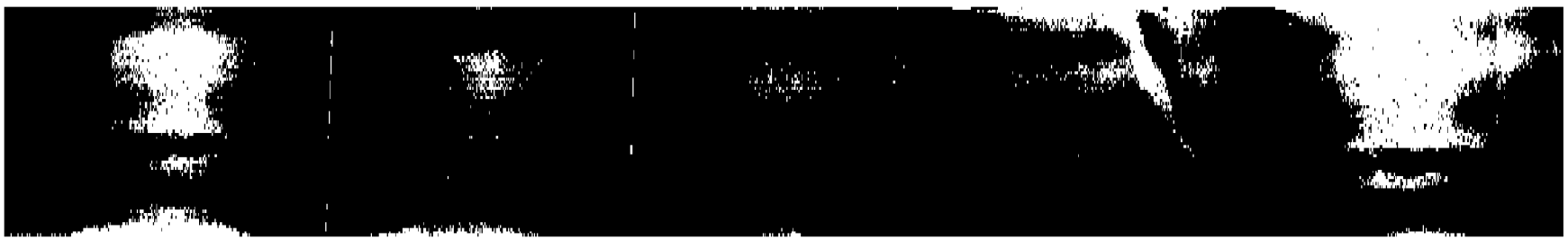
FIG. 9 is a 50× photographic representation of the cross machine direction of a 35 lb web produced according to the present invention and creped with a blade having a 15° bevel angle, illustrating the delamination that occurs within the web.

FIG. 9 is a photographic representation of the cross machine direction of a 35 lb web produced according to the present invention. The web was creped from the Yankee dryer with a 15° beveled blade. As can be seen from the 50× photograph, delamination of the fibers occurs within the web, thereby increasing bulk and absorbency of the web.

EXAMPLE 143

A web was produced as in Example 141, except that the creping was carried out using a 0° bevel blade.

The above examples establish that this process responds much like a normal dry creping process, but the low internal cohesion of the fibers in the web, due to its wetness, amplifies the creping effects.

It was quite surprising that the coating on the Yankee surface never changed throughout the above examples. Similar processes carried out on a cooler Yankee resulted in significant changes in the coating on the Yankee making the coating difficult to establish and to maintain.

In the process according to the present invention, the amount of wear observed on the creping blade was significantly reduced below that which one would expect from a wet crepe process. By way of illustrative example, crepe blades used in wet creping processes would often be worn out in as little as 30 minutes, while the creping blade in the process according to the present invention still showed almost no wear after 2 hours.

Preferred products according to the present invention have the attributes shown in Table 5:

TABLE 5

| Product Attributes | | |
|---|---|---|
| Description | Basis Weight lbs/3000 ft$^2$ | Void Volume, gms/gm |
| Example P Conventional Dry Crepe | 29.0 | 5.25 |
| Example 141 Invention w/10° | 34.2 | 7.84 |
| Example 142 Invention w/15° Blade | 34.1 | 6.79 |
| Example 143 Invention w/0° Blade | 34.5 | 7.99 |
| Uncreped TAD Towel | 25.7 | — |
| Conventional Wet Crepe Towel | 31.5 | 5.32 |

The results are consistent with an increase in air permeability of about 2 to 4 times those of a conventionally dry creped web, shown in FIG. 6, in spite of the fact that the wet creped samples of the invention were 20% heavier than the dry creped samples. The absorbent sheet of the invention typically has an absorbency of 250-350 grams per square meter.

It can be seen from Table 5 that a sheet in accordance with the invention exhibits higher as-creped void volumes than either conventional wet creped or conventional dry creped products. The as-creped web exhibits a characteristic void volume which is used herein to approximate as closely as is practical the actual voidage of the wet sheet as it is creped off of the Yankee dryer and dried without disturbing the as-creped microstructure in accordance with the foregoing procedures. In the foregoing examples, the as-creped sheet was lightly calendered which may have additionally compressed the web slightly. Characteristic void volumes of the web as defined above, that is, measured on a wet creped sheet which is thereafter dried without disturbing the voidage thereof; may thus be slightly higher (up to perhaps 20% or so higher) than as shown in Table 5. In any event, the values reported in Table 5 approximate the characteristic void volumes (as creped) of the various products shown.

COMPARATIVE EXAMPLES Q AND R

The following examples demonstrate that conventionally prepared wet-creped products are not generally suitable for throughdrying at practical drying rates. The advantages of the present invention over throughdry processes is appreciated by considering FIGS. 10A through 11B. Throughdry processes for making absorbent sheet require relatively permeable webs which are not conventionally formed by wet creping at high basis weights or with recycle fiber having a relatively high fines content. In this respect, a series absorbent sheets made from 100% high ash recycle were tested for throughdrying at practical rates by wetting them up to 300% (consistency of 25%) and drying them with hot air in a throughdry apparatus.

Figure 10A:
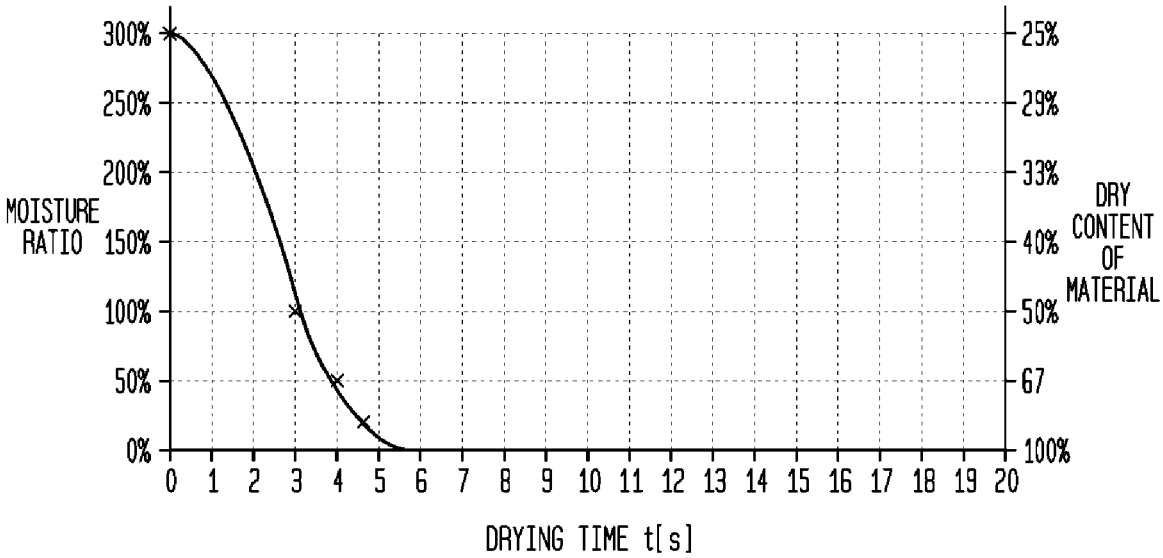
FIGS. 10A and 10B are plots of drying time and permeability characteristics for a conventionally prepared 13 lb basis weight wet-creped towel utilizing high ash recycle furnish.
Figure 10B:
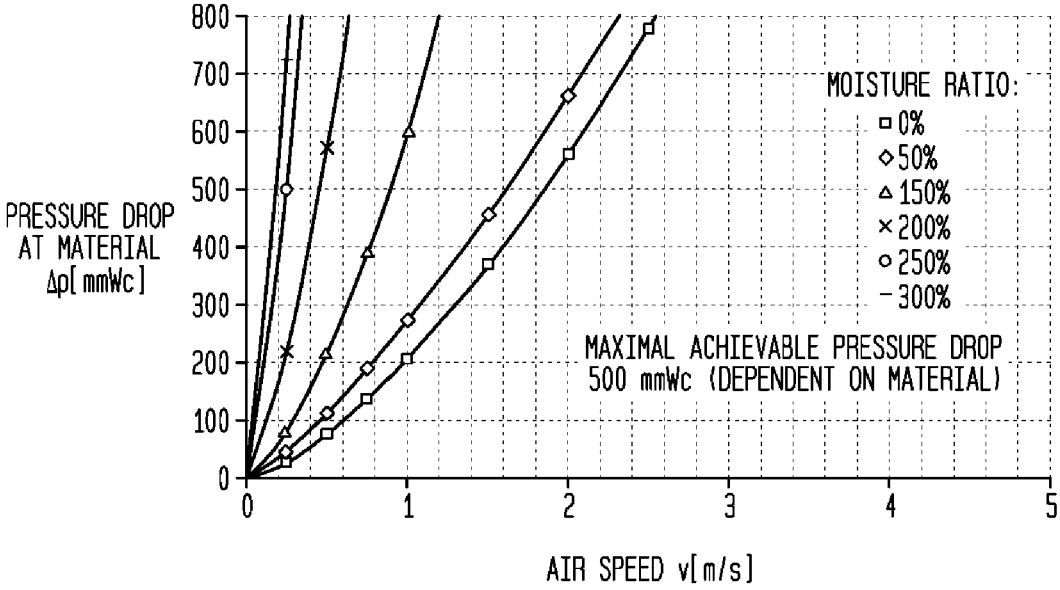

FIG. 10A is a plot of drying time versus moisture content for a wet-creped, 13 lb/3000 ft$^2$ product made with recycle furnish, wherein the drying temperature was 220° C. and the pressure drop was about 480 mm of water through the sheet. FIG. 10B is a plot of air speed through the sheet versus pressure drop at various moisture levels for the sheet used to generate the drying data of FIG. 10A.

Figure 11A:
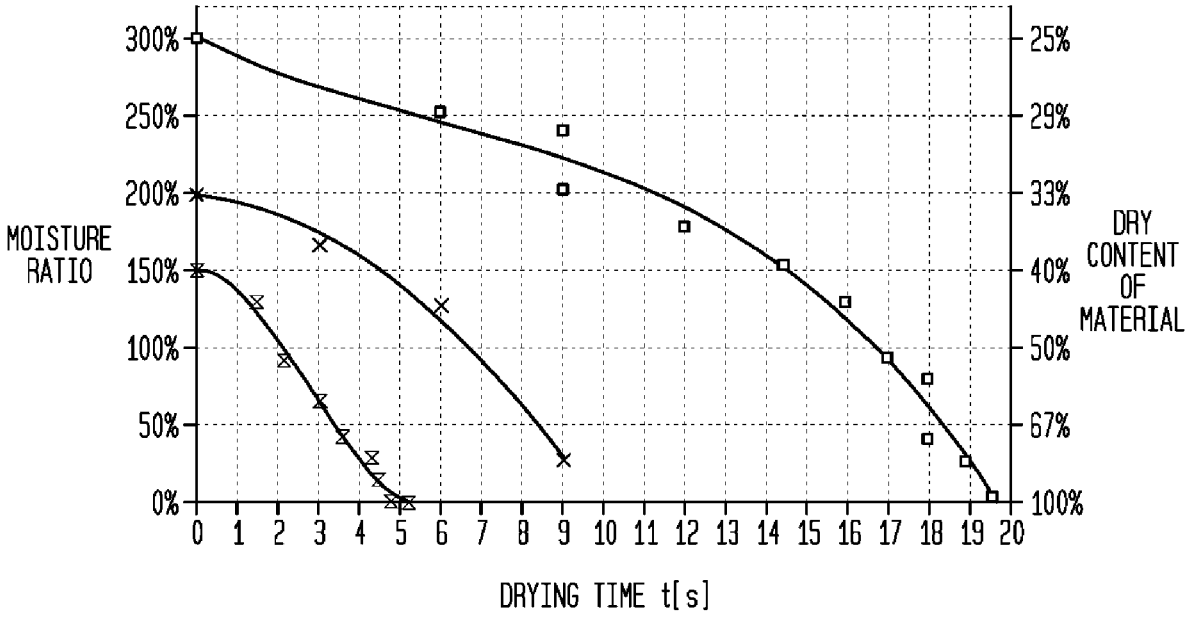
FIGS. 11A and 11B are plots of drying time and permeability characteristics for a 28 lb basis weight, conventionally prepared, wet-creped towel utilizing high ash recycle furnish.

FIG. 11A is a plot of drying time versus moisture content starting at various moisture levels at time=0 for a 28 lb/3000

Figure 11B:
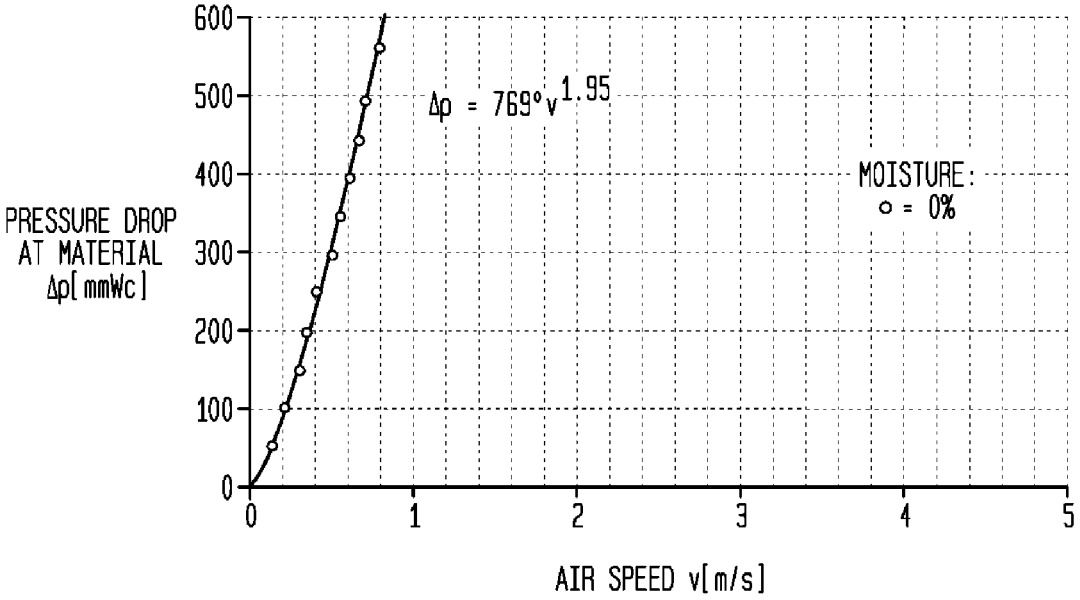

$ft^2$, wet creped product made with recycle furnish wherein the drying temperature was about 220° C. and the pressure drop was about 480 mm of mercury through the sheet. FIG. 11B is a plot of air speed through the sheet utilized to generate the data of FIG. 11B versus pressure drop through the sheet.

The data of FIGS. 10A through 11B may be utilized to calculate a throughdry process drying length shown in Table 6 below, wherein drying is calculated beginning at 25% consistency and continuing to 95% consistency.

TABLE 6

Throughdry Processing Drying Length for Conventional Wet Crepe Products

| Basis Weight (lbs/3000 $ft^2$) | Drying Time (From 25% Cons) | Air Flow Rate (500 mm Δp) | TAD Length (@ Commercial Speed) |
|---|---|---|---|
| 13 | 5.0 sec's | 0.25-2 m/sec | 433 ft (5200 fpm) |
| 28 | 19.5 sec's | 0.75 m/sec | 1170 ft (3000 fpm) |

*Basis: Begin drying at 25% consistency (3 lbs water/lb fiber) and finish drying at 95% consistency.

Clearly, while throughair drying lengths of 50-100 feet could be considered practical in connection with 16-18 foot diameter throughdryers with 270 degrees of wrap, lengths above this would not be. Thus, for a wet creped sheet with low permeability, throughdrying is simply not practical.

The present invention is advantageously practiced in connection with high speed transfer over an open draw and wet shaping the air side of the web after it is creped from the Yankee dryer and before it is throughdried or the invention may be practiced in connection with fabric creping from a Yankee dryer followed by throughdrying as will be discussed below in connection with FIGS. 12A, 12B and 12C. The throughdry fabric is suitably a coarse fabric such that the wet web is supported in some areas and unsupported in others in order to enable the web to flex and response to differential air pressure or other force applied to the web. Such fabrics suitable for purposes of this invention include, without limitation, those papermaking fabrics which exhibit significant open area or three dimensional surface contour or depression sufficient to impart substantial Z-directional structure to the web and are disclosed, for example, in U.S. Pat. No. 5,411,636 to Hermans et al., the disclosure of which is hereby incorporated by reference.

Suitable impression or throughdrying fabrics include single layer, multi-layer, or composite permeable structures. Preferred fabrics have at least one of the following characteristics: (1) on the side of the molding fabric that is in contact with the wet web (the "top" side), the number of machine direction (MD) strands per inch (mesh) is from 10 to 200 and the number of cross direction (CD) strands per inch (count) is also from 10 to 200. The strand diameter is typically smaller than 0.050 inch; (2) on the top side, the distance between the highest point of the MD knuckle and the highest point on the CD knuckle is from about 0.001 to about 0.02 or 0.03 inch. In between these two levels there can be knuckles formed either by MD or CD strands that give the topography a three dimensional hill/valley appearance which is imparted to the sheet during the wet molding step; (3) on the top side, the length of the MD knuckles is equal to or longer than the length of the CD knuckles; and (4) the fabric may be made to show certain geometric patterns that are pleasing to the eye, which is typically repeated between every two to 50 warp yarns. Suitable commercially available coarse fabrics include a number of fabrics made by Asten Johnson Forming Fabrics, Inc., including without limitation Asten 934, 920, 52B, and Velostar V-800.

The consistency of the web when differential pressure is applied must be high enough that the web has some integrity and that a significant number of bonds have formed within the web, yet not so high as to make the web unresponsive to the process. At consistency approaching dryness, for example, it is difficult to draw sufficient vacuum on the web for deflecting it into the fabric because of its porosity and lack of moisture. Preferably the consistency of the web about its surface will be from about 30 to about 80 percent and more preferably from about 40 to about 70 percent and still more preferably from about 45 to about 60 percent for pressure or vacuum forming and similar consistency for fabric creping. While the invention is illustrated below in connection with vacuum molding, the means for deflecting the wet web to create the increase in internal bulk can be pneumatic means, such as positive and/or negative air pressure or mechanical means such as a male engraved roll having protrusions which match up with the depressions in the coarse fabric. Deflection of the web is preferably achieved by differential air pressure, which can be applied by drawing vacuum through the supporting coarse fabric to pull the web into the coarse fabric or by applying the positive pressure into the fabric to push the web into the coarse fabric. A vacuum suction box is a preferred vacuum source because it is common to use in papermaking processes. However, air knives or air presses can also be used to supply positive pressure, where vacuums cannot provide enough pressure differential to create the desired effect. When using a vacuum suction box the width of the vacuum slot can be from approximately 1/16 inch to whatever size is desired as long as sufficient pump capacity exists to establish sufficient vacuum. It is common practice to use vacuum slots from 1/8 inch to 7/8 inch.

The magnitude of the pressure differential and the duration of the exposure of the web to the pressure differential can be optimized depending on the composition of the furnish, the basis weight of the web, the moisture content of the web, the design of the supporting coarse fabric and the speed of the machine. Suitable vacuum levels for rearranging the web can be from about 10 inches of mercury to about 30 inches of mercury, preferably from about 15 to about 25 inches of mercury. Fabric creping can likewise be used to impart caliper, absorbency and softness to the sheet as described in more detail hereinafter.

Figure 12A:
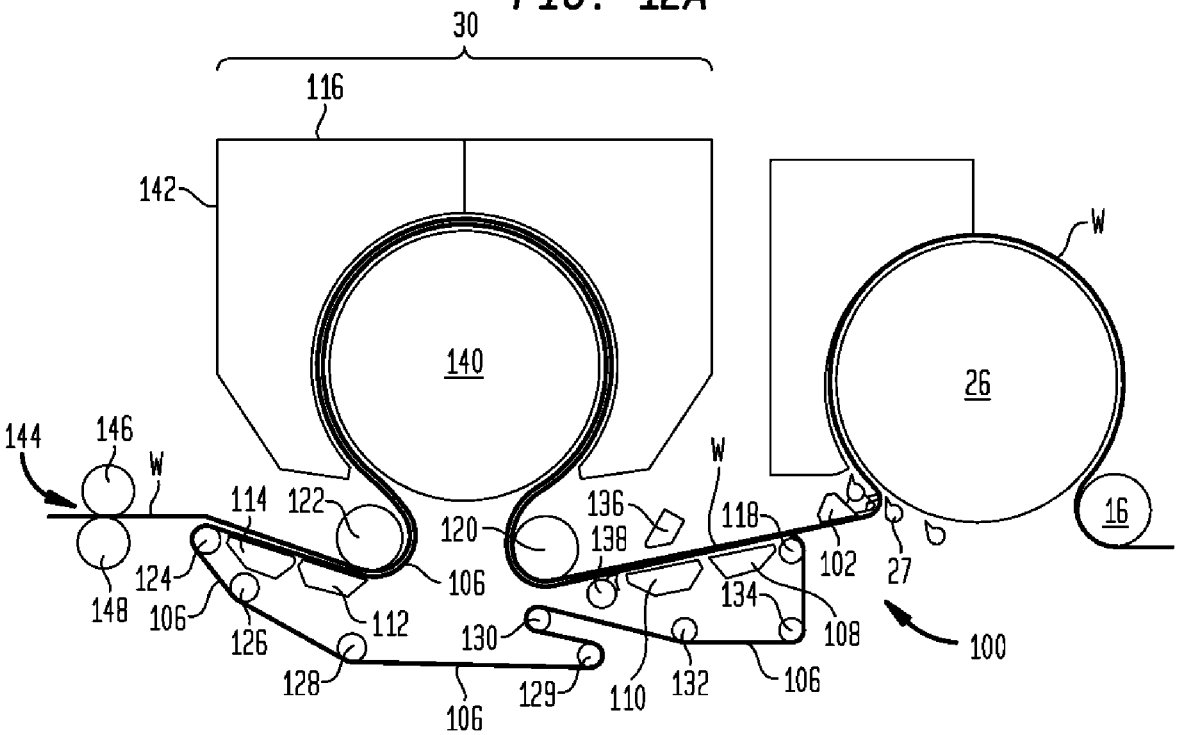
FIG. 12A is a schematic diagram of a portion of a papermachine useful for practicing the present invention.

FIG. 12A is a schematic diagram of a portion of a papermachine including an after drying section 30 referred to in FIG. 4, wherein web W is applied to Yankee drum 26 by way of a press roll 16 and is thereafter creped from the Yankee by blade 27 as the drum rotates. Additional skinning or cleaning doctors may be provided as shown. After creping, web W is transferred over an open draw 100 while being supported by one or more air foils as indicated at 102. The airfoils may be of various configurations as discussed in more detail hereinafter.

After traversing open draw 100, the web is received upon a throughdrying fabric 106. Blow boxes 108, 110, 112 and 114 are provided to help stabilize web W on the fabric since the fabric travels at relatively high velocity; whereas, rolls 118 to 134 support the fabric and web as it travels through section 30 and in particular through throughdrying unit 116. The web is typically creped at a consistency of from about 55 to about 65 percent and is optionally re-wet with an aqueous composition by a rewet shower 136. After re-wetting, the web may be shaped by way of a shaping box indicated at 138 which deflects web W into fabric 106, prior to throughdrying in unit 116.

Throughdryer 116 includes a foraminous throughdrying roll 140 as well as a hood 142. Generally, heated air is passed from hood 142 through web W and into the interior of roll 140 before being exhausted or recycled depending on the operating temperature and auxiliary systems available. Typically, web W is dried to a consistency of greater than 95 percent in unit 116 and is lightly calendered, for example, in a nip 144 defined by rolls 146, 148 before being wound on a take-up reel (not shown) or further processed. Throughdryers are well known in the art and are shown, for example, in U.S. Pat. No. 3,432,936 to Cole et al., the disclosure of which is incorporated herein by reference.

Re-wetting helps in some embodiments to facilitate vacuum molding by shaping box 138 and/or is a convenient means to add chemistry to the system such as strength aids and so forth. An aqueous composition applied to the web at 136 may include softeners, debonders, starch, strength aids (as noted above), retention aids, barrier chemicals, insolubilizers, latexes, binders, absorbency aids, antimicrobials, wax emulsions, botanicals, dyes, pigments, optical brighteners, opacifiers, sizing agents and the like. Such chemicals may include phospholipids, polyamines, PEG esters, PPG esters, polyols, surface modifiers, crosslinkers and so forth. Any combination of functional or process additives may be added to the system by any means.

Instead of a re-wet shower, one might employ a coating apparatus such as a gravure coater, blade coater, an integrated size press, a nozzle coater, curtain coater and so forth in order to apply chemicals including functional resins to the web. Such apparatus may be employed at any convenient location in the system, or at the location of re-wet shower as shown in FIG. 12A. So also, if a positive pressure aerodynamic support foil is used as discussed in connection with FIGS. 23 through 26 below, chemicals may be applied to the web as a mist through slots in the airfoil along with the air used to stabilize the web adjacent the airfoil.

Figure 12B:
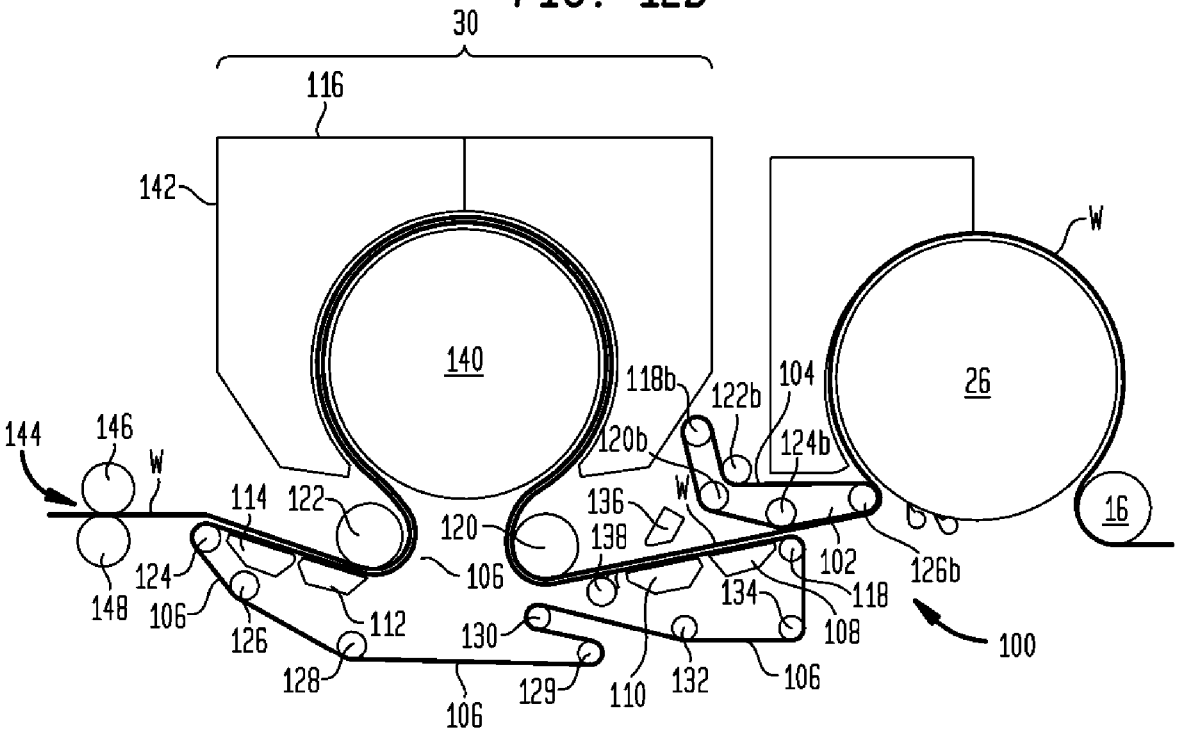
FIG. 12B is a schematic diagram of a portion of another papermachine useful for practicing the present invention.

FIG. 12B is a schematic diagram of a portion of another papermachine including an after drying section 30 referred to in FIG. 4, wherein parts identical to those in FIG. 12A are given identical numbers and have the same function. The difference between the apparatus of FIG. 12A and the apparatus of FIG. 12B is that rather than employing a creping blade as is used in the apparatus of FIG. 12A, the apparatus of FIG. 12B utilizes a fabric creping technique as taught in U.S. Pat. No. 4,689,119 to Weldon, the disclosure of which is incorporated herein by reference.

To this end, there is provided a creping fabric supported on a plurality of rolls 118*b*-124*b* as well as a transfer roll 126*b*, which may optionally be a vacuum transfer roll, to facilitate transfer onto fabric 104. Fabric 104 may be of the same or similar construction as fabric 106, that is, a throughdrying or transfer fabric as is well known. Perhaps more preferably, fabric 104 is of finer weave construction. In the apparatus of FIG. 12B, there is no open draw to contend with and the creping fabric can be selected so as to promote bulk as well as crepe to the product by way of shaping the web. While Yankee drum rotates in a counterclockwise direction as illustrated schematically on FIG. 12B, fabric 104 travels clockwise at a speed typically less than the speed of drum 26. The relative speed, as well as the fabric geometry and design, is selected based on the product attributes desired.

Inundating fabric 104 or 106 with the web in a fabric creping operation takes full advantage of the caliper inherent in the fabric and promotes caliper, absorbency and softness in the product and may be less sensitive to the moisture of the web. Fabric 104 is typically operated to provide a percent crepe (Yankee speed−Speed of Fabric 104)÷ Yankee speed× 100% of from about 5 to about 50 percent, with from about 10 to about 35 percent crepe being typical. About 15 percent crepe is preferred in some cases. Consistency of the web upon fabric creping from the Yankee is generally from about 15 to about 60 percent, with from about 25 percent or more being typical. About 40-60 percent may be preferred in some embodiments.

Web W may likewise be creped from fabric 104 by way of fabric 106 in a transfer region as is known in the art. In such cases, fabric 106 is typically operated at a speed that is lower than the speed of fabric 104 such that the percent crepe may be calculated as (Speed of Fabric 104−Speed of Fabric 106)÷ Speed of Fabric 104×100%. Fabric creping has the advantage of eliminating open draws and it is believed 2 crepings or workings of web W are particularly advantageous.

Creping conditions between fabric 104 and fabric 106 are generally at a consistency of web W of from 15-60 percent with from about 25-60 percent being preferred in many cases. From about 40-60 percent consistency of web W upon creping may be preferred in a large number of embodiments. If necessary or desirable, web W may be re-wet on fabric 104 to provide additional chemistry or achieve the desired consistency for a second fabric creping. The percent crepe applied between fabrics 104 and 106 is generally from about 5 to about 50 percent with from about 10 to about 35 percent crepe being typical. In some embodiments, about 15 percent crepe applied in fabric to fabric transfer may be preferred.

Figure 12C:
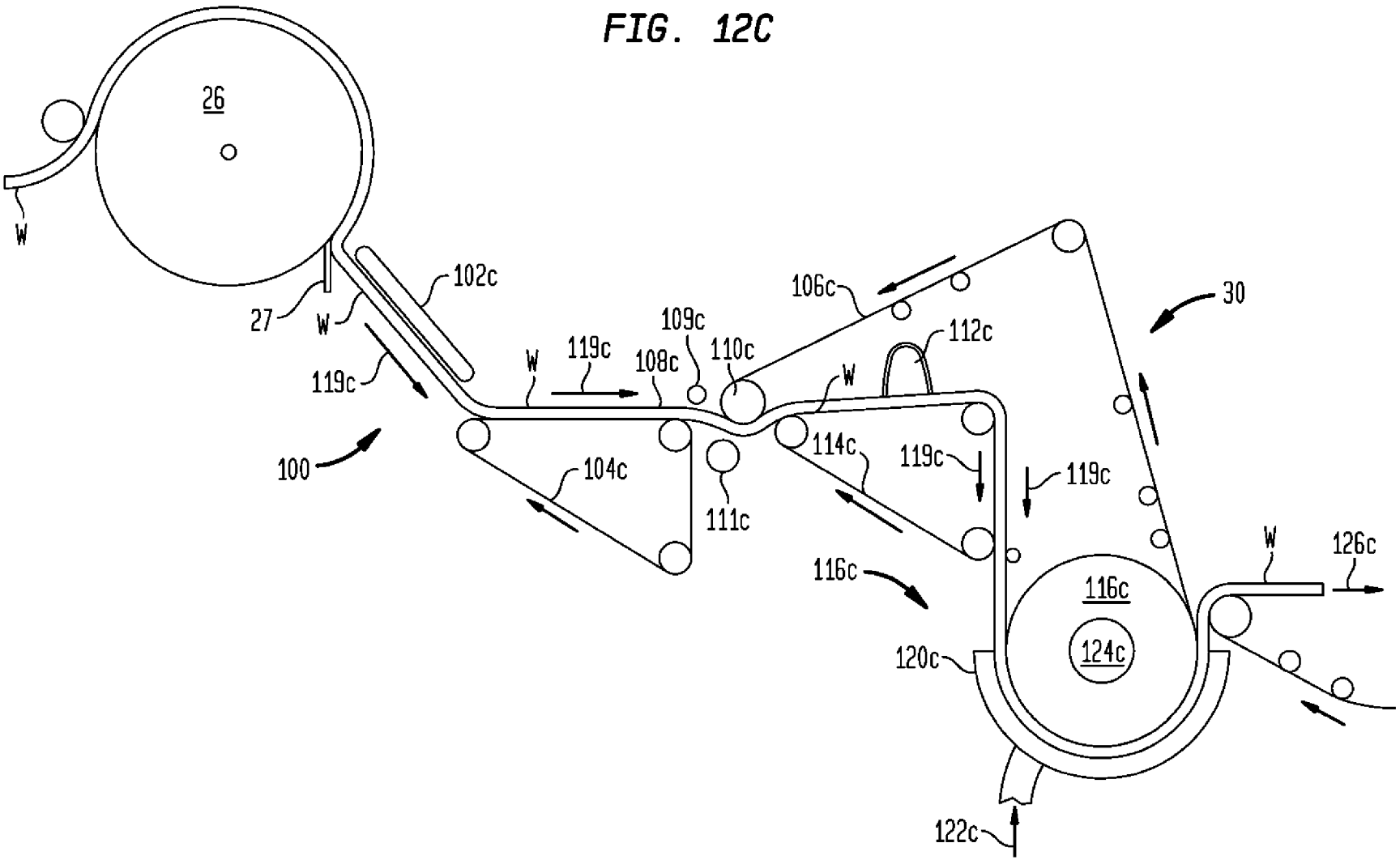
FIG. 12C is a schematic diagram of a portion of still yet another paper machine suitable for practicing the present invention.

FIG. 12C shows a web W being applied to a Yankee dryer 26 as discussed above wherein the web W is partially dried on the Yankee and creped by creping blade 27 at a consistency of from about 30 to about 90 percent. The web W is then transferred over an open draw indicated at 100 while being supported by an air foil 102*c*. Air foil 102*c* may be a passive air foil which may be contoured or uncontoured or the air foil may be a Coanda effect air foil as is shown for example in U.S. Pat. No. 5,891,309 to Page et al. the disclosure of which is hereby incorporated by reference. After transfer over open draw 10*c* the web W is placed upon a transfer fabric 104*c* which conveys the web to a throughdry fabric 106*c* having the characteristics noted above. It is noted at this point that the air side of the web indicated at 108*c* is disposed upwardly with respect to transfer fabric 104*c*. Web W is then transferred to an impression fabric 106*c* having the characteristics noted above optionally by utilizing a suction roll 110*c*. Web W when transferred to molding or throughdrying fabric 106*c* is downwardly disposed with respect to that fabric and such that the air side of web W is vacuum molded by way of a vacuum box 112*c* as indicated on FIG. 12C. Here it is noted that the web is pulled upwardly into the fabric 106*c* by way of vacuum box 112*c* whereupon the web is macroscopically rearranged on fabric 106*c*. There is optionally provided another transfer fabric 114*c* which serves to support the web over the drying loop. After molding web W continues as shown by arrows 116*c* to a throughdrying unit indicated at 118*c*. Fabrics 106*c*, 114*c* may be optionally operated at a speed slower than fabric 104*c* to provide additional crepe to web W as described in connection with FIG. 12B above. In such cases, one might choose to eliminate vacuum molding as unnecessary.

Throughdrying unit 116*c* includes a hood 120*c* provided with means for supplying heated air at 122*c* and exhaust means for removing air at 124*c*. It is noted that throughdryers are well known in the art as is shown, for example, in U.S. Pat. No. 3,432,936 to Cole et al. the disclosure of which is incorporated herein by reference. The web is generally creped from cylinder 26 at a consistency of greater than about 60 percent, typically at a consistency of at least about 65 percent. At this consistency, the web has enough strength to resist damage at the high speed requirements of commercial units; however, it may be desirable to re-wet the web with an aqueous composition slightly in order to facilitate wet-molding or provide additional chemistry to the system. The aqueous composition applied to the web may include chemical additives such as surface modifiers, softeners, debonders, strength aids, latexes, opacifiers, optical brighteners, dyes, pigments, sizing agents, barrier chemicals, retention aids, insolubilizers, organic or inorganic crosslinkers, and combinations thereof, said chemicals optionally comprising polyols, starches, PPG esters, PEG esters, phospholipids, surfactants, polyamines and the like. Aqueous compositions may include functional additives such as softeners or debonders, wet strength resins, dry strength resins and the like. The Web is usually re-wet to a consistency of about 55 percent or less to facilitate wet molding; generally by way of one or more re-wet showers 109*c*, 111*c* indicated on FIG. 12C; however, any suitable technique may be used.

Web W is finally dried in unit 116*c* to greater than 95 percent consistency and the web is transferred over another fabric to a take up reel, for example, as indicated at 126*c*.

Figure 13:
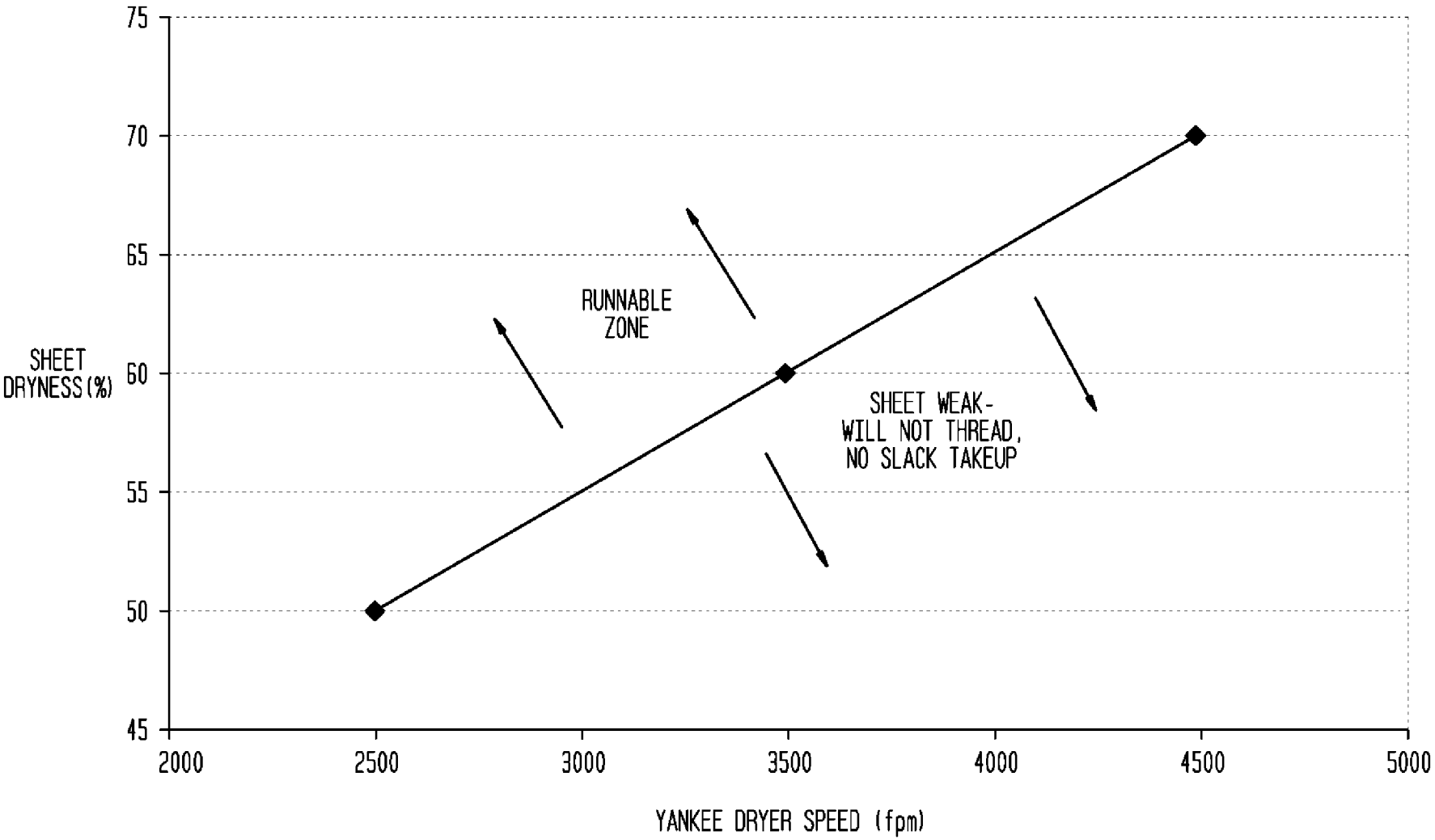
FIG. 13 is a plot illustrating conditions for stable transfer of a wet web off a Yankee dryer.

Transfer of web W over open draw 100 is preferably accomplished with the aid of an aerodynamic support as noted above. This aspect of the invention is better appreciated by way of reference to FIG. 13 which is a plot of consistency, or sheet dryness vs. Yankee dryer speed. One method is described in the '309 patent noted above, while additional methods of stabilizing a wet web above can be appreciated from the following.

Figure 14:
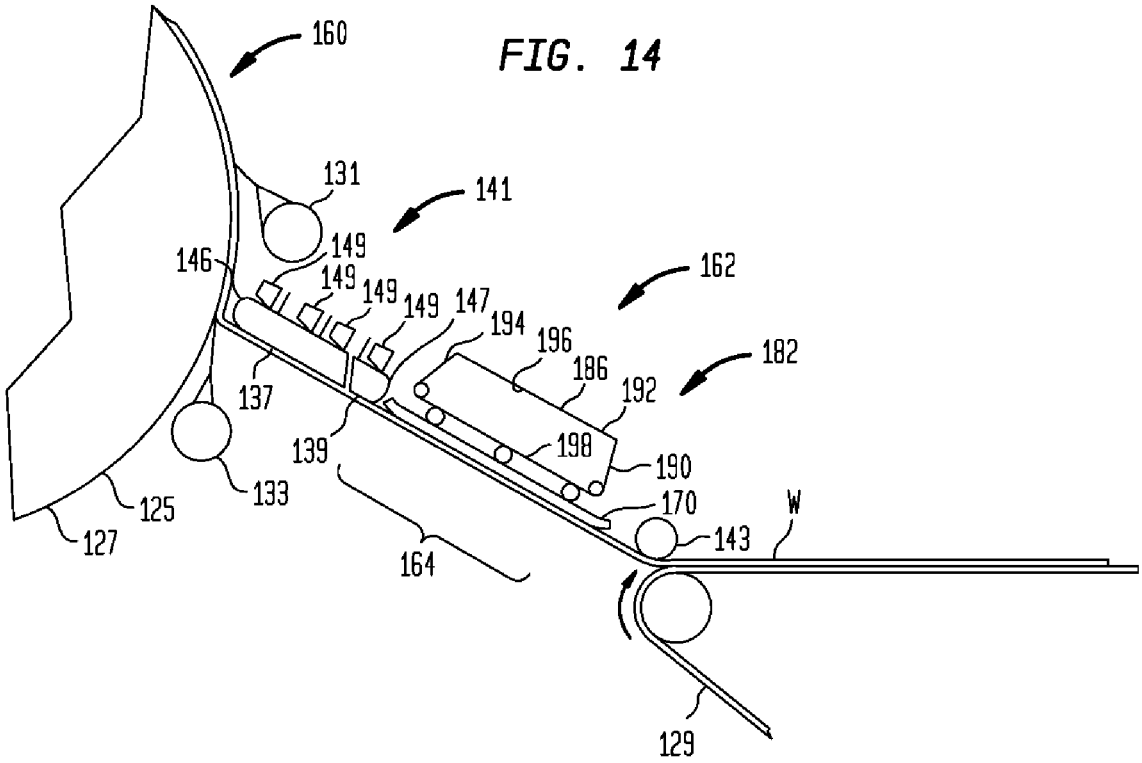
FIGS. 14 and 15 are schematic diagrams showing airfoils for stabilizing transfer of a wet web off of a Yankee dryer over an open draw.
Figure 15:
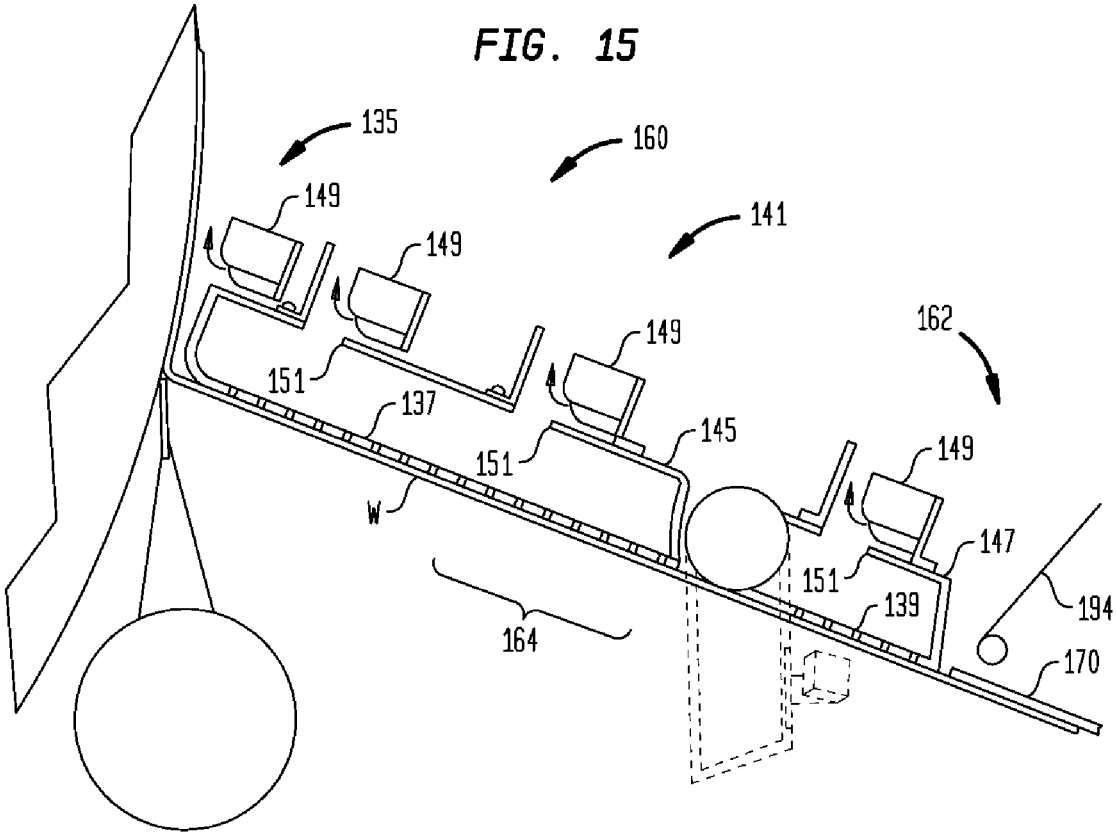

Referring to FIGS. 14 and 15, there is shown a dryer section of a papermachine 160 having components between which a moving paper web W is transferred as the web W is moved through the papermachine 160 and wherein the papermachine 160 utilizes an embodiment, generally indicated 162, of an apparatus for supporting the paper web W as the web W is transferred between the components. In addition, in FIGS. 14 and 15 papermachine 160 includes a region of unsupported movement (open draw), indicated 164, through which the paper web W is moved as the web W is transferred between the surface 127 of the drying cylinder 125 and the upper surface of the carrier fabric 129. The support apparatus 162 is supportedly positioned within this region 164 and, as will be apparent herein, acts upon the paper web W in a manner which provides support and stability to the web W as web W moves through region 164. For purposes of smoothing web W, and thereby preventing the formation of longitudinal folds therein, a Mount Hope roll 143 is rotatably mounted above web W adjacent the leading edge of the carrier medium 129.

With reference still to FIGS. 14 and 15, the support apparatus 162 includes an air-permeable sheet 170 which is suitably supported in a stationary condition across the papermachine region 164 so as to span a substantial portion (e.g., at least one-half) of the entire length of region 164. Furthermore, the sheet 170 is sized to extend across the width of web W as web W is measured between its opposite side edges and is positioned adjacent one side of the moving web W. During operation of the support apparatus 162, the web W is urged upwardly toward and into engagement with the sheet 170 as a result of a pressure differential created on opposite sides of the moving web W and wherein the higher pressure is on the side of the web W opposite the sheet 170 (.e., the lower side of the sheet 170). Accordingly, the sheet 170 is positioned adjacent the side of the moving web W toward which the web W is desired to be urged, i.e., on the low-pressure side of web W.

Figure 16:
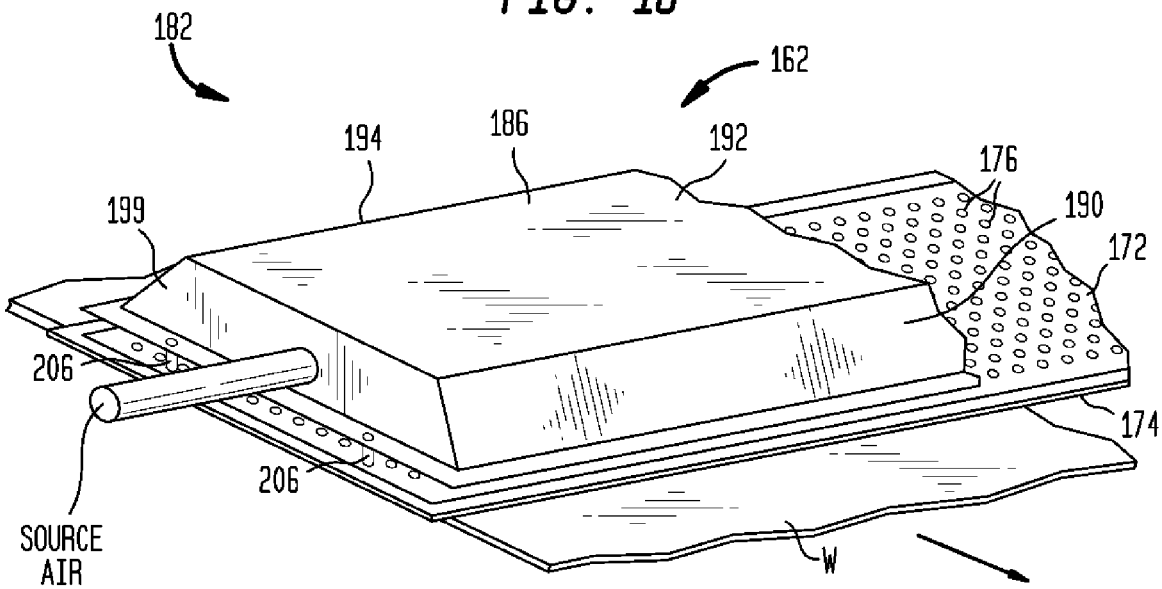
FIGS. 16 and 17 are details of the airfoils of FIGS. 14 and 15.

In the depicted apparatus 162, the sheet 170 is plate-like in form and has side edges which are arranged in a plane. Furthermore, the sheet 170 is comprised of a rigid sheet steel, although other materials, such as an air-permeable fabric, can be used, and its opposite side faces, indicated 172 and 174 in FIG. 16 are relatively smooth. In addition, the depicted sheet 170 is perforated in that it defines a plurality of through-openings 176 (formed by bores) extending between the side faces 172 and 174. In the depicted sheet 170, each through-opening 176 is 0.25 inches in diameter and the centers of the through-openings 176 (which are arranged in staggered rows along the length of the sheet 170) are 0.5 inches apart. Thus, the through-openings 176 are relatively small in size and are regularly dispersed throughout the side faces 172 and 174. Through-openings of alternative sizes and spacings are, of course, possible.

As used herein, the term "air-permeable" is intended to describe any of a number of materials which are adapted to suitably permit the flow of air therethrough. For example and as mentioned above, the air-permeable sheet 170 could be constructed of a flexible air-permeable fabric material or a plate comprised, for example, of a synthetic resin. Accordingly, the air-permeable material need not itself be rigid, although a flexible material would necessarily have to be supported in a relatively rigid condition (e.g., by way of a rigid frame attached, for example, along the edges of the material) to resist forces expected to be applied to a side face of the sheet during operation of the support apparatus 162. Furthermore, the side face of the air-permeable sheet along which web W is expected to slidably move is preferably smooth to avoid damage to the web W by the sheet.

Figure 17:
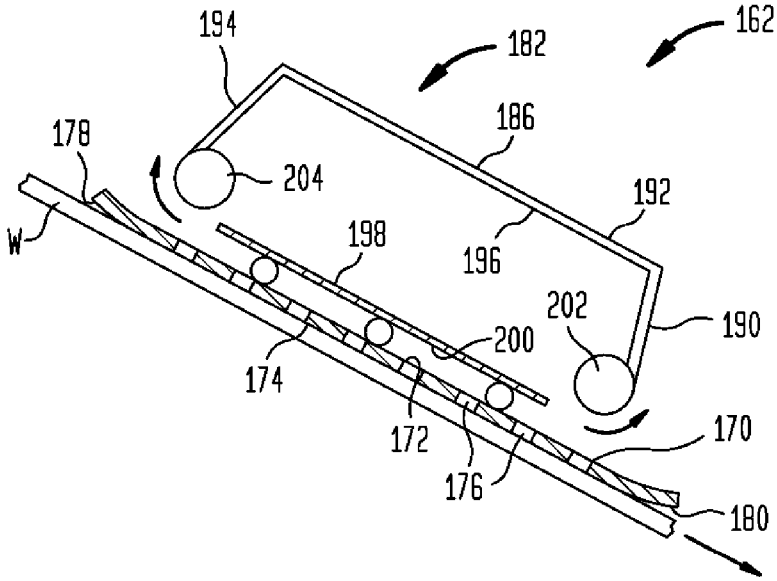

As mentioned earlier, the air-permeable sheet 170 is positioned across so as to substantially span the length of the papermachine region 164. In this connection, the sheet 170 has a leading edge 178 across which the moving web W first comes into contact with the sheet and a trailing edge 180 across which the moving web W moves out of contact with sheet 170, and each of the leading and trailing edges 178, 180 is positioned in relatively close proximity (e.g., within about 1.0 feet) to the closest papermachine component disposed upstream or downstream of the corresponding edge 178 or 180. If desired, the leading edge 178 or the trailing edge 180 may be upturned (i.e., provided with an arcuate shape) as shown in FIGS. 14 and 17 to reduce any likelihood that web W would catch or tear as it moves across the leading or trailing edge.

With reference to FIGS. 14 through 20, the support apparatus 162 also includes means, generally indicated 182, for directing air from a source away from the side of the air-permeable sheet 170 opposite paper web W so that as the paper web is moved through the papermachine region 164, the paper web is biased into contact with and slidably moves along the length of the sheet 170. In the depicted apparatus 162, the air-directing means 182 includes a blowbox 186 situated adjacent (i.e., above) the side face 172 of the sheet 170 for creating a zone of low pressure (i.e., sub-atmospheric pressure) adjacent the side face 172 of the air-permeable sheet 170 so that paper web W is drawn against the lower surface of the sheet 170 by way of the through-openings provided in the sheet 170.

To this end, the blowbox section 186 includes a series of walls 190, 192, 194 which are jointed together to provide a box-like interior 196 for the blowbox 186 and also includes a partition 198 which is positioned between so as to separate the blowbox interior 196 from the sheet 170. Each of the walls and partition 198 of the blowbox section 186 are constructed, for example, of appropriately-shaped sheet metal, and the interior 196 is sized to span substantially the entire width of the sheet 170. In addition, the opposite ends of the interior are capped with end walls 199 (only one shown in FIG. 16) having lower edges which terminate in close proximity to the sheet 170. The blowbox partition 198 is arranged substantially parallel to the side face 172 of the sheet 170 so that a narrow air space 200 is provided between the partition 198 and the side face 172 of the sheet 170. Nozzles 202 and 204 are disposed at the opposite (longitudinal) ends of the blowbox interior 196 for extending across the machine 160 and for receiving pressurized air from an air supply (e.g., a high-pressure industrial fan) and for discharging the air through elongated slots formed along the length of the nozzles 202 and 204.

With reference still to FIG. 16, the sheet 170 is suspended from the walls of the blowbox 186 by way of suitable strut members 206 so that the support apparatus can be supported as a single unitary unit from a frame (not shown) situated above the papermachine region 164. If desired, the blowbox 186 can be supported by the frame for movement into and out of the papermachine region 164 to facilitate the servicing of various ones of the papermachine components, such as the creping doctor 133. In addition, the provision of the strut members 206 which extend between the blowbox 186 and the sheet 170 maintain a constant spacing between the blowbox partition 198 and the sheet 170. In practice, a spacing of 11/16 inches (0.67875 inches) has been found to be a suitable distance between the partition 198 and the sheet 170.

The operating principles of blowboxes are described in U.S. Pat. No. 4,551,203 (the disclosure of which is incorporated herein by reference) so that a detailed description of such principles are not believed to be necessary. Suffice it to say that as streams of air are discharged from nozzles 202 and 204 in directions generally away from the side face 172 of the air-permeable sheet 170, a vacuum zone (i.e., a region of sub-atmospheric pressure) is created within the narrow air space 200. The resulting difference in air pressure which exists between the air space 200 (disposed adjacent the sheet side face 172) and the air space disposed adjacent the opposite, or lower, side face 174 draws the air from the lower side face 174 of the sheet 170 through the through-openings 176 to the air space 200 so that a pressure differential is created on opposite sides of the web and so that the greater pressure (i.e., atmospheric pressure) exists on the side of web W opposite the sheet 170. Consequently, the air pressure which exists on the high-pressure side of the web (i.e., the lower surface as depicted in FIG. 17 urges web W toward and thereby biases the web into contact with the lower side face 174 of the sheet 170. Web W may be required to be tensioned across the papermachine region 164 so that the web is positioned close enough to the sheet 170 so that the web is lifted into contact with the sheet 170 by the air pressure which exists on the lower side of web W. In any event, it has been found that as long as the pressure differential created on the opposite sides of the web by the blowbox 186 is strong enough to hold the web into contact with the sheet 170, the movement of the web along the stationary sheet 170 does not cause the web to fall from the sheet 170.

While the blowbox section 186 has been described above as having end walls 199 which terminate in close proximity to the sheet 170, an alternative blowbox section can possess end walls which are equipped with edge nozzles which extend along the length thereof for discharging air from a source and thereby aid in the lowering of the air pressure between the partition 198 and the sheet 170 to sub-atmospheric conditions. In such a blowbox embodiment, therefore, the region of sub-atmospheric conditions between the partition 198 and the sheet 170 are bordered by the edge nozzles and the cross-machine nozzles 202 and 204.

The aforedescribed biasing of web W into contact with the side face 174 of the sheet 170 confines the movement of the web along the substantially linear contour of the depicted sheet and thereby enables the sheet 170 to provide a support backing for the web as the web is moved through the papermachine region 164. With the moving web drawn into contact with the side face 174 in this manner, the web is not in a suspended condition between the cylinder 125 and carrier medium 129 and the web is less likely to pull itself apart under the influence of its own weight or experience undesirable movements, such as flutter, as the web is moved through the region 164. Furthermore, with the movement of the web substantially confined along the linear contour of the sheet 170 by the blowbox section 186, the web is less likely to break or otherwise experience damage as a consequence of the web shifting out of its desired path of movement. Consequently, the biasing of the moving web W into contact with the side face 174 of the sheet 170 for sliding movement therealong provides support and stability to the web that web W would not otherwise possess if a relatively large open draw existed in the papermachine region 164 between the drying cylinder 125 and the carrier fabric 129.

With reference to FIGS. 14 and 15, there is disposed within the region of movement 164 another support apparatus 141 disposed upstream of the support apparatus 162 for acting upon the paper web in a manner which provides support and stability to the web as it moves along the apparatus 141. The support apparatus 141 includes a pair of box-like compartments 145, 147 having bottom panels in the form of an air-permeable sheet, or foil, 137 or 139, which are supported so as to span the width of the paper web and means, generally indicated 135, for moving, or drawing, air from the side of the sheet 137 or 139 opposite web W so that as the paper web is moved along the portion of the region 164 spanned by the support apparatus 141, the web is biased (upwardly) into contact with and slidably moves along the length of the sheets 137 and 139. As best shown in FIG. 14, the upstream edge of the sheet 137 is disposed in close proximity to the surface of the dryer 125, while the upstream edge of the sheet 139 is disposed in close proximity to the downstream edge of the sheet 137. Each sheet 137 or 139 is provided with a plurality of through-openings which permit the passage of air between the opposite sides of the sheet 137 or 139, and the air-directing means 135 includes a plurality of Coanda air knives 149 mounted atop the compartments 145, 147 and disposed adjacent upwardly-directed openings 151 provided in the top panel of the compartments 145, 147 so that the air knives 149 span the entire width of the compartments 145, 147.

The Coanda air knives 149 are adapted to receive compressed air (e.g., in the range of between 30 and 60 psig) from a compressor and discharge the pressurized air from outlets provided in the knives 149 so that the air which is directed out of the knives 149 exit the knife outlets at about a right angle to the air-permeable sheets 137 and 139. In accordance with the known principles of the Coanda effect, the air which is forced to exit the knives 149 entrains, and thereby draws, air from the interiors of the compartments 145 and 147 by way of the openings 151 and thereby creates a region of sub-atmospheric pressure within the interiors of the compartments 145 and 147. The creation of the sub-atmospheric pressure within the compartments 145 and 147 renders the atmospheric pressure on the underside of the web higher than that on the upper side of the sheets 137 and 139 so that the web is biased by the greater air pressure upwardly into contact with the underside of the sheets 137 and 139 for sliding movement therealong. This biasing of the web into contact with the underside of the sheets 137 and 139 as the web moves therealong enables the sheets 137 and 139 to provide a support backing for the web.

In addition, the compartment 145 is hingedly secured to appropriate support means adjacent the trailing edge of the sheet 137 so that the compartment 145 can be pivoted between a position illustrated in solid lines in FIG. 15 and a position illustrated in phantom in FIG. 15. Therefore, the compartment 147 acts as a trap door (or a skinning broke bombay door) providing an opening through which the web could be routed from the skinning doctor 131 to facilitate the servicing of various parts (e.g., the creping doctor 133) of the papermachine components.

Figure 18:
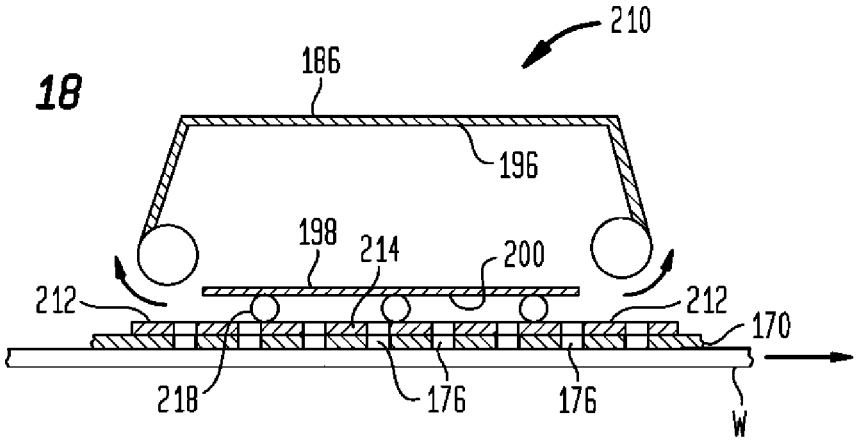
FIGS. 18-21 illustrate further modifications of the airfoils of FIGS. 14-17.
Figure 19:
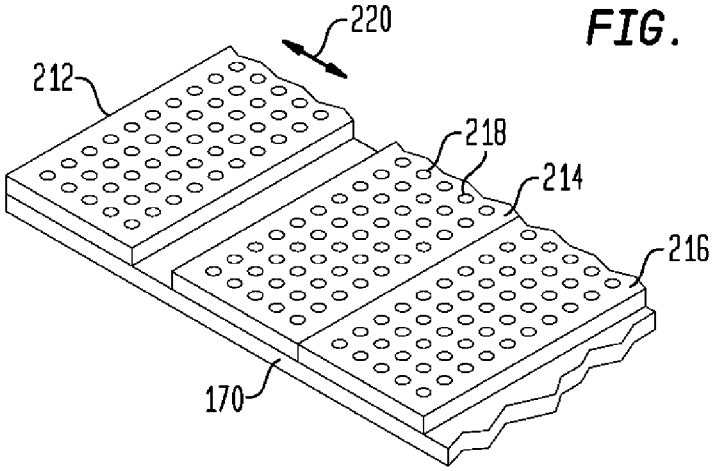

With reference to FIG. 18, there is shown a support apparatus 210 including the components of the support apparatus 162 of FIG. 14 with the addition of a series of three perforated control plates 212, 214 and 216 which are positioned upon the upper surface (i.e. upper side face 172) of the air-permeable sheet 170 and are releasably secured to the sheet 170 along the side edges thereof. (The components of the FIG. 18 support apparatus 210 which are identical to those of the FIG. 14 support apparatus 162 accordingly bear the same reference numerals.) As best shown in FIG. 19, the control plates 212, 214 and 216 define through-openings 218 which are positionable in registry with the through-openings 176 of the underlying sheet 170 yet are capable of being shifted forwardly or rearwardly (relative to the direction of web movement) along the length of the underlying sheet 170 so that the through-openings 218 are movable into or out of registry with the underlying openings 176. By moving the plates 212, 214 and 216 forwardly or rearwardly along the sheet 170 (in one of the directions indicated by the arrow 220) between a position (as illustrated in FIG. 18) at which the through-openings 218 and 176 are positioned in registry with one another so that the underlying through-openings 176 are unobstructed (and thereby fully open) and an alternative position at which the through-openings 176 are either partially or fully obstructed (i.e. closed) by the plates 212, 214 and 216, the exposure of the web W to the sub-atmospheric condition of the space 200 can be controlled, thereby permitting control to be had over the biasing strength exerted upon the web W.

Moreover, by selectively moving the plates 212, 214 and 216 independently of one another to alternative positions along the sheet 170 permits the biasing strength exerted upon the web W to be controlled in selected areas of the length of the sheet 170. Such control, for example, can be utilized to control the biasing strength exerted upon the web W along only the side edges of the web W. The capacity to control the biasing strength exerted upon the web W with the plates 212, 214 and 216 can be particularly useful to adapt the support apparatus 162 to support paper webs of different weight or water content.

Figure 20:
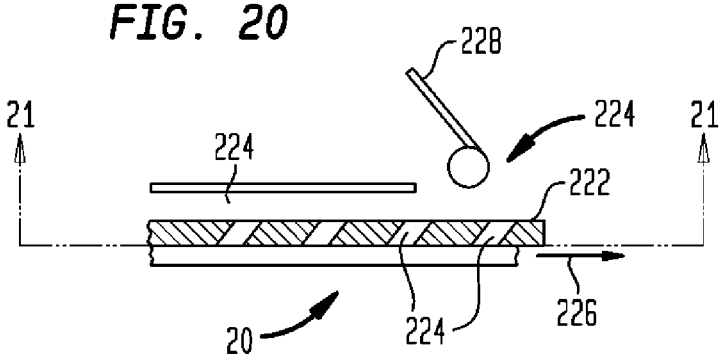
Figure 21:
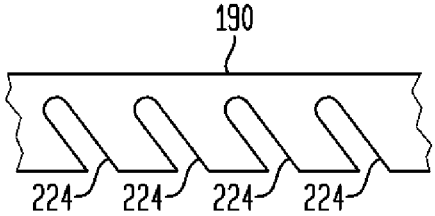

It will be understood that numerous modifications and substitutions can be had to the aforedescribed embodiments without departing from the spirit of the invention. For example, although the air-permeable sheets 170, 137 and 139 of the support apparatus embodiments of FIGS. 14-19 have been shown and described as including through-openings which are formed with bores having longitudinal axes which are normal to the surface of the corresponding sheet, an alternative air-permeable sheet can possess alternatively-formed air passageways. For example, there is shown in FIGS. 20 and 21 an air-permeable sheet 222 having through-openings 224 which are provided by slot-like openings whose walls are arranged at an oblique angle with respect to the direction of travel of the web W therealong, wherein the direction of web travel is indicted by the arrow 226. Furthermore and as best shown in 21, the transversely-extending edges of the through-openings 224 are canted forwardly of the sheet 222 relative to the nearest side edge of the sheet 222. With the walls and edges of the through-openings 224 arranged in this manner, the biasing effect of the air pressure differential induced on opposite sides of the web W by suitable air-directing means, such as the blowbox 228 of FIG. 20, effects a desirable cross-stretching of the web W with force vectors having components directed both rearwardly of the sheet 222 and outwardly toward the nearest side edges of the web W.

Figure 22:
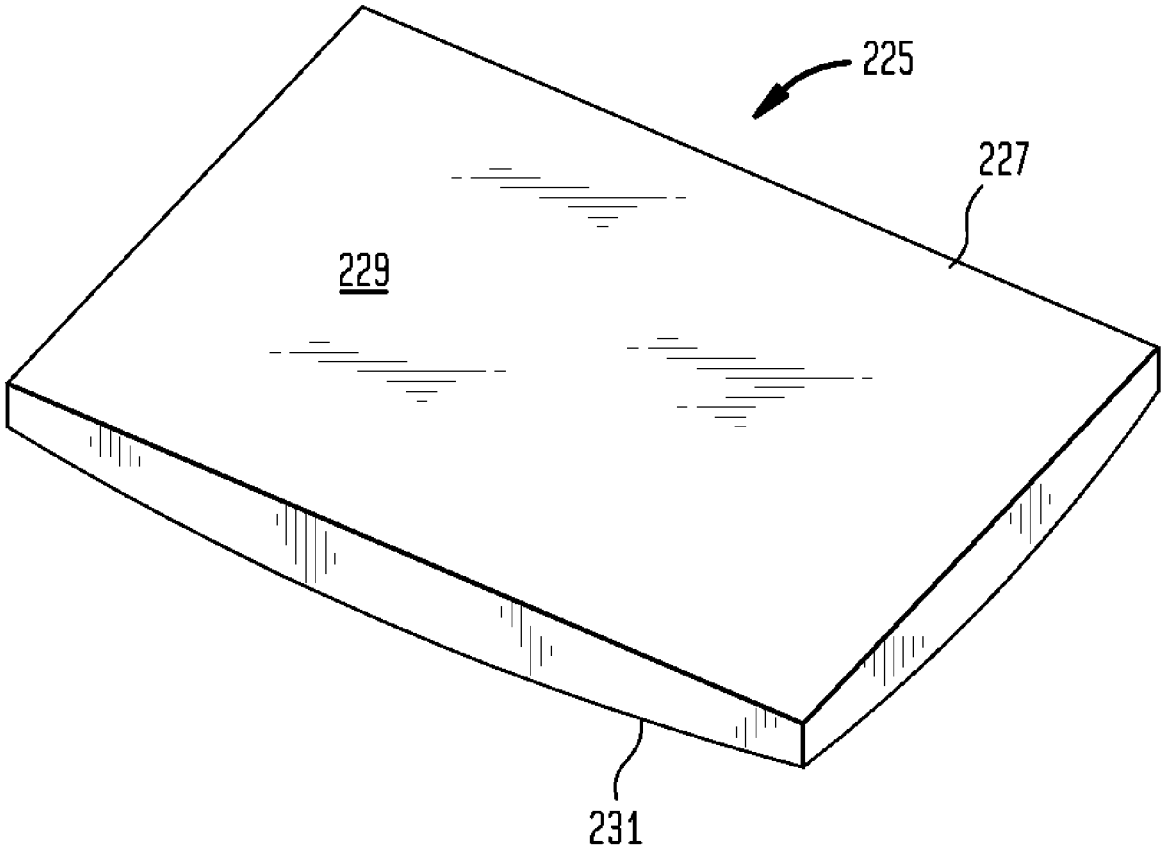
FIG. 22 illustrates schematically yet another airfoil for stabilizing transfer of a wet web off of a Yankee dryer.

In still yet other embodiments, the air foil may be a simple planar passive air foil, or may be a contoured air foil having, for example, a complex curvature along its length as well as along its breadth. One design is convex along its length facing web W (1-2" of convexity over some 4½' in length), i.e., in the machine direction with a similar convexity across its breadth in the cross machine direction. This design is illustrated in FIG. 22 schematically which is a perspective view of a complex curvature air foil which may be utilized in accordance with the embodiment of FIG. 12A, if so desired. Foil 225 (corresponding to foil 102 of FIG. 12) is formed of a generally planar member 227 having an upper surface 229 disposed away from web W and a lower complex curvature surface 231 which is to be disposed adjacent web W, for example, as a substitute for a simple air foil 102. Surface 231 is biaxially convex, being 1-2 inches convex about its center with respect to the edges thereof in all directions.

A preferred method for providing support to a paper web over an open draw in a papermachine employs one or more air foils with a multiplicity of overlapping plates defining air injection gaps therebetween. Referring to FIGS. 23 through 26, there is illustrated schematically such an apparatus and its various parts including means for supplying relatively low pressure injection air to the air injection gaps as described in detail below.

Figure 23:
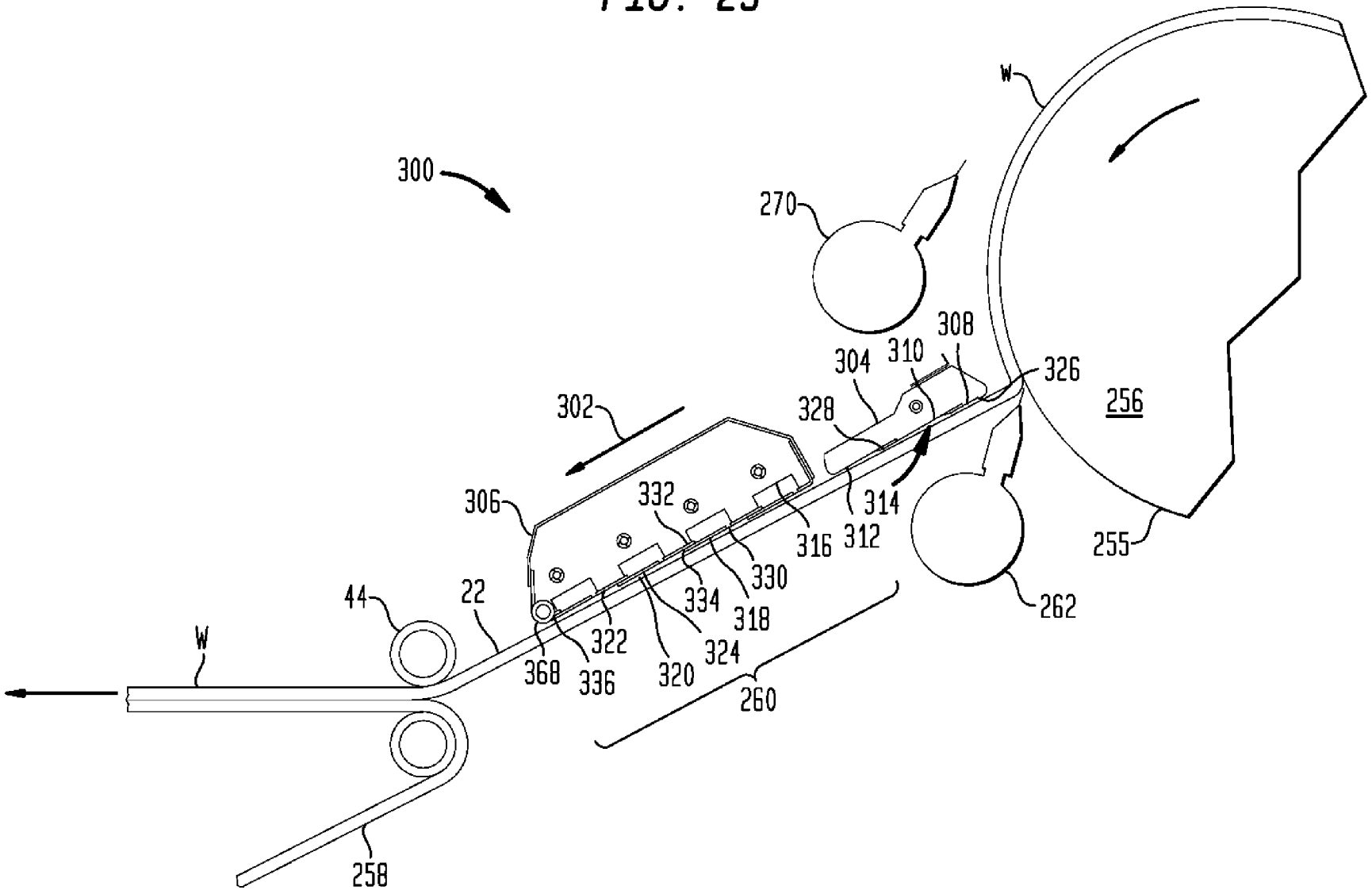
FIG. 23 is a schematic diagram of a papermachine which has been equipped with still yet another embodiment of a preferred support apparatus useful in connection with the products and processes of the present invention.

With reference to FIG. 23, which is a schematic side view of a fragment of a dryer section of a papermachine, there is shown a region 300 of a papermaking machine through which a paper web W is transferred form the surface 255 of Yankee dryer 256 to a carrier fabric 258 over an open draw 260 in the direction indicated by arrow 302. As noted in connection with FIG. 14, web W is not supported over the open draw and may be subject to damage at high production speeds due to flutter and so forth.

Creping doctor 262 crepes web W from the drying surface 255 during typical operation whereas skinning doctor 270 may be employed for this purpose sporadically during maintenance on the papermachine.

There is provided a first airfoil 304 and a second airfoil 306 in order to stabilize the transfer of web W from surface 255 to fabric 258. Airfoil 304 has 3 step portions 308, 310 and 312 defining its lower surface 314 which is a substantially continuous surface while second airfoil 306 has 5 step portions 316, 318, 320, 322 and 323 defining its lower surface 324 which is likewise a substantially continuous and generally planar surface. Stepped surfaces 314, 324 provide support to web W during transfer over open draw 260. Without being bound by any theory, it is believed that moving web W entrains air from between the web and the airfoils, thereby creating relatively low pressure or vacuum between the web and foil which operates to support the web. It has been found in accordance with the present invention that it is advantageous to inject air at relatively low pressure between web W and a support surface, such as surface 314 or 324 in order to stabilize the web. In this respect, there is injected into gaps between step portions of the support surfaces 314, 324, injection air at a gauge pressure of from 0.1 to about 40 inches of water to stabilize the system. This is in contrast to prior art methods where high pressure air is injected at velocities greater than the web to create a vacuum by way of the Coanda effect.

In the embodiment of FIGS. 23-26, airfoil 304 has a first gap 326 defined between step portions 308 and 310 and a second gap 328 defined between step portions 310 and 312. Airfoil 306 is provided with a first gap 330 between step portions 316 and 318, a second gap 332 between step portions 318, 320 as well as a third gap 334 between step portion 320 and 322 and a fourth gap 336 between step portions 322 and 323.

Figure 24:
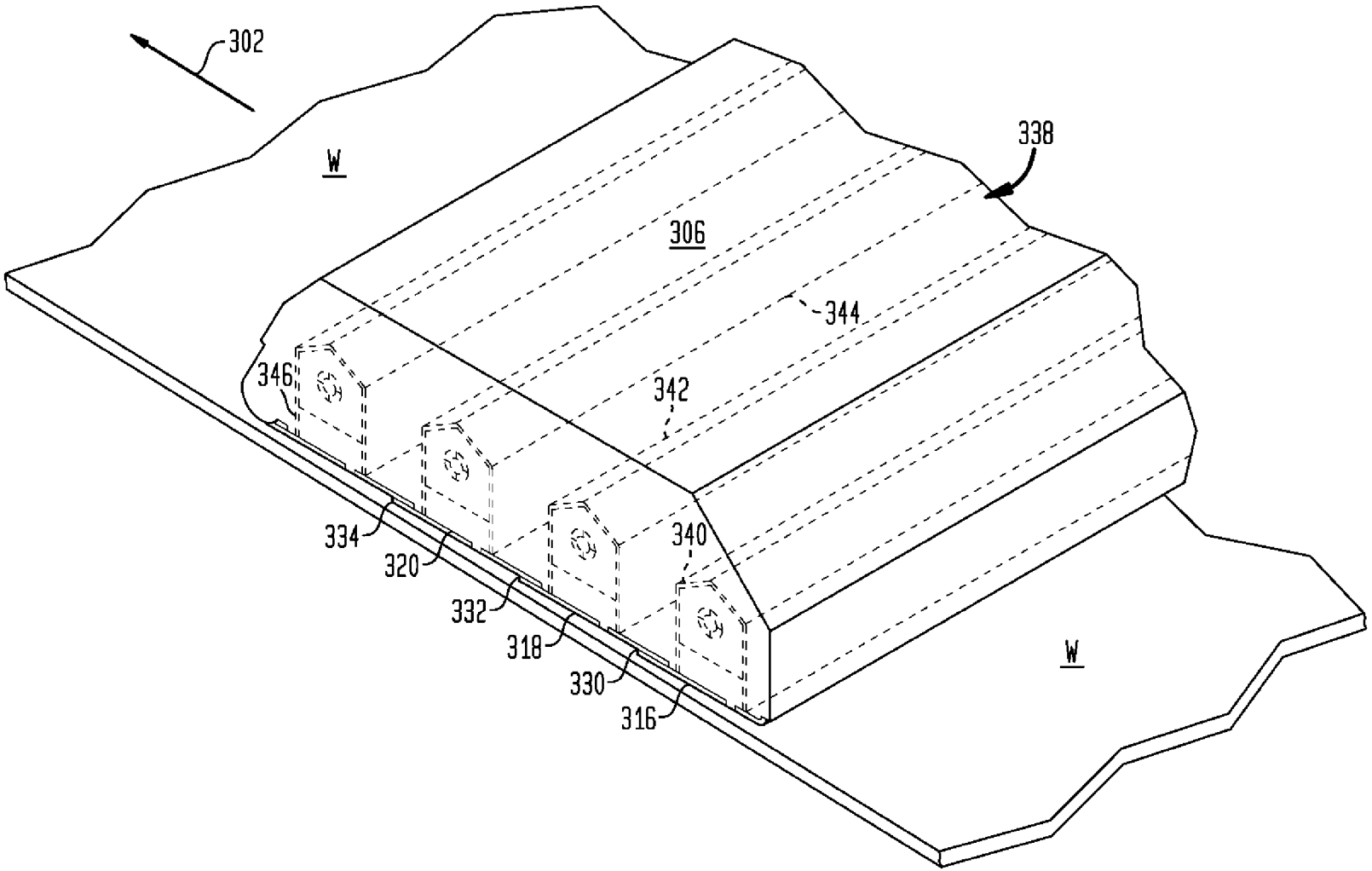
FIG. 24 is a partial perspective view of a portion of the support apparatus of FIG. 23.

FIG. 24 is a schematic view in perspective showing airfoil 306 of FIG. 23 oriented atop web W as the web travels along direction 302. Web W travels along lower surface 324 which includes the various step portions 316-323 as shown. The step portions are supported by a housing 338 and may be integrally formed therewith, for example, if the foil is cast or may be fabricated in any suitable manner as is appreciated by one of skill in the art. The housing also includes a plurality of air manifolds indicated schematically at 340-346. Each manifold is independent of the other, that is, not interconnected so that the pressure supplied to each gap 330, 332, 334 and 336 is independently adjustable. This arrangement provides for enhanced control of the air supply to each opening. Thus, manifold 340 supplies air to gap 330, manifold 342 supplies air to gap 332 and so forth.

Figure 25:
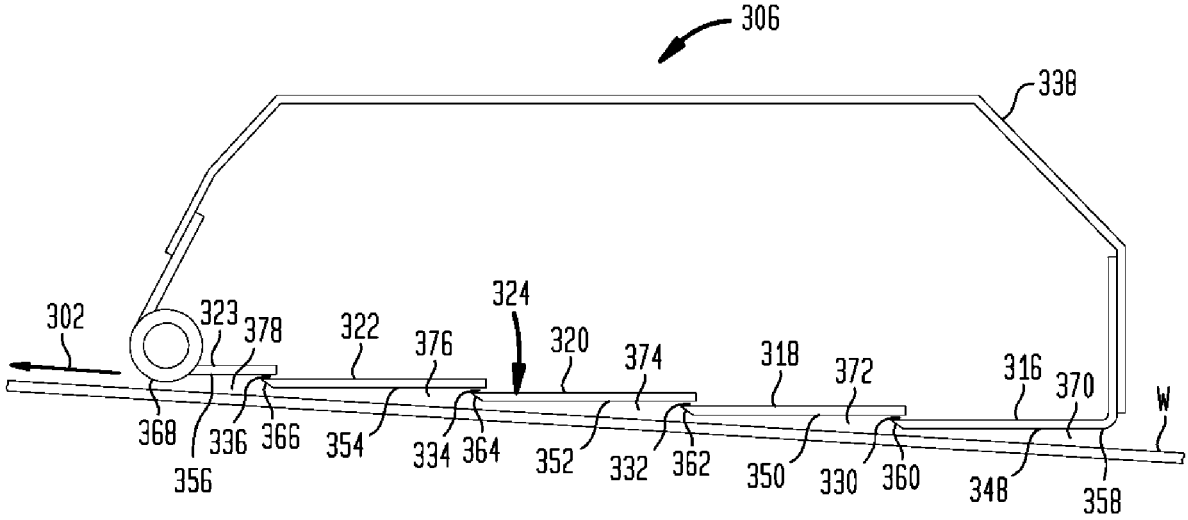
FIG. 25 is a schematic partial side view in cross-section illustrating the air foil of FIG. 24.
Figure 26:
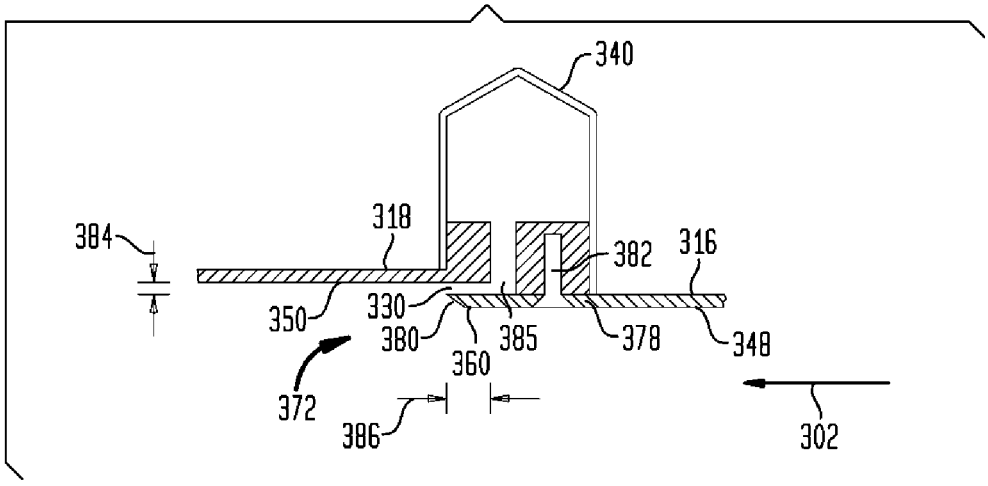
FIG. 26 is a schematic partial view in elevation of an air gap in the air foil of FIG. 25.

The construction and operation of foils 304, 306 is further appreciated by consideration of FIGS. 25 and 26. FIG. 25 is a schematic partial side view of foil 306 wherein it is shown housing 338 and surface 324 with various components. Surface 324 includes a plate 348 defined by portion 316, a plate 350 defined by portion 318, a plate 352 defined by portion 320, a plate 354 defined by portion 322 and a plate 356 defined by portion 323. The plates 348-356 as well as surface 324 are generally planar as shown in FIGS. 23-26 and overlap with each other as is best seen in FIG. 26. The plates may be unitary or segmented, but preferably segmented. In operation, web W is in sliding engagement or near engagement with foil 306 at only its most outwardly protruding portions, for example, at lead portion 358, plate junction 360, plate junction 362, plate junction 364, plate junction 366 and trailing portion 368. There is thus a plurality of cavities 370, 372, 374, 376 and 378 between web W and surface 324, each of which is supplied with air under a positive gauge pressure from manifolds 340-346 through gaps 330-336. The gaps and associated structure are preferably identical or nearly identical in configuration and have the features shown schematically in FIG. 26.

FIG. 26 is a schematic partial view in elevation and cross-section of gap 330 of foil 306 of FIGS. 23-26 showing the gap and its associated manifold 340. Manifold 340 has a plurality of walls to contain injection air generally under a positive gauge pressure of form 0.1 to 40 inches of water in communication with gap 330 through a channel 385 such that air is gently injected through gap 330 into cavity 372 between web W and surface 324 along the direction of travel 302 in region 300 of the papermachine. Plate 348 is a segmented plate including a knife edge portion or strip 378 provided with a beveled or chamfered edge 380 disposed injunction 360 and secured by a plurality of screws such as screw 382. Thus, when web W contacts junction 360, the chamfered edge 380 will not snag or damage the product since it is tapered in the direction of travel of the web. In general, the gap has an opening 384 of length 386. Opening 384 is generally from about 0.05 to about 2 mm whereas overlap length 386 may be 5 mm. It is further noted that the opening of the gap 330 is generally directed in the direction of travel 302 of the web W.

Inventive air foil 306 may be hingedly mounted in papermachine region 300 as described above in connection with other embodiments. While the injection air gaps such as gaps 330 and 332 generally have a distance between surfaces or a gap opening 384 of from about 0.05 mm to about 2 mm, from about 0.1 mm to 1 mm is typical, with from about 0.25 to about 0.75 mm often being preferred. A gap opening of about 0.5 mm is believed particularly suitable for stabilizing a wet or moist paper web. Air is supplied to the various air manifolds, such as manifold 340 supplying air to gap 330, generally at a pressure of from about 0. 1 to about 40 inches of water (positive gauge pressure) whereas preferred pressures may include from a out 0.25 to about 20 inches of water or 0.5 to 10 inches of water in some embodiments. A manifold positive pressure supplying the gap with air of from about 2 to about 3 inches of water is believed particularly suitable.

Figure 27:
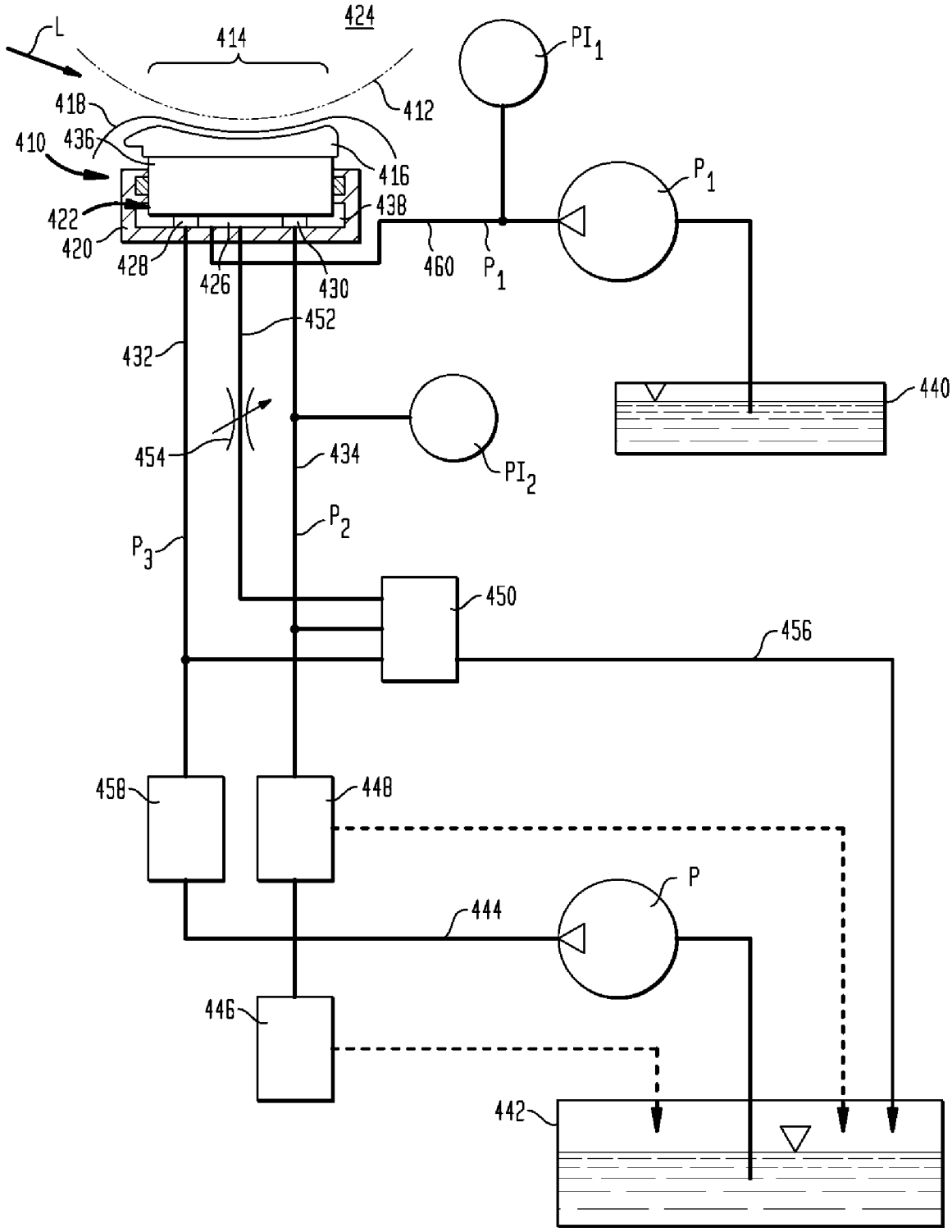
FIG. 27 is a schematic diagram of a controlled pressure shoe press useful in connection with a process of the present invention.

As noted above, web W may be compactively dewatered prior to being wet creped by a variety of methods. One method by way of a controlled pressure, extended nip shoe press, shown, for example, in U.S. Pat. No. 6,036,820 of Schiel et al., the disclosure of which is incorporated herein by reference. A controlled pressure shoe press may be inserted into the production line of FIG. 4 in any convenient position. The device may be generally configured as illustrated schematically in FIG. 27. FIG. 27 illustrates, in a partially sectioned side-view, a shoe press unit 410 in the form of a shoe press roll with an associated pressure fluid supply and an associated tilt control. Shoe press unit 410 may be utilized to treat a fibrous pulp web in a press zone 414 formed by an opposing surface 412 and elongated in a web run direction L. Shoe press unit 410 may include at least one press shoe 416, a flexible press jacket 418, e.g., a flexible press belt, guided over press shoe 416, and at least one force element 422 formed by a cylinder/piston unit and supported on a carrier 420. The at least one force element 422, and, thereby press shoe 416, presses flexible press jacket 418 against opposing surface 412 of a mating roll 424.

Besides the fibrous pulp web, one or two felts may be guided through press zone 414 formed between press jacket 418 and opposing surface 412 of mating roll 424.

The cylinder/piston unit of the at least one force element 422 includes a pressure chamber 326 having at least one pair of cylinder/piston subunits 428 and 430. Cylinder/piston subunits 428 and 430 are successively arranged (i.e., subsequent to each other) in web run direction L and may be supplied (imparted upon) with pressure fluid, via separate pressure fluid lines 432 and 434, to impart a tilting moment to press shoe 416 on a tilting axis that is at least substantially perpendicular to web run direction L. Cylinder/piston subunits 428 and 430 may be integrated into force element 422.

Further, a plurality of pairs of cylinder/piston subunits 428 and 430 may be positioned transversely to web run direction L to form two rows of cylinder/piston subunits 428 and 430 successively arranged in web run direction L.

As shown in FIG. 27 force element 422 may include a pressing piston 436 arranged within a cylinder 438. Press shoe 416 may be pressed by one or several pistons 436 arranged in one or several cylinders 438. Cylinders 438 are preferably hydraulic cylinders.

A predominant portion of a resulting force may be produced through oil pressure in pressure chamber 426 of force element 422. The oil pressure may be built up by a pump $P_1$, and may be indicated by a pressure measuring or indicator device $PI_1$. Pump $P_1$ may suction oil from a supply or reserve in an oil container 440. For the sake of clarity, several elements of the hydraulic circuit not essential to the features of the present invention that are known to the ordinarily skilled artisan, e.g., control valves and reverse movement of the oil, have been omitted.

Both cylinder/piston subunits 428 and 430 can be supplied or imparted upon with differential pressures to exert a substantially same or constant total force on press shoe 416. A hydraulic pump $P_2$, which suctions oil from an oil container 442 and conveys the suctioned oil to a pressure line 444, creates or produces the pressure to be supplied to subunits 428 and 430. If a surplus oil flow occurs in pressure line 444, the surplus may be channeled back into oil container 342 through a system pressure limiter 446. Cylinder/piston subunit 430 may be supplied with adjustable pressure via a pressure governor (regulator) 448. The corresponding pressure exerted on subunit 430 may be indicated by a pressure measuring or indicating device $PI_2$. For example, the pressure imparted to subunit 430 via pressure governor 448 may be adjustable from a value of zero to a maximum value that is less than or equal to the system pressure in pressure line 444.

The sum of fluid pressures $P_2$ and $P_3$ in respective pressure fluid lines 434 and 432, i.e., $P_2+P_3$, that is supplied to both cylinder/piston subunits 430 and 428 is maintained or kept constant and proportional to pressure $P_1$ by an addition valve 450 coupled to pressure chamber 426 of cylinder 438 of one or more force elements 422. Because of the constant fluid pressure force exerted through the differential pressure fluid lines 432 and 434 on subunits 430 and 428, the higher the pressure $P_2$ in a pressure fluid line 434 leading to cylinder/piston subunit 430 and the lower the pressure $P_3$ in a fluid line 432 leading to cylinder/piston subunit 428, the higher the press force between press jacket 418 and mating roll 424 will be at the end of press zone 414 and, the lower the press force will be at the beginning of press zone 414.

A reference pressure may be taken from pressure chamber 426 through a connection line 452 coupling pressure chamber 426 and addition valve 450. Through connection line 452, flow regulation can be provided, e.g., via an adjustable throttle 454 to substantially hinder or reduce vibrations of addition valve 450.

Surplus oil may flow through from pressure fluid line 432 to addition valve 450 and through a return pipe 456 to the oil container 442.

Between pressure fluid line 444 and pressure fluid line 432 that leads to cylinder/piston subunit 428, a flow-through limiter 458 may be provided to prevent pressure in pressure line 444 from falling too sharply when pressures are adjusted in cylinder/piston subunits 430 that are significantly higher than the medium pressure $$P_3+P_2/2$$

Flow-through limiter 458 may be, e.g., a throttle or a volume governor having a regulated flow that is smaller than a required amount of pump P. Thus, even at a pressure "zero" in pressure fluid line 432 leading to cylinder/piston subunit 428, it is ensured that the maximum system pressure in pressure line 444 is preserved.

A desired tilt of press shoe 416, and, thereby, the pressure profile curve in press zone 414, may occur via pressure governor 448 controlling the pressure in pressure fluid line 434 leading to cylinder/piston subunit 430.

Addition valve 450 substantially maintains the sum $P_2+P_3$ of pressures $p_2$ and $p_3$, imparted upon cylinder/piston units 428 and 430 substantially constant at all times and substantially fixed relative to the pressure in pressure fluid line 460 leading to pressure chamber 426. The supplied pressures may be set by the piston surfaces of addition valve 450.

The controlled pressure shoe press of FIG. 27 may be used to compactively dewater web W prior to or contemporaneously with its being adhered to Yankee 26 of FIG. 4. Generally, a controlled pressure shoe press can be used to compactively dewater the web to a consistency of about 40 percent or more.

The furnish or web may be compactively dewatered in accordance with the present invention by way of an optimized shoe press which transfers the furnish or nascent web to a transfer cylinder which may be a drier. As used herein, transfer cylinder refers to a roll that picks up the fibrous web thereby transferring the fibrous web from the foraminous carrier fabric upon which it had been carried. Typical transfer cylinders according to the present invention can include a steel roll, a metal coated roll, a granite roll, a Yankee drying cylinder, and a gas fired drying cylinder. Transfer cylinders for use according to the present method may be heated or cold. When the transfer cylinder is heated with an induction heater the cylinder is preferably constructed or coated with high diffusivity material, such as copper, to aid in increasing heat transfer. One or more transfer cylinders may be used in the process according to the present invention.

Heat is preferably applied to the transfer cylinder and/or backing roll. Heat can be applied by any art-known scheme including induction heating, oil heating and steam heating. Commercial available induction heaters can generate very high energy-transfer rates. An induction heater induces electrical current to the conducting roll surface. Since the induced current can be quite large, this factor produces a substantial amount of resistive heating in the conducting roll. Backing roll or transfer cylinder temperature can be anywhere from ambient to 700° F. but are more preferably from 180° F. to 500° F. Preferred heating schemes according to the present invention are induction heating and steam-heating.

Increased temperature in the backing roll or transfer cylinder decreases the viscosity of the water and makes the sheet more deformable hence improving water removal. Also, increased temperature and operating pressure bring the sheet into intimate contact with the transfer cylinder or backing roll, which improves heat transfer to the web. Furthermore, high steam pressure in the web within the nip can aid in rapidly displacing water from the sheet to the felt.

The pressing unit including a pressing blanket according to the present invention is, in some embodiments, an optimized shoe press. As described in more detail hereinafter, a shoe press includes a shoe element(s), which is pressed against the backing roll or transfer cylinder. The shoe element is loaded hydrodynamically against the backing roll or transfer cylinder causing a nip to be formed. A pressing belt or blanket traverses the shoe press nip with the fibrous web in contact with the foraminous fabric.

Pressing blankets can be smooth, or to enhance water removal at the press they can be grooved or blind drilled. Conventional pressing blanket designs contain a fabric coated with polyurethane where the fabric is used as reinforcement. Other pressing blanket designs use yams embedded in the polyurethane to provide reinforcement. One preferred pressing blanket according to the present invention is a yam reinforced blanket design under the tradename QualiFlex B, which is supplied by Voith Sulzer Corporation.

The shoe element length can be less than about 7 inches but is more preferably less than about 3 inches for the present invention. The shoe element may also be referred to as a hydraulic engagement member. Shoe designs can be hydrodynamic, hydrodynamic pocket, or hydrostatic. In the hydrodynamic shoe design, the oil lubricant forms a wedge at the ingoing side of the nip ultimately causing the formation of a thin oil film that protects the blanket and the shoe. The hydrodynamic pocket design incorporates a machined full width pocket in the shoe used for emptying the oil in the pressurized zone of the shoe. The final design is the hydrostatic design where oil is fed into the center region of the shoe.

Shoe presses can be open or closed. Early shoe press designs were the open belt configurations where an impermeable pressing blanket encircled a series of rollers similar to that of a fabric or felt run. These open designs suffered from papermachine system contamination by oil. The oil loss was at one time, up to 20 liters per day on some systems. The open shoe design is also inferior to a closed design since it cannot be operated in the inverted mode. The closed shoe design alleviates the oil contamination issue and is therefore preferred for use in the present invention.

According to one embodiment of the present invention, the peak pressure in the shoe press is preferably greater than about 2,000 kN/m$^2$, with a line load of preferably less than about 240 kN/m. In another embodiment of the present invention, for conventionally made wide-Yankee-dryers the peak pressure is preferably greater than about 2,000 kN/m$^2$, while the line load is preferably less than about 175 kN/m$^2$ and more preferably less than about 100 kN/m. For the purposes of the present invention, kN/m is an abbreviation for kilonewtons per meter and kN/m$^2$ is an abbreviation for kilonewtons per square meter. The peak pressure in some embodiments may be greater than 2,500 kN/m2 or even 3,000 kN/m$^2$; whereas in other embodiments the peak pressure may be from about 500 to about 2000 kN/m$^2$.

The sheet can be creped from the transfer cylinder by any suitable method using any suitable creping aid or application system.

The maximum line load a current standard Yankee can sustain is on the order of 100 kN/m. When a Yankee is used in conjunction with a suction pressure roll, the Yankee needs to be precisely crowned at the prevailing load to obtain a uniform nip. This procedure is necessary due to the inflexibility of the suction pressure roll arrangement and also due to loading at only the ends of the suction pressure roll. For the case of a shoe press, loading occurs at multiple points across the cross machine direction; individual shoe elements can be installed across the machine to give more precise cross machine direction pressing flexibility; and the shoe press is flexible and capable of conforming to the Yankee dryer surface. As a result, the precision to which the Yankee is ground for crowning will be less.

Figure 28:
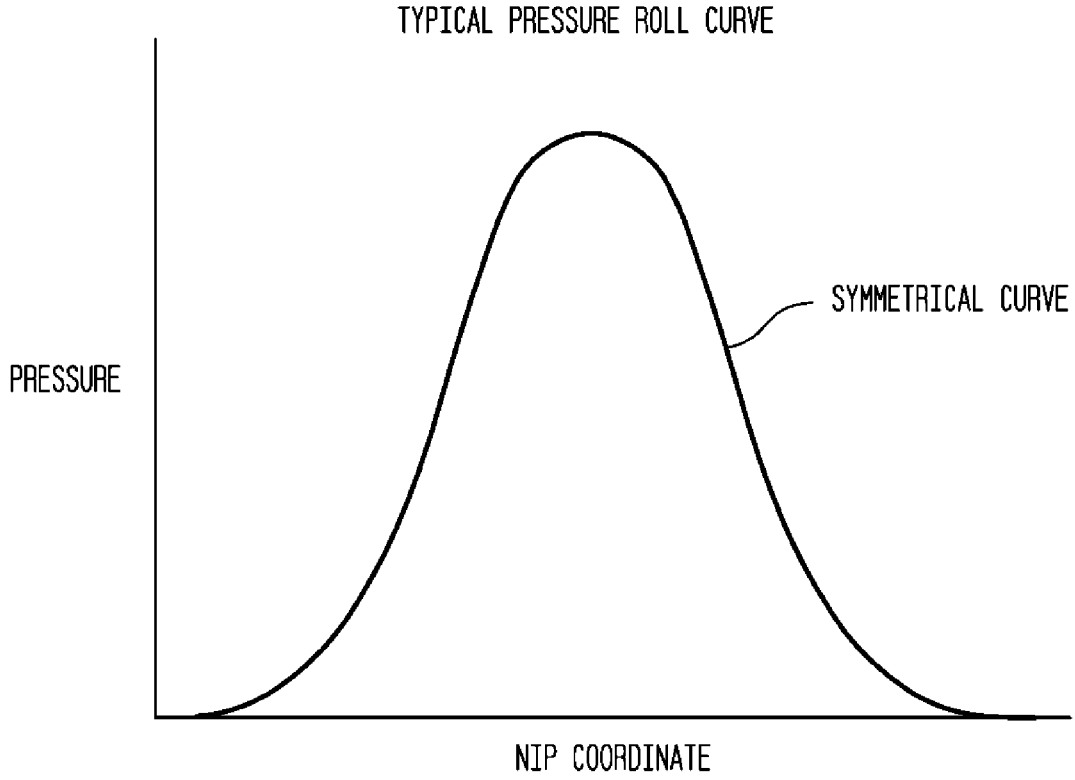
FIG. 28 illustrates a typical pressure profile in the nip of a suction pressure roll.
Figure 29:
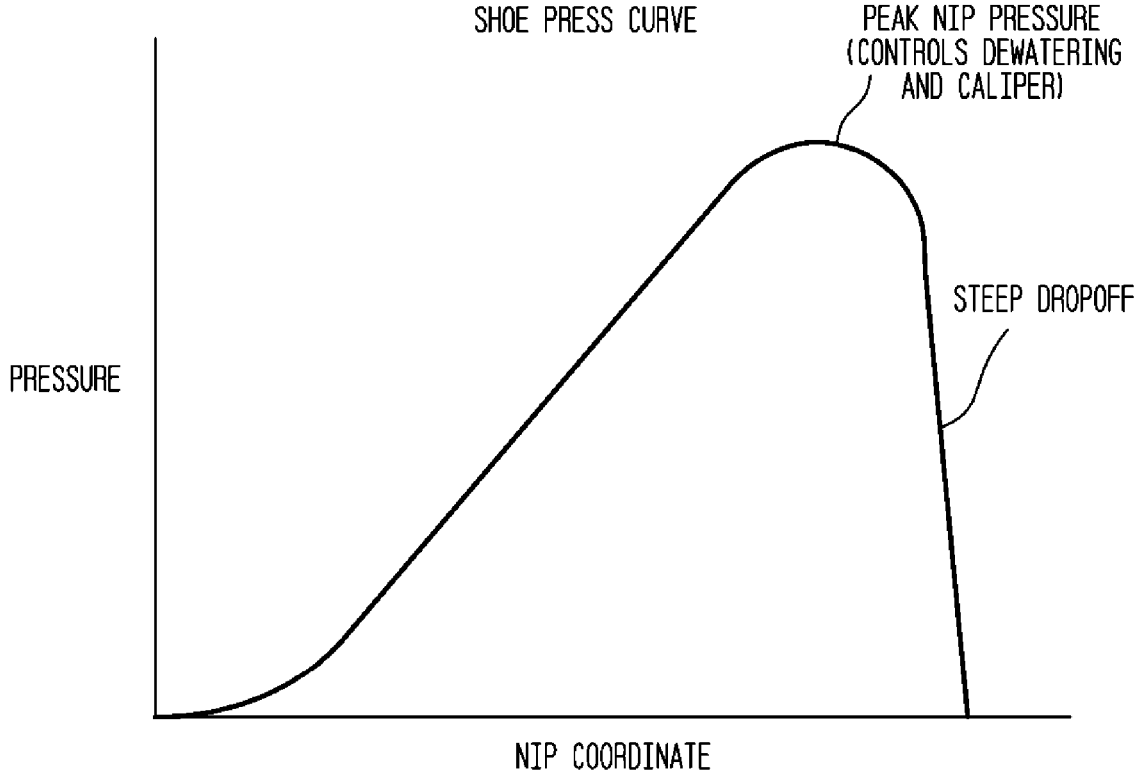
FIG. 29 illustrates a pressure profile in the nip of a shoe press.
Figure 30:
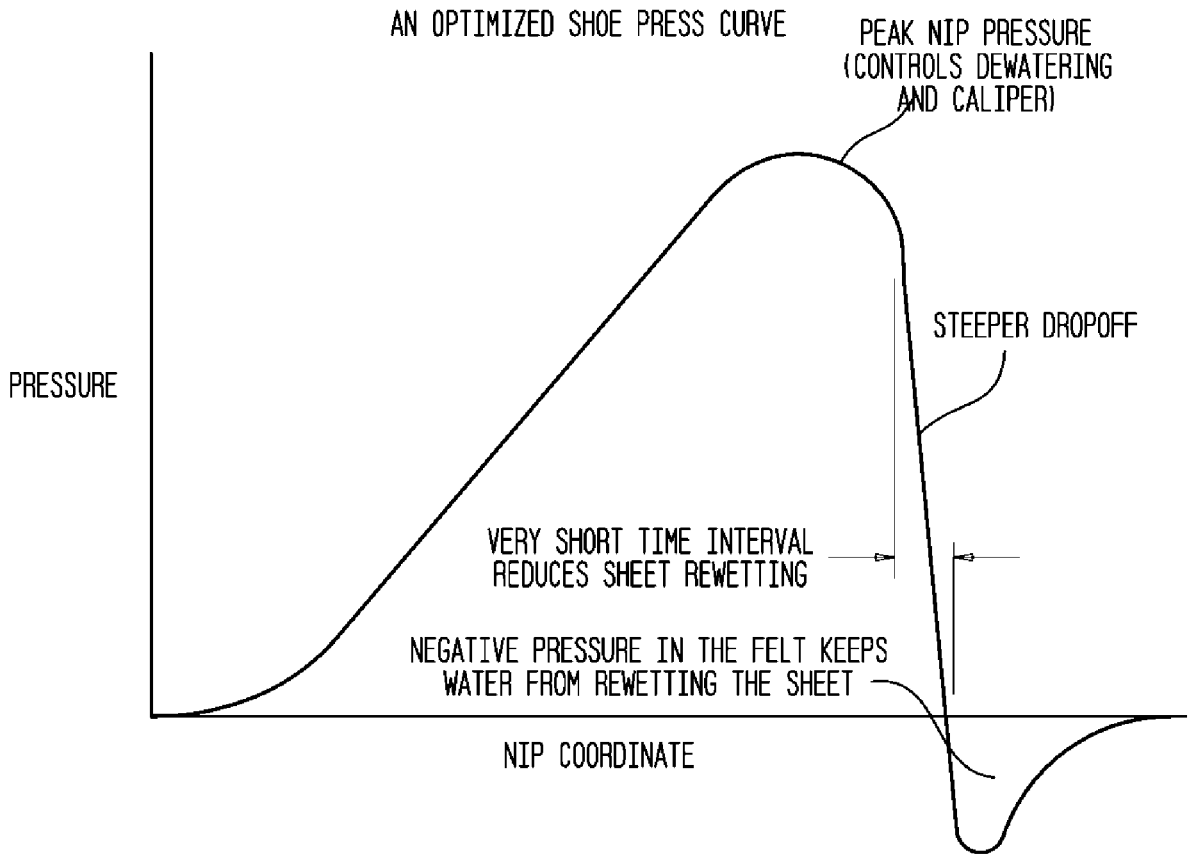
FIG. 30 illustrates a preferred pressure profile in the nip of a shoe press where the negative pressure corresponds to the vacuum level in the felt.

FIG. 28 shows a schematic sketch of typical pressure distribution curve for a suction pressure roll described by symmetrical mathematical functions like the sine and haversine curves. Since the nip pressure is relieved when the nip diverges, rewet is exacerbated for the suction pressure roll. FIG. 29 shows a schematic sketch of a pressure distribution curve for a shoe press with a steep drop off where the felt is stripped from the sheet and later from the pressing blanket. Such a steep drop-off in pressure reduces the amount of rewet. FIG. 30 shows a schematic sketch of a pressure distribution curve for a shoe press with a steeper drop off and where suction occurs in the felt at the point of simultaneous separation of the felt, sheet, and blanket when the nip pressure reaches about zero. The negative pressure in the felt, when the blanket and felt are stripped apart, is caused by capillary forces and should aid in holding water in the felt and should help further dewater the web.

Figure 31:
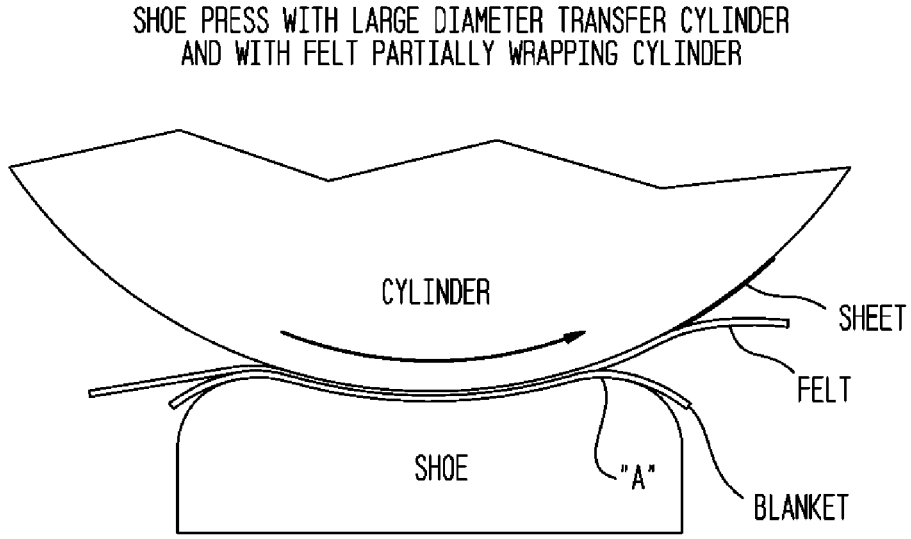
FIG. 31 illustrates a shoe press with a large diameter transfer cylinder where the felt rides the web causing rewet after the press nip.

Previous shoe, belt or blanket, and felt designs in wide nip presses do not permit optimum separation of these members. For instance, present designs allow for quick separation of the felt and blanket since the felt cannot "wrap" the unsupported blanket. But the drawback is that the felt stays in contact with the sheet allowing capillary flow back into the sheet, i.e., rewet. FIG. 31 is a schematic sketch of a shoe press nip showing sheet, felt, and blanket. Point A in FIG. 31 is the point of zero pressure on the pressure distribution curve at the exit side of the nip.

Rewet is determined in the literature by plotting moisture ratio versus the reciprocal of the basis weight using the following equation:

$$K_p = K_o + R/W$$

where $K_p$ is the moisture ratio of the paper after the wet press in grams of water per gram of fiber; $K_o$ is the moisture ratio of paper for 1/W=0; W is the basis weight in g/m$^2$; and R is the magnitude of the rewet of paper in g/m$^2$ and corresponds to the slope of the straight line used to fit moisture ratio versus reciprocal basis weight data. The aforementioned equation was first established by John Sweet. Data plotted according to the above equation is frequently referred to in the literature as a Sweet plot. The original work can be found in Sweet, J. S., *Pulp and Paper Mag.* Can., 62, No. 7: T267 (1961) and a review article can be found in Heller, H., MacGregor, M., and Bliesner, W., *Paper Technology and Industry*, p. 154, June, 1975. Rewet is much more significant for lightweight tissue grades than heavy weight linerboard grades. Rewet has been estimated to be from 5 to 50 g/m$^2$ of water, depending on the felt, furnish, etc. Rewet for a conventional shoe press can be determined from the above equation. The amount of rewet for the optimum shoe press is preferably less than about 50% of the amount determined from Sweet's theory using a conventional shoe press system. Rewet is preferably from 0 to 10 g/m$^2$ of water, more preferably from 0 to 5 g/m$^2$ of water.

Figure 32:
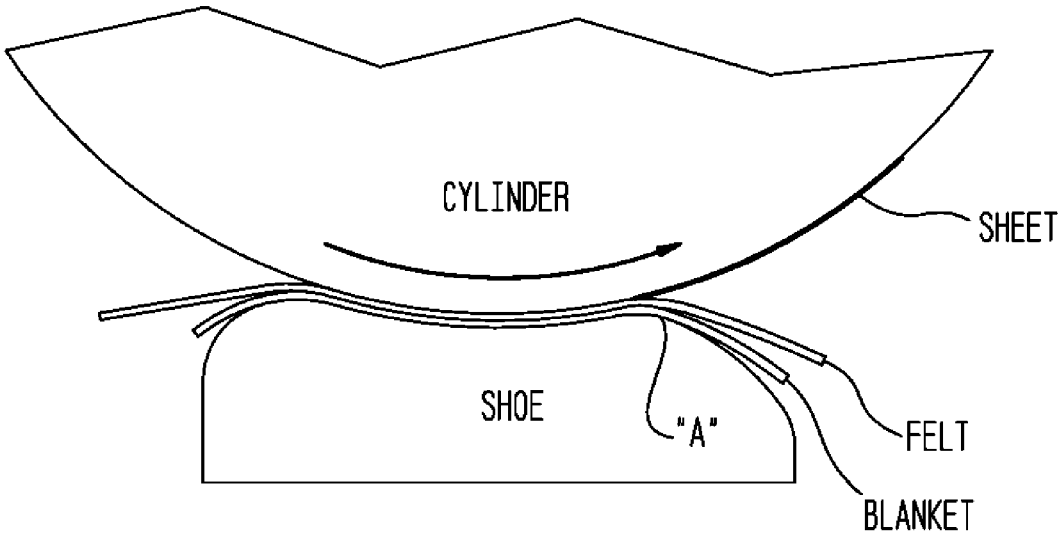
FIG. 32 illustrates a tapered shoe in a shoe press with a large diameter transfer cylinder where the felt is rapidly separated from the web but not from the pressing blanket.

According to another embodiment of the present invention, a pressing felt wraps the blanket and, therefore, pulls away quickly from the sheet reducing the time for possible rewetting. This design, as depicted in 32, can be achieved by altering the take-away angle of the felt from the nip and tapering the exit side of the shoe. To aid in blanket deflection from the felt at the exit side of the shoe, the blanket diameter can be reduced; the blanket can be eccentrically arranged with respect to the press plane; or a roll (not shown in FIG. 32) positioned against the blanket can deflect the belt further.

Figure 33:
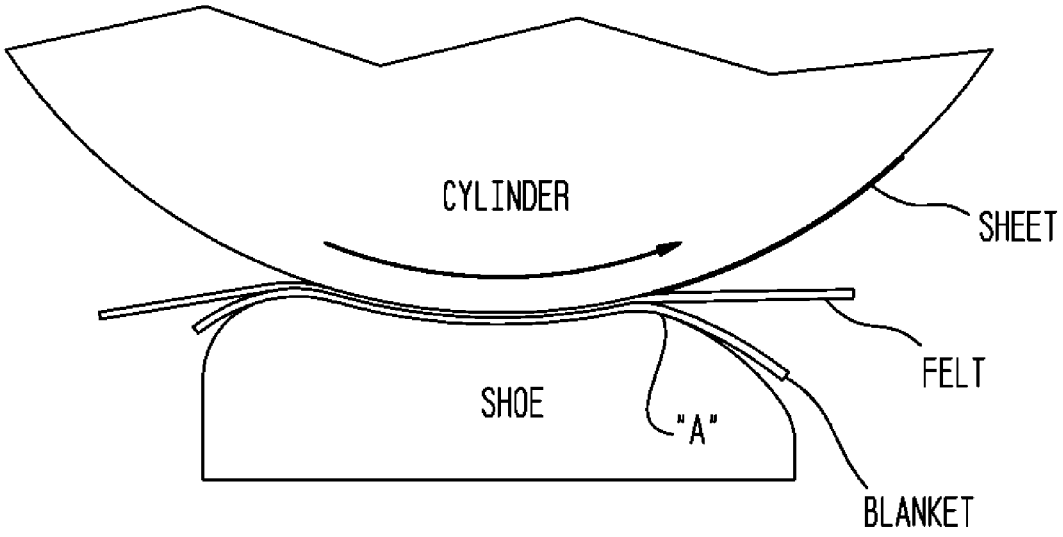
FIG. 33 illustrates a tapered shoe in a shoe press with a large diameter transfer cylinder where the felt is simultaneously stripped from the sheet and from the pressing blanket.

FIG. 33 shows another embodiment according to the present invention. In FIG. 33, a schematic sketch of a shoe press showing a sheet, felt, and blanket is displayed. This shoe press utilizes a very steep pressure drop at and following the exit of a nip curve of the press, while simultaneously separating the felt from the blanket and from the sheet. In this manner, the negative pressure generated by surface tension forces as the felt and blanket separate are effective in reducing the flow of water back into the sheet as the felt and sheet are separated The drawing shows a sharp drop off of the blanket near the shoe which, in turn, permits a quick separation of the felt from both the blanket and the sheet. The outgoing felt would be pulled at an angle that equally bisected the Yankee and blanket surfaces. Then by adjusting the tension on the felt, the exact point of separation can be controlled to affect the minimum in rewet. A felt drive roll located immediately following the shoe press can control the tension level on the felt. The objective of this embodiment according to the present invention is to affect the transfer of the sheet from the felt at the same time that the negative pulse caused by the separation of the felt and blanket occurs. This design not only minimizes the time the felt is in contact with the sheet; the added vacuum pulse will significantly reduce the amount of water than can flow, even over the short time. Point A in FIG. 33 is the point of zero pressure on the pressure distribution curve at the exit side of the nip. The nip pressure curve for the sheet/felt in FIG. 33 would most likely approach that shown in FIG. 30.

Figure 34:
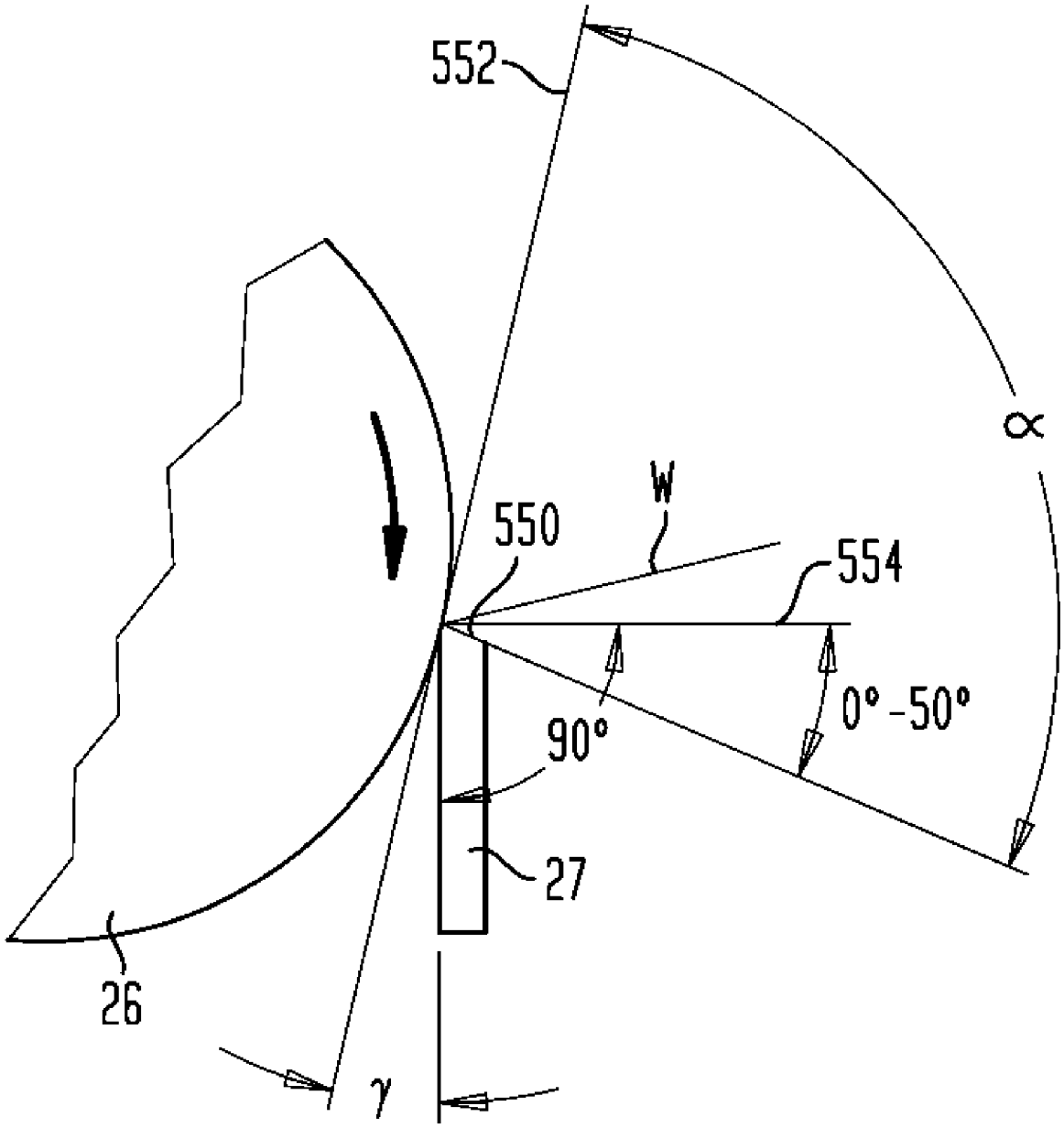
FIG. 34 is a diagram illustrating various angles involved in creping a web off of a Yankee dryer.

Referring to FIG. 34, the creping angle or pocket angle, a, is the angle that the creping shelf surface 550 makes with a tangent 552 to a Yankee dryer at the line of contact of the creping blade 27 with the rotating cylinder 26 as in FIG. 4. So also, an angle y is defined as the angle the blade body makes with tangent 552, whereas the bevel angle of creping blade 27 is the angle surface 550 defines with a perpendicular 554 to the blade body as shown in the diagram. Referring to FIG. 34, the creping angle is readily calculated from the formula:

$$\alpha=90+\text{blade bevel angle}-\gamma$$

As noted earlier, the creping angle is suitably from about 60 to about 95 degrees, whereas bevel angles may be anywhere from about 0 to bout 50 degrees with from about 5 to 15 degrees being typical.

FIGS. 35A-35C illustrate a portion of a conventionally-styled beveled creping blade 27 which may be utilized in accordance with the present invention (likewise a rectangular profile may be employed). Blade 27 includes a creping shelf surface 550 defining a creping ledge width of length, s, a blade body 556 which has an inner body surface 558 and an outer body surface 560. In operation, blade 27 is juxtaposed, for example, with Yankee dryer 26 as shown in FIGS. 4 and 12 such that shelf surface 550 contacts the wet web W during creping. One method, and perhaps a preferred method of ensuring a narrow shelf wherein the creping shelf effective width is no more than about 3 times the sheet thickness is to make the length S sufficiently small so that it is not possible to accumulate more material than can be supported on surface 550. Most preferably, the distance over which material accumulates on the surface of the creping blade should be only slightly greater than the sheet thickness on the Yankee dryer prior to creping. The length of the shelf, S, is suitably from about 0.005 to about 0.025 inches. Practical means of executing this include lightly loaded narrow shelf steel creping blades and ceramic blades ground in a fashion so as to self sharpen while maintaining the desired ledge width. Other methods of controlling the distance over which creped material accumulates on a creping blade shelf surface such as surface 550 include carefully selected blade surface material, geometry and accelerated sheet removal as further discussed herein.

In all cases, the creping shelf effective width, that is, the distance in the direction of travel of the web wherein web material accumulates on a creping blade ledge is less than about 3 times (and most preferably only slightly greater than) the thickness of the wet web on the Yankee dryer prior to creping thereof. For purposes of convenience, however, the crepe shelf effective width is also defined in terms of thicknesses of dry sheet by the same relationships.

Figure 36:
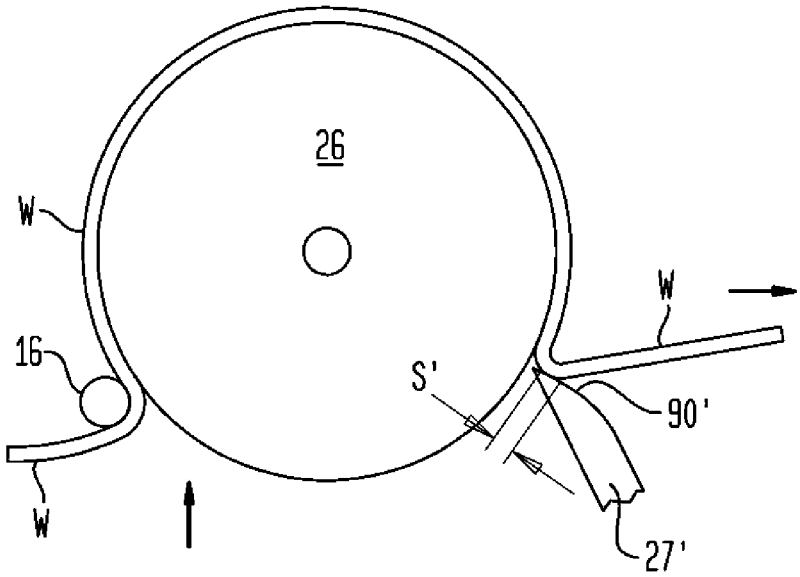
FIGS. 36 and 37 are schematic diagrams illustrating various methods of maintaining a narrow effective creping shelf.

Narrow shelf creping is further appreciated by reference to FIG. 36. Web W is applied to a Yankee dryer 26 by way of a press roll 16 as discussed in connection with FIG. 4. Web W is thereafter dried to a consistency of from about 30 to about 90% prior to being creped by blade 27'. Blade 27' is provided with a parabolic creping ledge 90' with a decreasing radius away from the line of contact of the creping blade with Yankee 26. This geometry is conducive to maintaining a narrow creping shelf effective width S' as shown. The effective width is thus defined as the distance over the creping blade ledge that the web contacts the blade.

Figure 37:
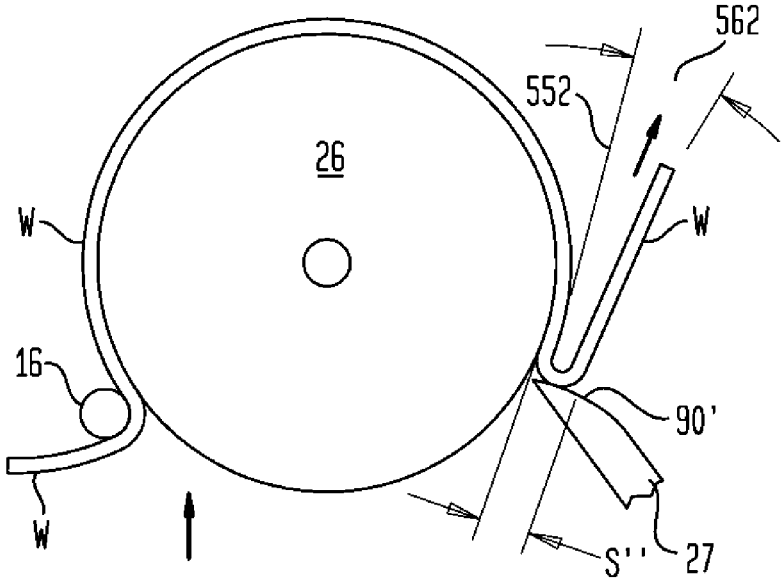

So also, accelerated sheet removal can be used to maintain a narrow creping shelf effective width as shown in FIG. 37. In FIG. 37, web W is applied to Yankee dryer 26 by way of press roll 16 as shown in FIG. 3. Thereafter, web W is creped off of the Yankee by blade 27. The sheet direction is controlled to make an angle 562 between the sheet and the tangent 552 to Yankee 26 at the line of creping of less than about 60 degrees. Angle 562 is suitably less than about 45 degrees. In this way, the creping shelf effective width, S", is kept small.

In some embodiments of the present invention, creping of the paper from a Yankee dryer is carried out using an undulatory creping blade, such as that disclosed in U.S. Pat. No. 5,690,788, the disclosure of which is incorporated by reference. Use of the undulatory crepe blade has been shown to impart several advantages when used in production of tissue products generally and especially when made primarily or entirely from recycled fibers. In general, tissue products creped using an undulatory blade have higher caliper (thickness), increased CD stretch, and a higher void volume than do comparable tissue products produced using conventional crepe blades. All of these changes effected by use of the undulatory blade tend to correlate with improved softness perception of the tissue products.

A salient advantage of using the undulatory blade is that there is a greater drop in sheet tensile strength during the creping operation than occurs when a standard creping blade is used. This drop in strength, which also improves product softness, is particularly beneficial when tissue base sheets having relatively high basis weights (>9 lbs/ream) or containing substantial amounts of recycled fiber are produced. Such products often have higher-than-desired strength levels, which negatively affect softness. In sheets including high levels of a recycled fiber, a reduction in strength equivalent to that caused by use of undulatory crepe blade can be effected, if at all, by application of extremely high levels of chemical debonders. These high debonder levels, in addition to increasing product cost, white water loading of unretained debonder, felt filling, foaming and so forth, can also result in problems such as loss of adhesion between the sheet and the Yankee dryer, which adversely impacts sheet softness, runnability and formation of deposits in stock lines and chests. FIGS. 38A through 38D illustrate a portion of a preferred undulatory creping blade 570 usable in the practice of the present invention in which a surface 572 extends indefinitely in length, typically exceeding 100 inches in length and often reaching over 26 feet in length to correspond to the width of the Yankee dryer on the larger modern paper machines. Flexible blades of the patented undulatory blade having indefinite length can suitably be placed on a spool and used on machines employing a continuous creping system. In such cases the blade length would be several times the width of the Yankee dryer. In contrast, the height of the blade 570 is usually on the order of several inches while the thickness of the body is usually on the order of fractions of an inch.

As illustrated in FIGS. 38A through 38D, an undulatory cutting edge 573 of the patented undulatory blade is defined by serrulations 576 disposed along, and formed in, one edge of the surface 572 so as to define an undulatory engagement surface. Cutting edge 573 is preferably configured and dimensioned so as to be in continuous undulatory engagement with Yankee 26 when positioned as shown in FIG. 34, that is, the blade continuously contacts the Yankee cylinder in a sinuous line generally parallel to the axis of the Yankee cylinder. In particularly preferred embodiments, there is a continuous undulatory engagement surface 580 having a plurality of substantially colinear rectilinear elongate regions 582 adjacent a plurality of crescent shaped regions 584 about a foot 586 located at the upper portion of the side 588 of the blade which is disposed adjacent the Yankee. Undulatory surface 580 is thus configured to be in continuous surface-to-surface contact over the width of a Yankee cylinder when in use as shown in FIG. 34 in an undulatory or sinuous wave-like pattern.

Several angles are used in order to describe the geometry of the cutting edge of the undulatory blade of the patented undulatory blade. To that end, the following terms are used:

Creping angle "α"—the angle between the rake surface 578 of the blade 570 and the plane tangent to the Yankee at the point of intersection between the undulatory cutting edge 573 and the Yankee;

Axial rake angle "β"—the angle between the axis of the Yankee and the undulatory cutting edge 573 which is the curve defined by the intersection of the surface of the Yankee with indented rake surface of the blade 570;

Relief angle "γ"—the angle between surface 572 of the blade 570 and the plane tangent to the Yankee at the intersection between the Yankee and the undulatory cutting edge 573, the relief angle measured along the flat portions of the present blade is equal to what is commonly called "blade angle" or holder angle", that is "γ" in FIG. 34 as noted above.

Quite obviously, the value of each of these angles will vary depending upon the precise location along the cutting edge at which it is to be determined. The remarkable results achieved with the undulatory blades of the patented undulatory blade in the manufacture of the absorbent paper products are due to those variations in these angles along the cutting edge. Accordingly, in many cases it will be convenient to denote the location at which each of these angles is determined by a subscript attached to the basic symbol for that angle. As noted in the '788 patent, the subscripts "f", "c" and "m" refer to angles measured at the rectilinear elongate regions, at the crescent shaped regions, and the minima of the cutting edge, respectively. Accordingly, "$\gamma_f$", the relief angle measured along the flat portions of the present blade, is equal to what is commonly called "blade angle" or "holder angle". In general, it will be appreciated that the pocket angle $\alpha_f$ at the rectilinear elongate regions is typically higher than the pocket angle $\alpha_c$ at the crescent shaped regions.

The undulatory creping blade may be used in connection with curled fiber, a controlled pressure shoe press and a temperature differential through a web adhered to a heated rotating cylinder to practice a process of the present invention as set forth in the appended claims. Numerous modifications to the foregoing specific embodiments within the spirit and scope of the claims will be readily apparent to those of skill in the art.

What is claimed is:

1. A wet crepe, throughdry process for making sheet comprising the steps of:

(a) depositing an aqueous fibrous furnish on a foraminous support;

(b) compactively dewatering said furnish to form a web;

(c) applying said dewatered web to a heated rotating cylinder and drying said web to a consistency of from about 15 percent to about 60 percent; and (d) creping said web from said heated cylinder at said consistency of from about 15 percent to about 60 percent in a creping nip utilizing a creping fabric traveling at a speed slower than the speed of said heated rotating cylinder so as to apply a percent crepe to said web of from about 5 percent to about 50 percent;

(e) throughdrying said web subsequent to creping said web from said heated cylinder to form said sheet, wherein said sheet has a void volume fraction of from about 0.55 to about 0.85 and is characterized in that said sheet exhibits a wet springback ratio of at least about 0.6 and a hydraulic diameter of from about $3\times10^{-6}$ ft to about $8\times10^{-5}$ ft with the provisos: (a) that when the void volume fraction of said sheet exceeds about 0.72, said hydraulic diameter of said sheet is less than about $8\times10^{-6}$ ft; and (b) that when the void volume fraction of the sheet exceeds about 0.8, said hydraulic diameter of said sheet is less than about $7\times10^{-6}$ ft.

2. The method according to claim 1, wherein a percent crepe of from about 10 to about 35 percent is applied to said web by way of said creping step.

3. The method according to claim 2, wherein a percent crepe of about 15 percent is applied to said web by way of said creping step.

4. The method according to claim 1, wherein said web is creped from said heated cylinder at a consistency of from about 25 percent to about 60 percent.

5. The method according to claim 4, wherein said web is creped from said heated cylinder at a consistency of from about 40 to about 60 percent.

6. The method according to claim 1 utilized for making an absorbent sheet with a basis weight of at least about 12 lbs/3000 $ft^2$.

7. The method according to claim 6, utilized for making an absorbent sheet with a basis weight of at least about 15 lbs/3000 $ft^2$.

8. The method according to claim 7, utilized for making an absorbent sheet with a basis weight of at least about 20 lbs/3000 $ft^2$.

9. The method according to claim 8, utilized for making an absorbent sheet with a basis weight of at least about 25 lbs/3000 $ft^2$.

10. The method according to claim 9, utilized for making an absorbent sheet with a basis weight of at least about 30 lbs/3000 $ft^2$.

11. The method according to claim 1, wherein said sheet is prepared from a fibrous furnish comprising fiber other than virgin cellulosic fiber.

12. The method according to claim 11, wherein said furnish comprises a non-wood fiber selected from the group consisting of straw fibers, sugarcane fibers, bagasse fibers and synthetic fibers.

13. The method according to claim 11, wherein said aqueous furnish comprises recycled fiber.

14. The method according to claim 13, wherein the recycled fiber in said aqueous furnish comprises at least about 50 percent by weight of the fiber present.

15. The method according to claim 14, wherein the recycled fiber present in said aqueous furnish comprises of at least about 75 percent by weight of the fiber present.

16. The method according to claim 15, wherein the cellulosic fiber present in said aqueous furnish consists essentially of recycled fiber.

17. The method according to claim 1, wherein said web is throughair dried at a rate of at least 40 pounds of water removed per square foot of throughair drying surface per hour.

18. The method according to claim 17, wherein said web is dried by throughair drying at a drying rate of at least about 50 pounds of water removed per square foot of throughair drying surface per hour.

19. The method according to claim 1, wherein said step of depositing said aqueous cellulosic furnish on said foraminous support includes foam-forming said furnish on said foraminous support.

20. The method according to claim 1, wherein said furnish is a foamed furnish and comprises from about 150 to about 500 ppm by weight of a foam-forming surfactant.

21. The method according to claim 20, wherein said foamed furnish has a consistency of from about 0.1 to about 3 percent.

22. The method according to claim 1, wherein at least about 5 percent of the fiber in said aqueous furnish has been subjected to a curling process.

23. The method according to claim 22, wherein at least about 10 percent of the fiber in said aqueous furnish has been subjected to a curling process.

24. The method according to claim 23, wherein at least about 25 percent of the fiber is said aqueous furnish has been subjected to a curling process.

25. The method according to claim 24, wherein at least about 50 percent of the fiber in said aqueous furnish has been subjected to a curling process.

26. The method according to claim 25, wherein at least about 75 percent of the fiber in said aqueous furnish has been subjected to a curling process.

27. The method according to claim 26, wherein at least about 90 percent of the fiber in said aqueous furnish has been subjected to a curling process.

28. The method according to claim 22, wherein said method of curling said fiber comprises concurrently heat-treating and convolving said fiber at an elevated temperature.

29. The method according to claim 28, wherein said fiber is curled in a disk refiner with saturated steam at a pressure of from about 5 to about 150 psig.

30. The method according to claim 1, wherein said heated cylinder is maintained at an elevated temperature relative to its surroundings so as to produce a temperature differential of from about 5° F. to about 80° F. between the cylinder side of said web and the air side of said web upon creping.

31. The method according to claim 30, wherein said temperature differential is between about 10° F. and about 40° F.

32. The method according to claim 31, wherein said temperature differential is about 15° F. and about 30° F.

33. The method according to claim 32, wherein said temperature differential is about 20° F.

34. The method according to claim 30, further comprising the step of pressure molding said web subsequent to creping said web by deflecting said web into an impression fabric.

35. The method according to claim 34, wherein the air side of said web is relatively moist with respect to the cylinder side of said web and the air side is deflected into said impression fabric.

36. The method according to claim 1, wherein said sheet exhibits a void volume of at least about 6.5 gms/gm.

37. The method according to claim 36, wherein said sheet exhibits a void volume of at least about 7 gms/gm.

38. The method according to claim 37, wherein said sheet exhibits a void volume of at least about 7.5 gms/gm.

39. The method according to claim 38, wherein said sheet exhibits a void volume of at least about 8 gms/gm.

40. The method according to claim 1, wherein the air side of said web is at a temperature of from about 160° F. to about 210° F. upon creping.

41. The method according to claim 40, wherein the air side of said web is at a temperature of from about 180° F. to about 200° F. upon creping.

42. The method according to claim 41, wherein the air side of said web is at a temperature of about 190° F. upon creping.

43. The method according to claim 1, wherein the cylinder side of said sheet is at a temperature of from about 210° F. to about 240° F. upon creping.

44. The method according to claim 43, wherein the cylinder side of said sheet is from about 220° F. to about 230° F. upon creping.

45. The method according to claim 1, wherein steam is supplied to said heated cylinder at a pressure of from about 30 to about 150 psig.

46. The method according to claim 45, wherein steam is supplied to said heated cylinder at a pressure of at least about 100 psig.

47. The method according to claim 1, wherein said step of compactively dewatering said furnish comprises pressing said furnish in a controlled pressure shoe press.

48. A wet crepe, throughdry process for making sheet comprising the steps of:

(a) depositing an aqueous fibrous furnish on a foraminous support;

(b) compactively dewatering said furnish to form a web;

(c) applying said dewatered web to a heated rotating cylinder and drying said web to a consistency of from about 15 percent to about 60 percent;

(d) creping said web from said heated cylinder at said consistency of from about 15 percent to about 60 percent in a creping nip utilizing a creping fabric traveling at a speed slower than the speed of said heated rotating cylinder so as to apply a percent crepe to said web of from about 5 percent to about 50 percent;

(e) throughdrying said web subsequent to creping said web from said heated cylinder to form said sheet, wherein said sheet has a void volume fraction of from about 0.55 to about 0.85 and is characterized in that said sheet exhibits a wet springback ratio of at least about 0.6 and a hydraulic diameter of from about $3\times10^{-6}$ ft to about $8\times10^{-5}$ ft with the provisos: (a) that when the void volume fraction of said sheet exceeds about 0.72, said hydraulic diameter of said sheet is less than about $8\times10^{-6}$ ft; and (b) that when the void volume fraction of the sheet exceeds about 0.8, said hydraulic diameter of said sheet is less than about $7\times10^{-6}$ ft, further comprising the step of creping said web from said creping fabric utilizing a second fabric traveling at a speed slower than said creping fabric so as to apply an additional percent crepe of from about 5 percent to about 50 percent.

49. The method according to claim 48, wherein an additional percent crepe of from about 10 to about 35 percent is applied to said web by way of transfer from said creping fabric to said second fabric.

* * * * *